US008298353B2

(12) United States Patent
Saha et al.

(10) Patent No.: US 8,298,353 B2
(45) Date of Patent: Oct. 30, 2012

(54) ULTRATOUGH HIGH-STRENGTH WELDABLE PLATE STEEL AND ITS METHOD OF MANUFACTURING THEREOF

(75) Inventors: Arup Saha, Portland, OR (US); Gregory B. Olson, Riverwoods, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 13/134,965

(22) Filed: Jun. 22, 2011

(65) Prior Publication Data

US 2012/0125492 A1 May 24, 2012

Related U.S. Application Data

(62) Division of application No. 10/579,030, filed as application No. PCT/US2004/037808 on Nov. 12, 2004, now Pat. No. 8,016,954.

(60) Provisional application No. 60/519,388, filed on Nov. 12, 2003.

(51) Int. Cl.
*C22C 38/42* (2006.01)
*C22C 38/44* (2006.01)
*C21D 8/00* (2006.01)

(52) U.S. Cl. ..... 148/328; 148/332; 148/334; 148/335; 148/547; 148/654; 148/663; 148/664

(58) Field of Classification Search ..... 148/328, 148/332–335, 547, 653, 654, 663, 664; 420/91–93
See application file for complete search history.

(56) References Cited

U.S. PATENT DOCUMENTS

| | | | | |
|---|---|---|---|---|
| 3,453,152 | A | 7/1969 | Hill et al. | 148/12.4 |
| RE28,523 | E | 8/1975 | Hill et al. | 420/8 |
| 4,964,926 | A | 10/1990 | Hill | 148/325 |
| 5,454,883 | A | 10/1995 | Yoshie et al. | 148/320 |
| 6,162,389 | A | 12/2000 | Hase et al. | 420/92 |

FOREIGN PATENT DOCUMENTS

WO WO 02101112 12/2002

OTHER PUBLICATIONS

Cormerford, L.W., Study of the microstructural basis for the strength and toughness properties of overaged HSLA-100 steel, Report (1991) , Order No. AD-A246955, 115pp. Avail. :NTIS from Gov. Rep. Announce. Index (U.S.) 1992, 92(12) Abstr. No. 233, 370 (provided abstract only) Jun. 1991.

*Primary Examiner* — Deborah Yee

(57) ABSTRACT

A transformation toughened, high-strength steel alloy useful in plate steel applications achieves extreme fracture toughness (Cv > 80 ft-lbs corresponding to KId=200 ksi.in ½) at strength levels of 150-180 ksi yield strength, is weldable and formable. The alloy is characterized by dispersed austenite stabilization for transformation toughening to a weldable, bainitic plate steel and is strengthened by precipitation of M2C carbides in combination with copper and nickel. The desired microstructure is a matrix containing a bainite-martensite mix, BCC copper and M2C carbide particles for strengthening with a fine dispersion of optimum stability austenite for transformation toughening. The bainite-martensite mix is formed by air-cooling from solution treatment temperature and subsequent aging at secondary hardening temperatures to precipitate the toughening and strengthening dispersions.

6 Claims, 61 Drawing Sheets

| | |
|---|---|
| G (gage length) | 30 ± 0.1 mm (1.18" ± 0.004") |
| D (gage diameter) | 6 ± 0.1 mm (0.24" ± 0.004") |
| R (radius of fillet) | 6 mm (0.24") |
| A (length of reduced section) | 36 mm (1.42") |

ULTRATOUGH HIGH-STRENGTH WELDABLE PLATE STEEL AND ITS METHOD OF MANUFACTURING THEREOF

CROSS-REFERENCE TO RELATED APPLICATION

This application is a divisional of Ser. No. 10/579,030 filed Feb. 27, 2007, now U.S. Pat. No. 8,016,945 issued Sep. 13, 2011 which was the National Stage of International Application No. PCT/US2004/037808 filed Nov. 12, 2004, which claims benefits of U.S. provisional application Ser. No. 60/519,388 filed Nov. 12, 2003, the disclosures of all of which are incorporated herein by reference.

REFERENCE TO GOVERNMENT RESEARCH CONTRACTS

This development was supported by the Office of Naval Research (Grant No. N00014-01-1-0953.

BACKGROUND OF THE INVENTION

In a principal aspect, the present invention relates to a steel alloy and a process for making such an alloy which exhibits new levels of strength and toughness while meeting processability requirements. The ultratough, weldable secondary hardened plate steel alloys for structural applications exhibits fracture toughness ($K_{Id}$ 200 ksi.in$^{1/2}$) at strength levels of 150-180 ksi yield strength, is weldable and formable.

Throughout the history of materials development, there has been an ever-increasing need for stronger, tougher, more fracture resistant and easily weldable plate steels for structural applications at minimal cost. Unfortunately, however, any increase in strength is rarely achieved without concomitant decreases in toughness and ductility, which limits the utility of most ultrahigh-strength steels. The best combinations of strength and toughness have usually been obtained from martensitic microstructures as shown in FIG. 1.

High strength bainitic steels have not been as successful in practice because of coarse cementite particles in bainite that are detrimental to toughness. Nonetheless, a potential benefit motivating research of air-hardened steels containing bainite/martensite mixtures is the ease of processing, which may lead to a product with good performance at a relatively lower cost. The possibility of improving the strength and toughness simultaneously using fine-grained bainitic ferrite plates and enhancing the toughness by transformation toughening effects presents a technological challange. Further improvements of strength can possibly be achieved with co-precipitation of alloy carbides and bcc copper for easily weldable, low-carbon steels again presenting a technological challenge.

It is now known that the interaction of deformation-induced martensitic transformation of dispersed austenite with fracture-controlling processes such as microvoid induced shear localization results in substantial improvements in fracture toughness called Dispersed Phase Transformation Toughening (DPTT). Transformation toughening is attributed to modification of the constitutive behavior of the matrix through pressure-sensitive strain hardening associated with the transformation volume change. The transformation behavior and the toughening effects are controlled by the stability of the austenite dispersion. For transformation toughening at high strength levels, the required stability of the austenite dispersion is quite high and can be achieved only by size refinement and compositional enrichment of the austenite particles. The size influences the characteristic potency of nucleation sites in the particles while the composition influences the chemical driving force and interfacial friction for the martensitic transformation. The size refinement and the compositional enrichment of the austenite can possibly be controlled with heat treatments such as multi-step tempering.

With this general background, design objectives motivating the invention are the achievement of extreme impact fracture toughness ($C_v$>85 ft-lbs corresponding to fracture toughness, $K_{Id}$>200 ksi.in$^{1/2}$ and $K_{Ic}$>250 ksi.in$^{1/2}$) at high strength levels of 150-180 ksi yield strength in weldable, formable plate steels with high resistance to hydrogen stress corrosion cracking ($K_{ISCC}/K_{IC}$>0.5). Design goals are marked by the star in the cross-plot of $K_{Ic}$ fracture toughness and yield strength illustrated in FIG. 2. This design aims to substantially expand the envelope marked as "steels" to the top right corner of the plot. Optimization of such a system and achievement of design goals can possibly be effectively achieved by consideration of the methods of systems design. FIG. 3 describes in general a system approach to design steel with the specified strength, toughness levels as well as optimum weldability and hydrogen resistance.

As further background, recent studies have shown that selection of fine Ti(C,N) as a grain refining dispersion contributes to increasing the fracture resistance by delaying the coalescence of microvoids among the primary voids. Studies have also suggested that the resistance to primary void formation and coalescence is proportional to inclusion spacing. Thus, it may be desirable to reduce the volume fraction of primary inclusions or coarsen inclusions for a given volume fraction. This can be achieved by clean melt practices and tight composition control. However, engineering design fracture toughness parameters like $K_{Ic}$ and $K_{Id}$ are difficult and expensive to measure. Thus for preliminary design analyses, small-scale inexpensive fracture measurements like Charpy V-notch impact energy ($C_V$) values may be used to estimate $K_{Ic}$ and $K_{Id}$. Studies of fracture toughness dependence on loading rate measured over a temperature range have shown that $K_{Ic}$ fracture toughness values under static and intermediate loading are about 20% higher than the $K_{Id}$ measured under impact loading. An approximate correlation between $K_{Ic}$ and $C_V$ test results for conventionally grain-refined steels is as follows:

$$K_{IC}^{2=AC_V} \quad (1)$$

where A is a constant of proportionality. Fitting equation (1) to results from high Ni steels is shown in FIG. 4.

According to these relationships, the $C_V$ impact toughness objective of 85 ft-lbs corresponds to a $K_{Ic}$ fracture toughness under static loading of 250 ksi.in$^{1/2}$ and a dynamic $K_{Id}$ of 200 ksi.in$^{1/2}$.

A fine carbide dispersion may need to be obtained in order to achieve the desired strength level. Coherent $M_2C$ carbides have been used in secondary hardened steels that are currently in use. Previous work to optimize the carbide particle size for maximizing the strength 3 nm carbide precipitates corresponding to the transition from particle shear to Orowan bypass may provide maximum strength. Thermodynamics and kinetics of carbide precipitation may need to be controlled to obtain such a fine $M_2C$ carbide dispersion. The driving force for $M_2C$ nucleation may also be maximized by proper control of the amount and ratio of carbide formers in the alloy to refine the $M_2C$ particle size. Sufficient $M_2C$ precipitation may need to be achieved to dissolve cementite in order to attain the desired toughness levels because coarse cementite particles are extremely deleterious as microvoid nucleation sites. Tempering times should also be minimized to prevent impurity segregation at grain boundaries.

Even if low alloy carbon levels are maintained, steels containing higher alloying content might help in achieving the desired combination of mechanical properties, but may reduce the weldability of the material by increasing hardenability. For any structural material, the heat-affected zones (HAZ) adjacent to the welded joints are considered to be the weakest links. Weldability of steels is generally controlled by both the matrix and the strengthening dispersion structures. As a rule of thumb, for adequate weldability of the steel C content of the alloy should be kept below 0.05 wt %. This in turn limits the C available for $M_2C$ strengthening. For a bainitic matrix, modification of the hardenability of the steel may provide bainite with a much lower cooling rate. However, weldability can deteriorate as the hardenability increases. Again, numerous interrelated technological challenges are apparent in view of various known considerations.

Ultra-high strength steels are prone to a decrease of fracture toughness in aqueous environments due to hydrogen assisted cracking. This reduction of toughness is caused by intergranular brittle fracture associated with impurity segregation to grain boundaries, which may reduce toughness of the steel by as much as 80% in a corrosive environment. The common impurities in steel are P and S, both of which are embrittlers since they have lower free energy on a surface than at a grain boundary. An effective way of reducing them is by cleaner processing techniques or impurity gettering. Impurity gettering can tie up P and S as stable compounds formed during solidification. La and Zr have been found to be effective impurity gettering elements. Another approach to minimize impurity effects is by design of grain boundary chemistry. Segregating elements like W and Re preferentially on the grain boundaries that may enhance grain boundary cohesion could be beneficial to the stress corrosion cracking resistance. Small amounts of dissolved B may also help in grain boundary cohesion. In view of the numerous foregoing factors and information, a need for an improved high strength plate steel was addressed.

SUMMARY OF THE INVENTION

A transformation toughened ultratough high-strength steel alloy useful in plate steel applications achieves extreme fracture toughness ($C_v$>80 ft-lbs corresponding to $K_{Id}$ 200 ksi.in$^{1/2}$) at strength levels of 150-180 ksi yield strength, is weldable and formable. The alloy employs dispersed austenite stabilization for transformation toughening to a weldable, bainitic plate steel and is strengthened by precipitation of $M_2C$ carbides in combination with copper and nickel. The desired microstructure is a matrix containing a bainite-martensite mix, BCC copper and $M_2C$ carbides for strengthening with a fine dispersion of optimum stability austenite for transformation toughening. The bainite-martensite mix is formed by air-cooling from solution treatment temperature and subsequent aging at secondary hardening temperatures to precipitate the toughening and strengthening dispersions.

More specifically, steel alloys nominally in weight percent comprised of about 0.03 to 0.055 carbon (C), 3.5 to 5.0 copper, 6.0 to 7.5 nickel (Ni), 1.6 to 2.0 chronimym (Cr), 0.2 to 0.6 martensite (Mo), 90.05 to 0.20 vanadium (V) and the balance iron (Fe) and insubstantial impurities is formed from a melt and heat treated by various steps including tempering, for example, to form an essentially banite/martensite phase alloy with dispersed austenite, $M_2C$ carbide strengthening where M is Cr, V and/or Mo, dispersed BCC copper for precipitation strengthening and nickel to promote austenite stability and transformation toughening.

The solidified melt is preferably subjected to a two stage tempering process with the first stage at a higher temperature in the range of 500° C. to 600° C. for less than one hour followed by a lower temperature stage for more that one hour of about 400° C. to 500° C.

BRIEF DESCRIPTION OF THE DRAWINGS

In this application reference is made to the drawing comprised of the following figures.

DESCRIPTION OF THE PREFERRED EMBODIMENTS

Figure 1:
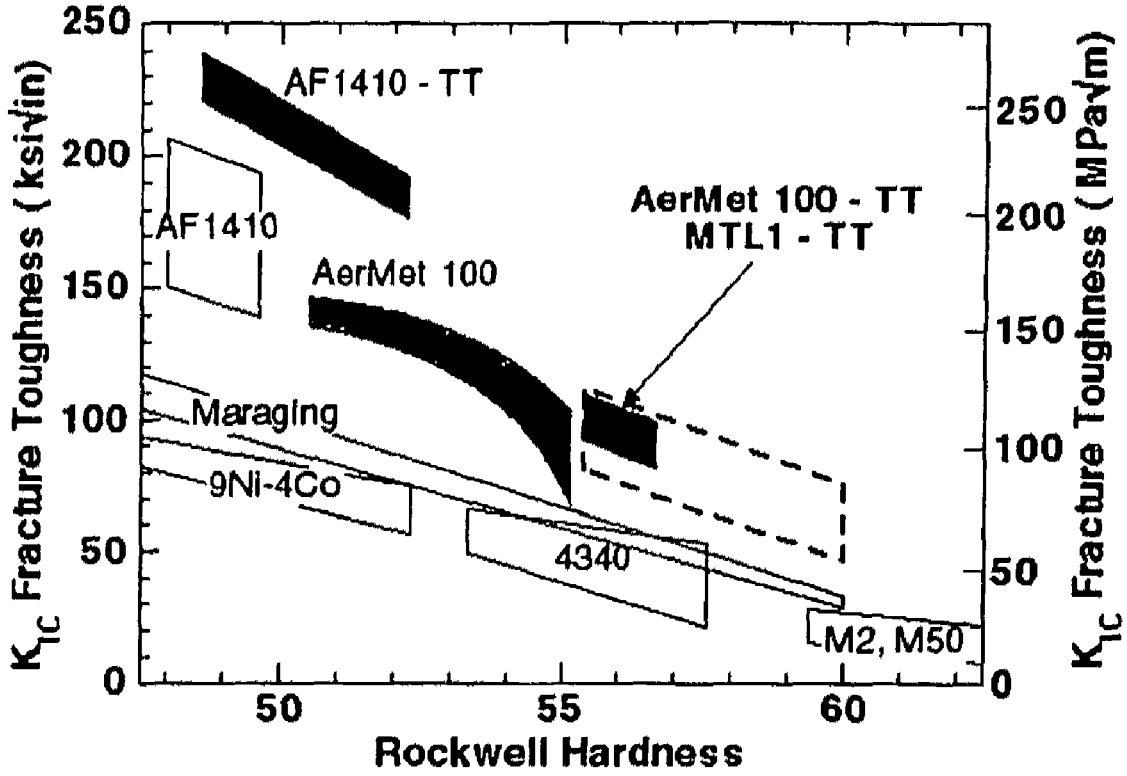
FIG. 1 is a graph of $K_{IC}$ toughness vs: $R_C$ hardness cross-plot for ultra-high strength martensitic steels.
Figure 2:
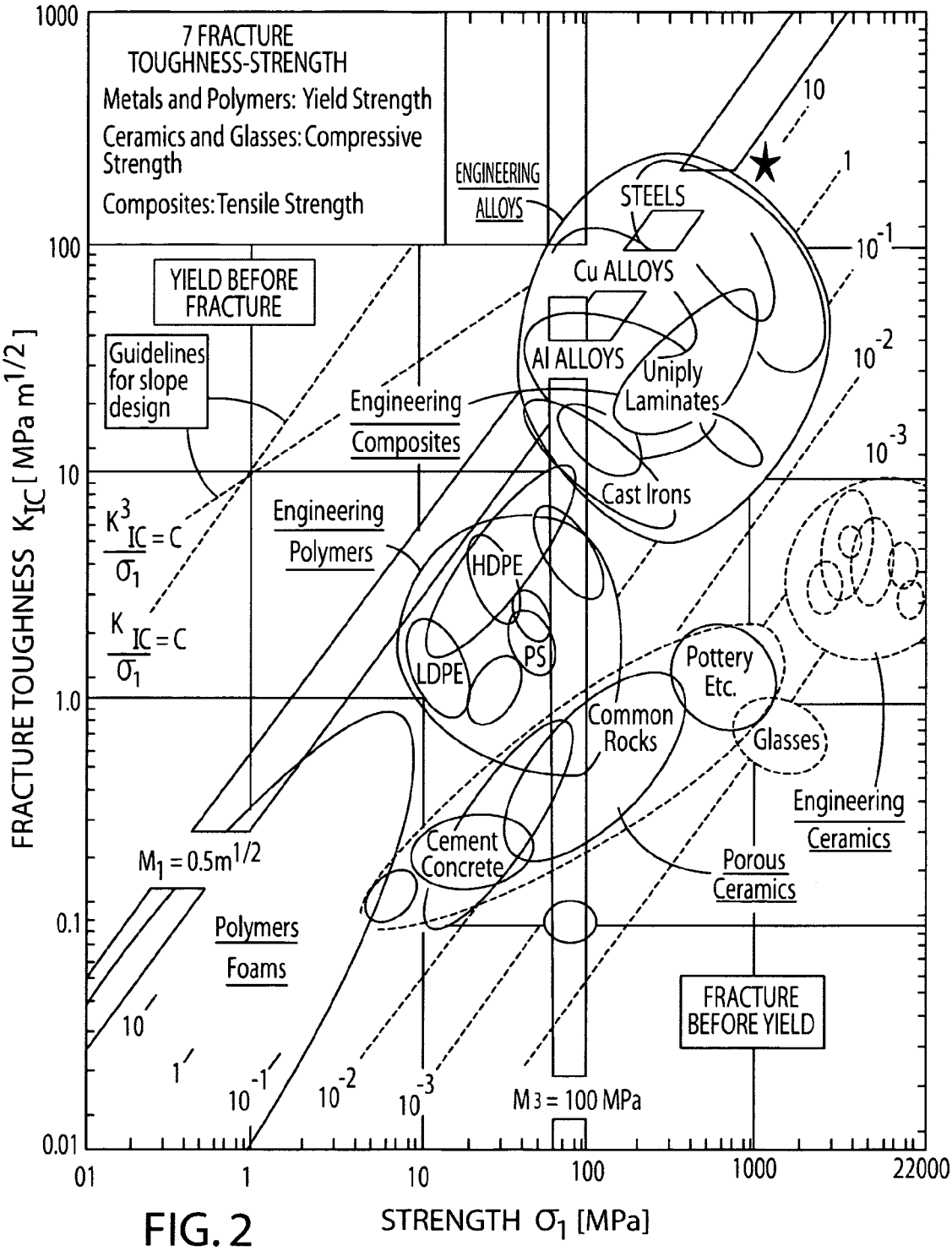
FIG. 2 is a graph of $K_{IC}$ toughness vs. σ yield strength cross-plot for different classes of materials.
Figure 3:
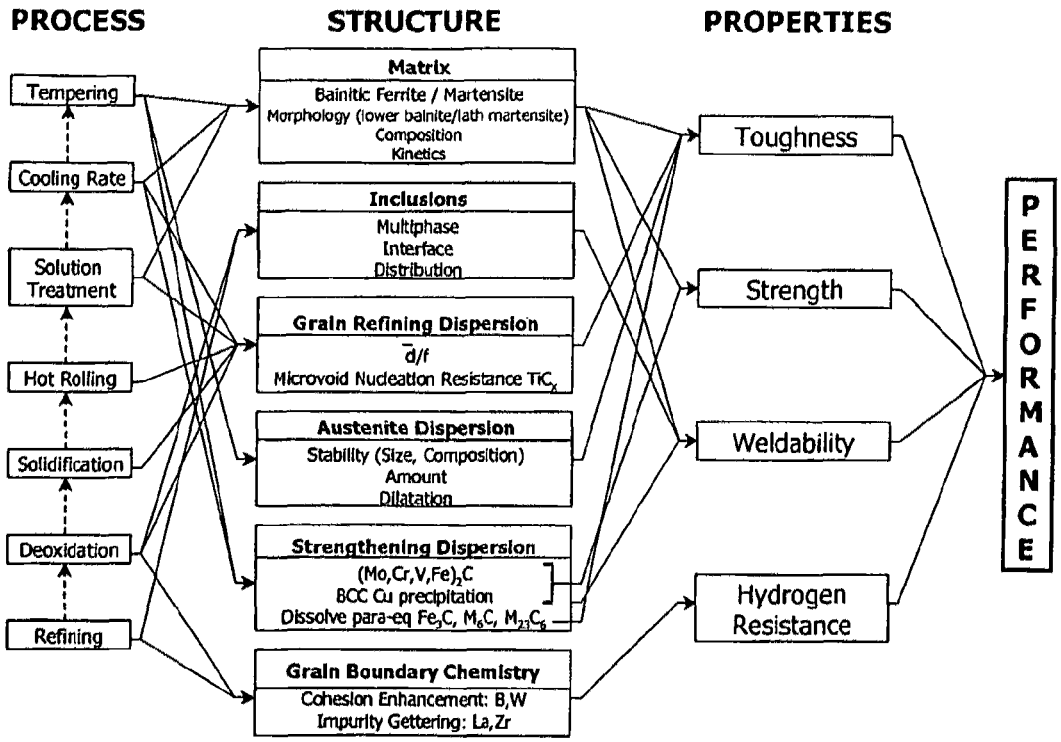
FIG. 3 is a systems design chart for blast resistant naval hull steels.
Figure 4:
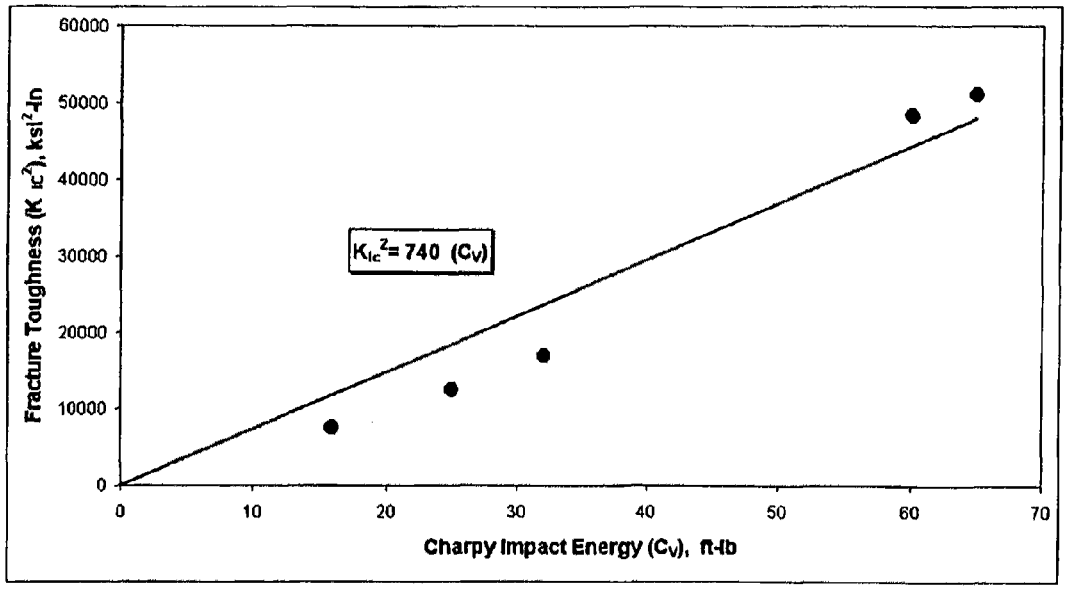
FIG. 4 is a graph correlation between $K_{Ic}$ and $C_V$ test results for high Ni steels.
Figure 5:
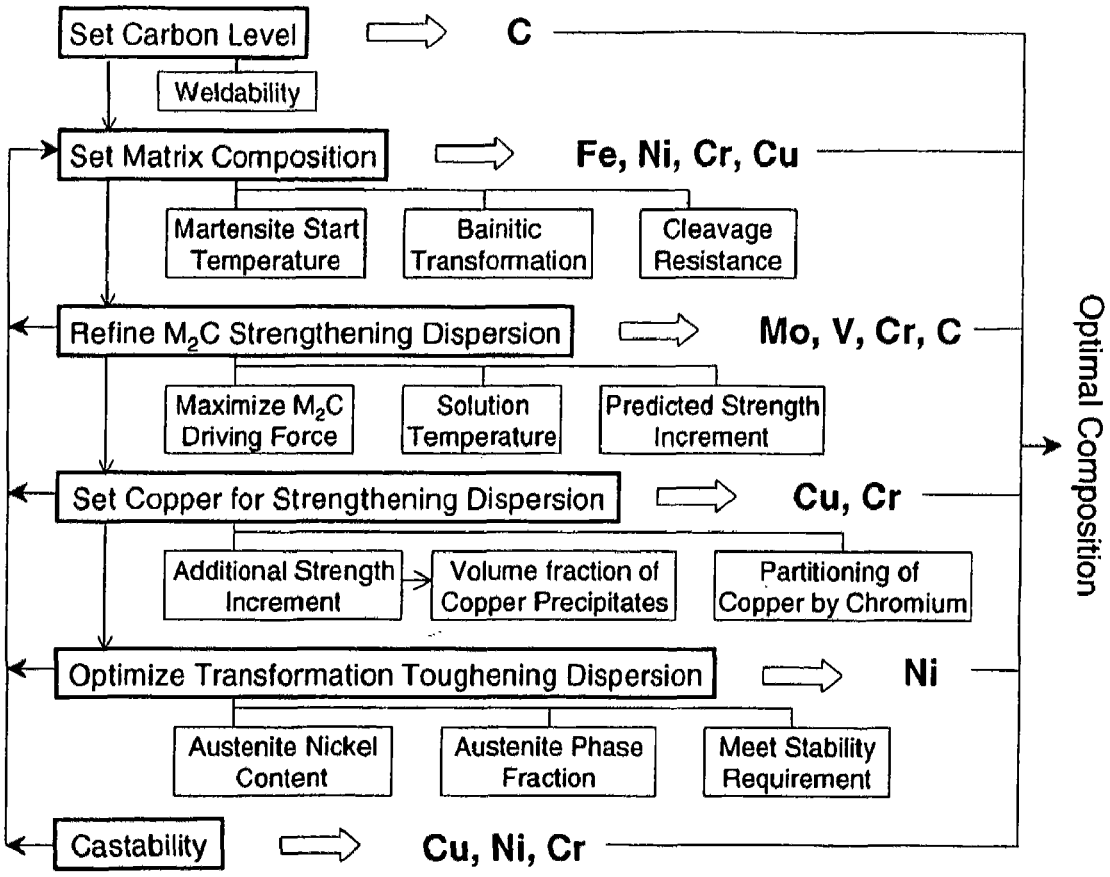
FIG. 5 is a schematic of the design optimization procedure.

FIG. 5 presents a schematic process flow of the design optimization procedure and considerations generally employed to determine an optimal composition and process for development of alloys of the invention. Following is discussion regarding these considerations among others.

Constituent Considerations

To strengthen the steel while limiting carbon content for weldability, co-precipitating $M_2C$ carbides and BCC copper have been employed. By optimizing the particle size and the phase fraction of the precipitates, the goal of high-strength is achieved.

Figure 6:
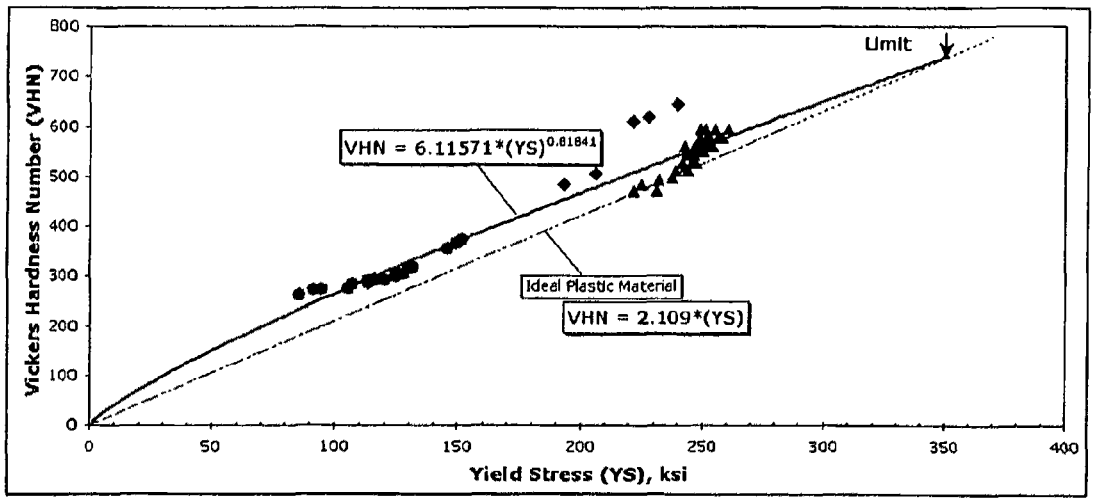
FIG. 6 is a graph of power-law relationship relating hardness of related steels to yield stress from experimental data from Foley (circles), Kuehmann (triangles) and Spaulding (diamonds) shown in comparison to straight-line relationship for ideal plastic material.

To achieve a goal of 160 ksi yield strength, quantitative models are employed to relate the contribution from dispersions of $M_2C$ carbide precipitates and BCC copper precipitates in secondary-hardened steels. The levels of $M_2C$ carbide formers and copper are optimized based on the strength contribution from each of these substructures. Assessment of the yield strength of the material has been made directly from the hardness data because of the ease and convenience in measurement of the latter. Hardness of a material is a direct manifestation of its resistance to plastic flow, monotonically relating to yield stress. An empirical relationship has been developed between hardness and yield stress. The best-fit curve in a log-log plot of hardness vs. yield stress has been used to determine the relationship based on strain hardening associated with the alloy. FIG. 6 presents the experimentally measured hardness—yield stress data superimposed with the best-fit power-law relationship and the theoretical straight-line relation describing the same for an ideal plastic material. The higher hardness of the empirical power-law relationship relative to the ideal-plastic case represents the effect of strain hardening, which is more pronounced at lower strength levels. The point at which the two curves meet represents the prediction limit of the relationship.

Thus, the hardness estimate for the target yield strength of 160 ksi from the power-law relationship is 389 VHN. The relation obtained is:

$$VHN=6.116YS^{0.8184} \quad (2)$$

where, VHN (Vickers Hardness Number) is in kg/mm$^2$ and YS (Yield Strength) is in ksi.

Figure 7:
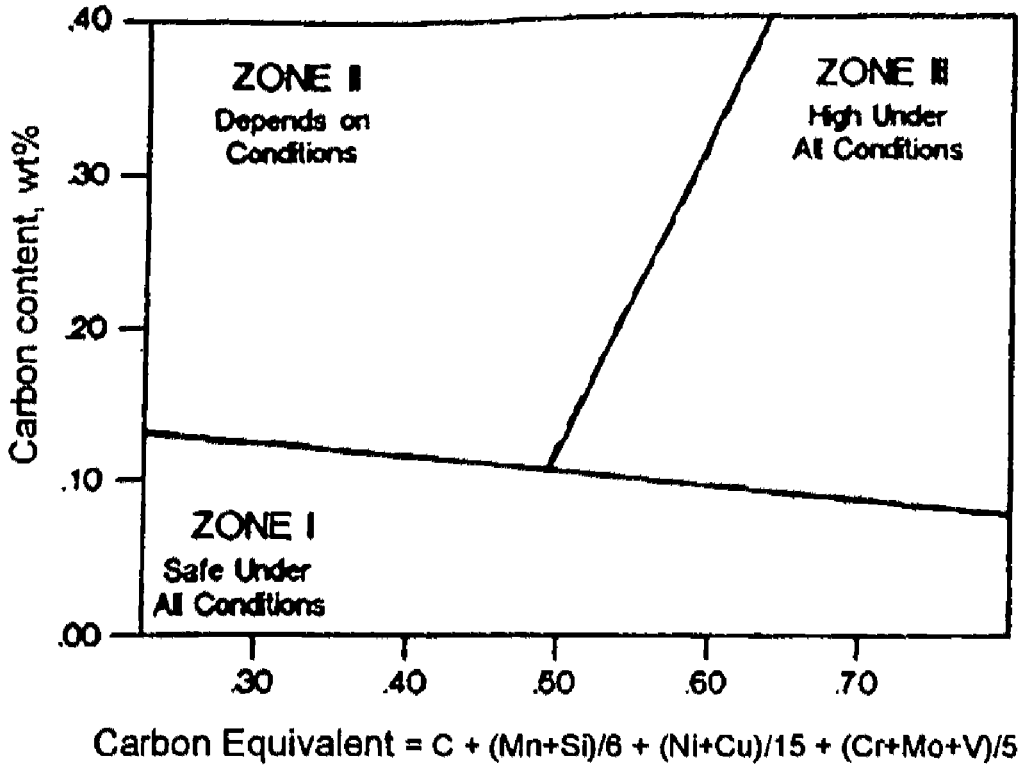
FIG. 7 is a design Graville diagram for determining susceptibility to HAZ cracking in plate steels.

Setting the carbon content of the alloy to ensure good weldability is appropriate initially prior to evaluation of hardness factors of the alloy. FIG. 7 presents the Graville diagram of overall carbon content in the alloy as a function of carbon equivalent. This shows that at 0.05°wt % C, the steel is not susceptible to hydrogen—induced cold cracking in the heat affected zone (HAZ) of weldments. An upper limit C content of about 0.05 wt % C is desired.

Figure 8:
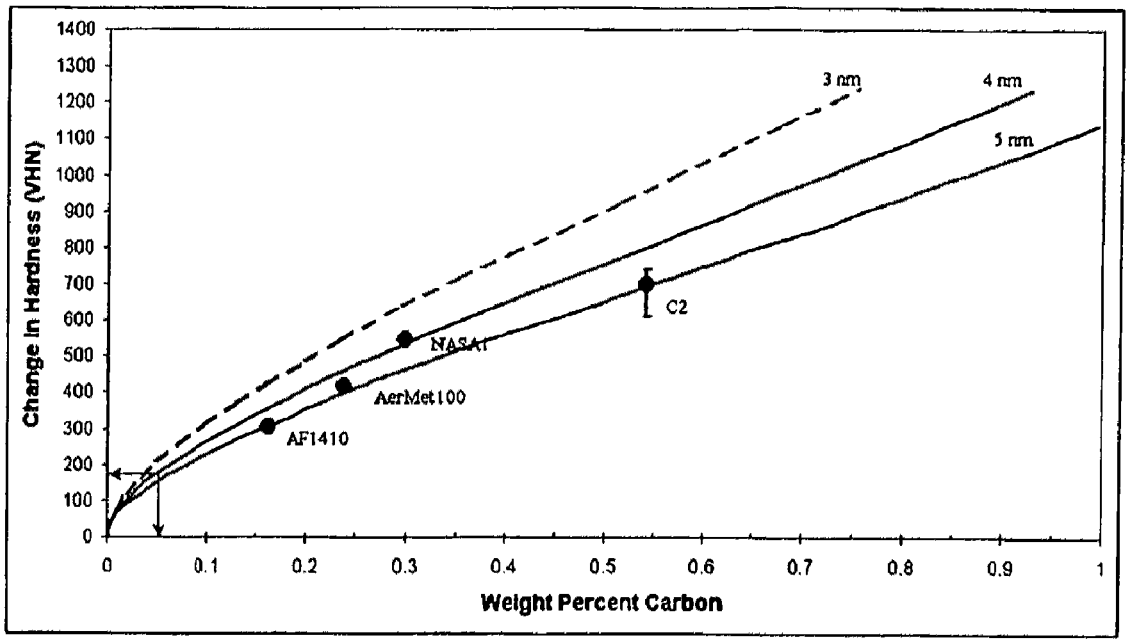
FIG. 8 is a graph change in hardness as a function of alloy carbon content for $M_2C$ carbide strengthening contribution. The arrows represent hardness increment of 175 VHN is achieved at C level of 0.05 wt % set for the alloy. Experimental results of other secondary hardening steels are shown.

Based on the predicted change in hardness-carbon content (wt %) plot shown in FIG. 8, at a C level of 0.05 wt % the hardness increment due to $M_2C$ carbide precipitation is estimated to be 175 VHN provided a sufficient driving force is maintained to achieve the particle size range of ~4-5 nm in FIG. 8. The base strength of a lath martensitic substructure is estimated as 63 VHN. The additional strength increment of 151 VHN to achieve the strength goal of 389 VHN is therefore to be attained through BCC copper precipitation strengthening. The effect of solid solution strengthening is assumed to be negligible for steels having low carbon and low hardenability. Thus, the total strength of the alloy is modeled by breaking it down into three contributions. The strength is described by the effects of $M_2C$ carbide precipitates, $\tau_{M2C}$; BCC copper precipitates, $\tau_{Cu}$ and matrix martensitic structure, $\tau_{\alpha''}$ $$\tau=\Delta\tau_{M2C}+\Delta\tau_{Cu}+\Delta\tau_{\alpha''}=389VHN \quad (3)$$

Figure 9:
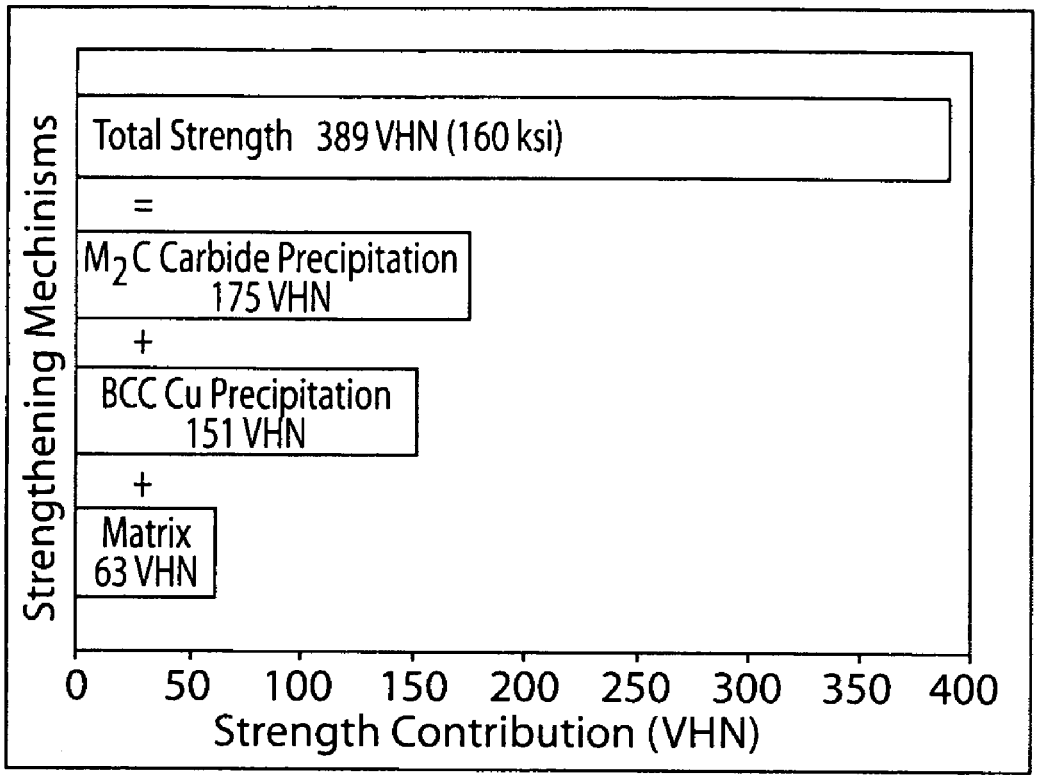
FIG. 9 is a graphical representation for contributions of the individual mechanisms to achieve the strength goal equivalent to 389 VHN.

The contributions of the individual mechanisms to achieve the strength goal equivalent to 389 VHN are graphically presented in FIG. 9.

$M_2C$ Carbide Strengthening

For the high-strength design, it is desired to ensure that substantially all of the carbon is taken up by the $M_2C$ carbide formers (Cr, Mo and V) in order to dissolve the cementite in the matrix since cementite negatively affects strength and toughness. Therefore, the sum of the atomic concentrations of Cr, Mo, and V is about double the concentration of C for the $M_2C$ stoichiometry.

Figure 10:
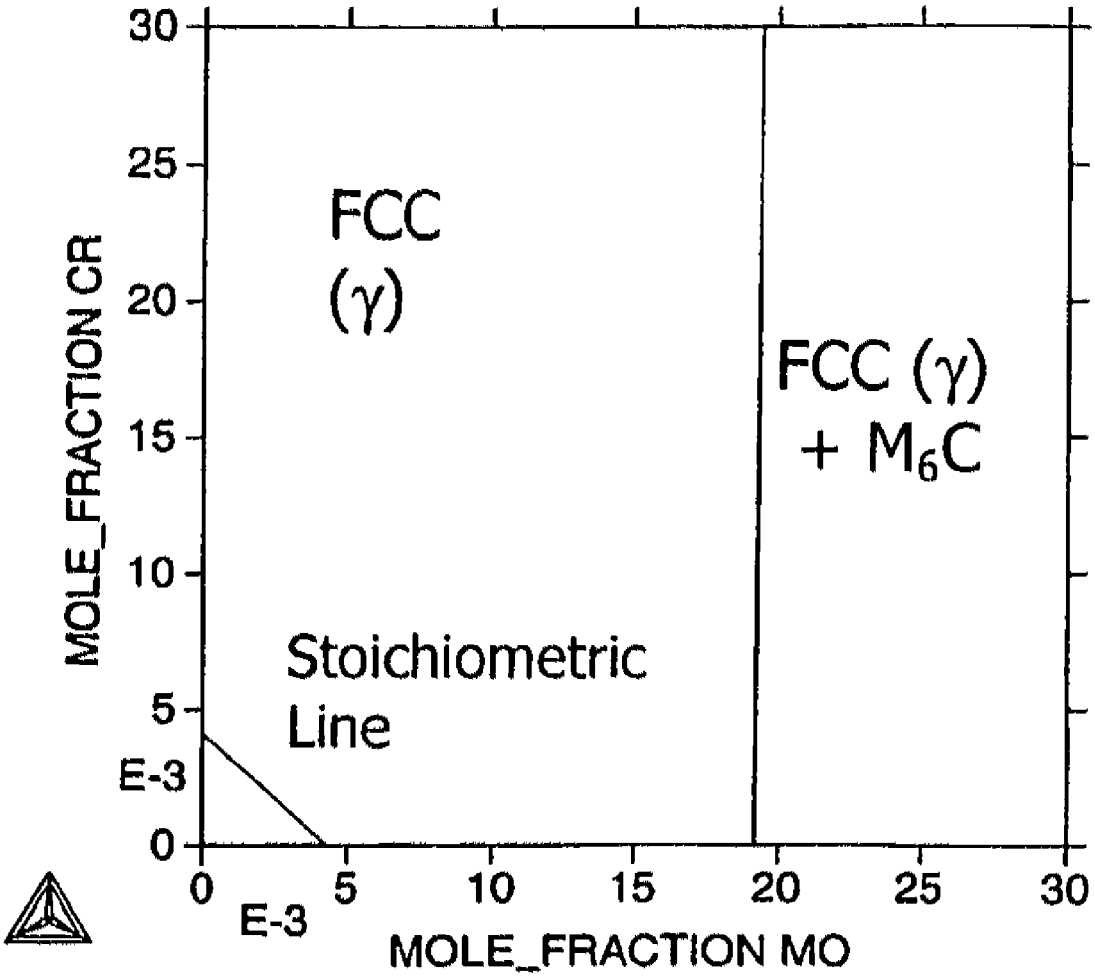
FIG. 10 is a Cr—Mo Phase Diagram Section at 900° C. with alloy composition in atomic %: Fe-0.234C-1.32Cu-6.21Ni-0.055V. This diagram shows the phase fields of the FCC austenite and FCC+$M_6C$ revealing that the $M_2C$ stoichiometric line is well within the solubility limit.

Compositions are set using the guideline for carbon content limited to about 0.05 weight % for weldability (FIG. 7); Cu should be at least 1.5 weight % for significant strengthening, minimum Ni content should be at least half that of Cu to avoid hot shortness, and the relative amounts of carbide formers Cr, Mo and V may be initially set equal in atomic percent. A BCC Cu-rich precipitate is necessary for Cu precipitation strengthening, an $M_2C$ carbide phase is necessary for carbide strengthening, and FCC austenite dispersion is critical for transformation toughening. Referring to FIG. 10, $M_2C$ solubility is not a limiting factor in the region of interest, due to the relatively limited C content.

Figure 11:
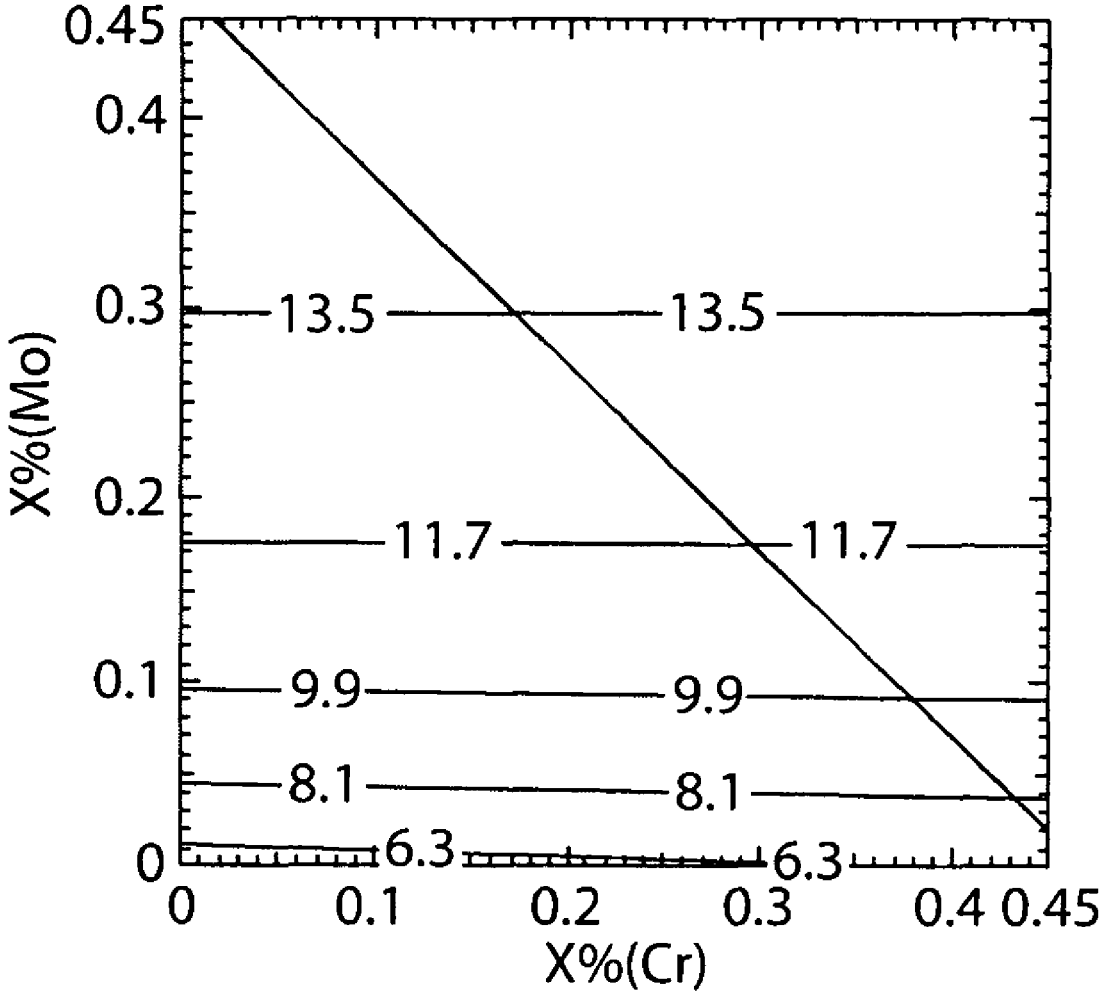
FIG. 11 is a graph depicting driving Forces (in kJ/mole) for $M_2C$ carbide nucleation contour plot varying at % (Mo) and at % (Cr) with superimposed $M_2C$ stoichiometric (heavy) line at 500° C. at alloy compositions at % Fe-0.234C-1.32Cu-6.21 Ni-0.055V.

The stoichiometric constraints of the $M_2C$ carbide dictate that the total amount of carbide formers (Cr, Mo, V) needed to balance the carbon content would be 0.468 at %. Using this constraint, initial plots were constructed of the driving force for $M_2C$ nucleation vs. at % (Mo) and at % (Cr), setting V at different levels. FIG. 11 is a representative plot of driving force contours with varying at % (Mo) and at % (Cr) at an alloy composition of 0.05 at % V and at 500° C. The stoichiometric constraint line has been drawn on the plot indicating the line of allowed compositions for $M_2C$. Cr has the least effect on driving force, especially at the higher contents of interest.

Figure 12:
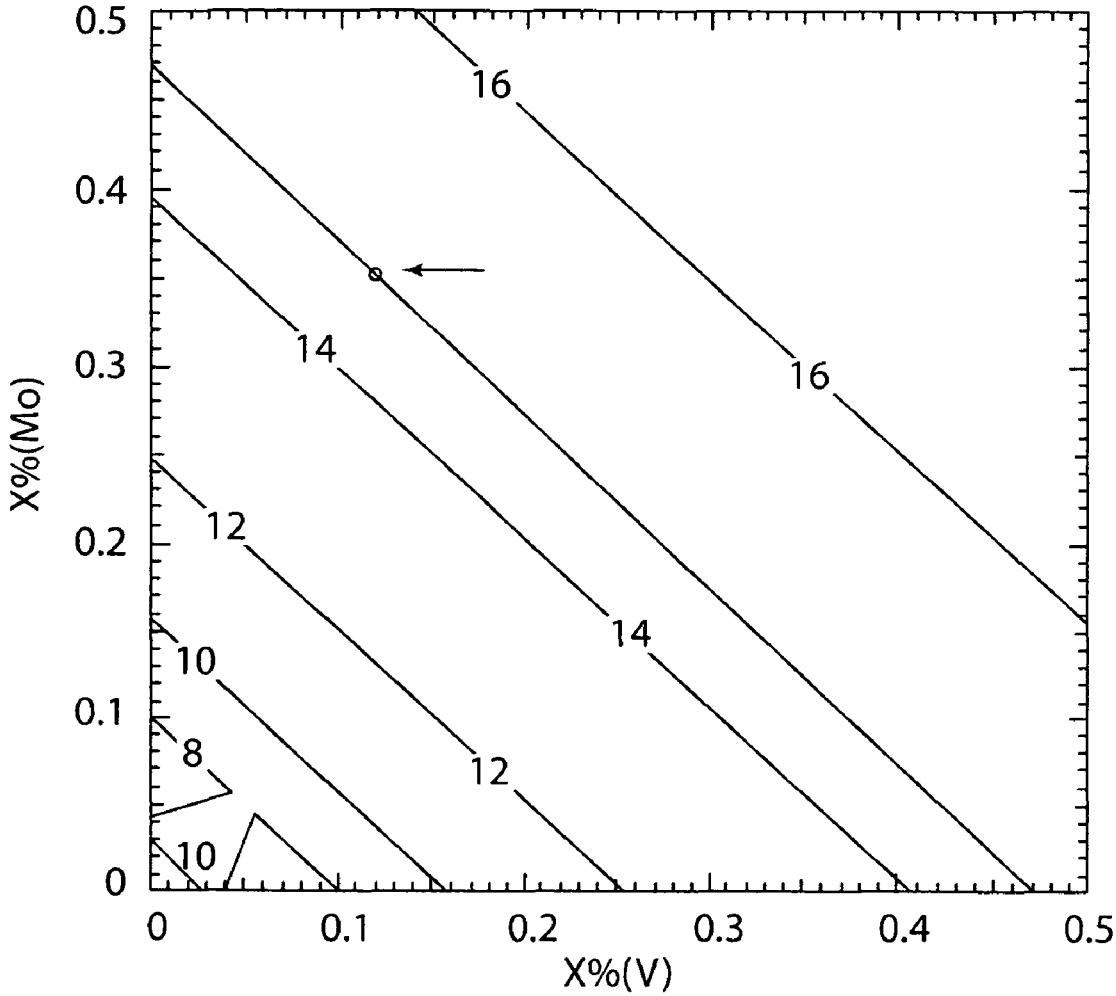
FIG. 12 is a graph depicting driving Force (in kJ/mole) for $M_2C$ carbide nucleation contour plot varying at % (Mo) and at % (V) with superimposed $M_2C$ stoichiometric line at 500° C. at alloy compositions at % Fe-0.234C-1.32Cu-6.2Ni.

Based on this finding, another set of driving force plots were created varying at % (Mo) and at % (V) while setting the Cr level at fixed values. Due to the very small Cr dependence, all the plots were very similar and so only a representative graph (FIG. 12) was included at 0 at % (Cr). A similar $M_2C$ stoichiometric line was drawn as before, constraining a maximum driving force at about 14.4 (U/mole). This plot revealed an almost equal effect on driving force for Mo and V, indicating that any allowed ratio of the two should give a maximum driving force value, so a series of calculations were done along the stoichiometric line (maximum driving force). A feasible alloy composition where all the desired phases as mentioned before co-exist, is indicated by the dot and arrow in FIG. 12. The alloy composition in wt % without any Cr is as follows: Fe-0.05C-1.5Cu-6.5Ni-0.6Mo-0.1V.

Figure 13:
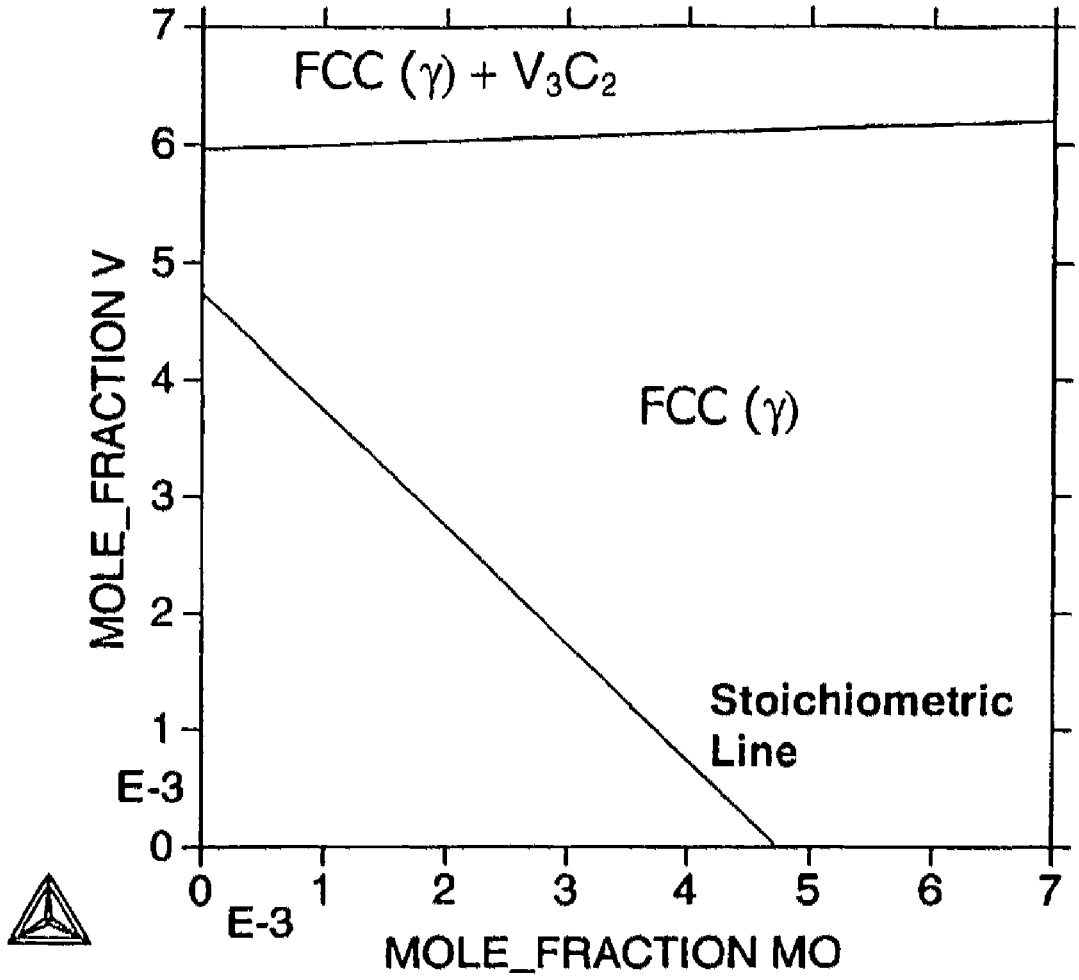
FIG. 13 is a Mo—V Phase Diagram Section at 900° C. with alloy composition in atomic %: Fe-0.234C-1.32Cu-6.2Ni. This diagram shows the phase fields of the FCC austenite and FCC+$V_3C_2$ revealing that the $M_2C$ stoichiometric line is well within the solubility limit.

The V—Mo phase diagram section at a solution temperature of 900° C. with the feasible alloy composition was also calculated. Again, the solubility of these carbide formers is not a limiting factor in the region of interest. This plot is shown in FIG. 13.

Copper Precipitation Strengthening

Figure 14:
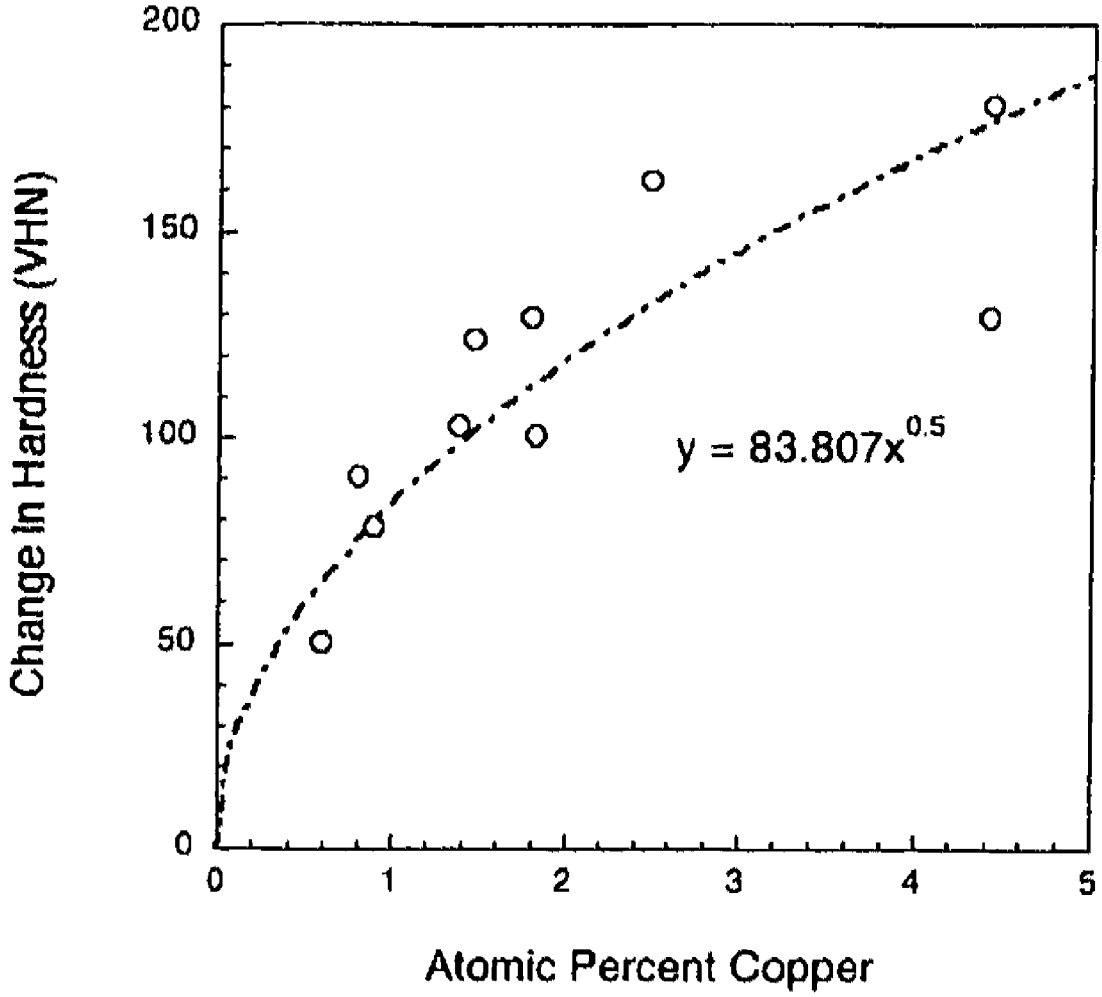
FIG. 14 is a graph depicting change in hardness as a function of alloy copper content for BCC copper strengthening contribution. Experimental results of other copper strengthened steels are shown. The dotted line represents the best-fit line for one-half power law given by equation (5).

In addition to $M_2C$ carbide strengthening, BCC copper precipitation strengthening controls the phase fraction of the precipitates through the alloy copper content and provides an additional increment of strength (≅151 VHN). The copper precipitates that contribute to strengthening in steels have a metastable BCC structure, which are fully coherent with the matrix having an average diameter of 1-5 nm: The strengthening mechanism is based on the interaction between the matrix slip dislocation and the second phase copper-rich particle of lower shear modulus than the matrix. The shear stress has a maximum value, $\tau_{max}$, given by Equation 3.3.

$$\tau_{max} = \frac{0.041 Gbf^{1/2}}{r_0} \tag{4}$$

where G is the matrix shear modulus, b is the burgers vector, f is the volume fraction of atoms and $r_0$ is the core radius of the dislocation. Thus the maximum strength that can be achieved is proportional to the square root of the volume fraction of the precipitate. Based on this volume fraction dependence of the precipitate on yield stress, the hardening increment from available data of copper precipitation strengthened steels was plotted as shown in FIG. 14. The best-fit line described by a one-half power law defined the hardening increment dependence on the alloy content (at %) of copper.

$$\Delta\tau(\text{VHN}) = 83.807 X_{Cu}^{1/2} \tag{5}$$

Based on this relationship, the hardness increment of 151 VHN is achieved by addition of about 3.25 at % Cu to the alloy composition.

Processing Considerations

Transformation Toughening

The toughness of the higher strength steel is improved by utilizing the beneficial properties of Ni-stabilized precipitated austenite. This form of austenite can precipitate during annealing or tempering at elevated temperatures above about 470° C. The fact that this dispersed austenite forms by precipitation is significant because it allows greater overall control of the amount and stability of the austenite. Further processing and treatments can be used in the form of multi-step tempering to first nucleate particles in a fine form at a higher tempering temperature and then complete Ni enrichment during completion of precipitation strengthening (cementite conversion to $M_2C$) at a lower final tempering temperature.

The austenite dispersion has stability and formation kinetics to ensure maximum toughening enhancement. Other factors controlling the stability of austenite are particle size and stress state sensitivity, the latter being related to the transformational volume change. Stability of an austenite precipitate is defined by chemical and mechanical driving force terms. At the $M_s^{\sigma}$ a temperature (where transformation occurs at yield stress) for the crack-tip stress state, the total driving force equals the critical driving force for martensite nucleation, as represented by Equation 6.

$$\Delta G^{ch} + \sigma_y \frac{d\Delta G^{\sigma}}{d\sigma}\bigg|_{cracktip} = -\left[\frac{2\gamma}{nd} + G_0 + W_f\right] \tag{6}$$

Rearranging the terms and substituting a dependence of defect potency on particle volume $V_p$, defines a convenient stability parameter:

$$\Delta G^{ch} + W_f + \frac{K}{\ln(V_p)} = -\left[\sigma_y \frac{d\Delta G^{\sigma}}{d\sigma}\bigg|_{cracktip} + G_0\right] \tag{7}$$

$\Delta G^{ch}$ is the transformation chemical free energy change and $W_f$ is the athermal frictional work term described in Section 2.4. $\Delta G^{ch}$ is temperature and composition dependent while $W_f$ is only composition dependent. $W_f$ will vary with tempering temperature due to the change in austenite composition. $\sigma_y$ is the yield stress of the material, $\Delta G^{ch}$ is set by the stress state and $G_0$ is a nucleus elastic strain energy term. K is a proportionality constant, γ is the nucleus specific interfacial energy and d is the crystal interplanar spacing.

The austenite stability for a given set of conditions or service temperature for a given dispersion can be assessed by the parameter given by the left-hand side of Equation 7. Austenite stability parameter becomes the sum of the chemical driving force for transformation of FCC austenite to BCC martensite at room temperature (300K) and the frictional work term for martensitic interfacial motion: $\Delta G^{ch}+W_f$. The model is represented in Equation 8.

$$W_f = \sqrt{\sum_i (K^i X_i^{1/2})} + \sqrt{\sum_j (K^j X_j^{1/2})} + \sqrt{\sum_k (K^k X_k^{1/2})} + K^{Co} X_{Co}^{1/2} \tag{8}$$

where the K's represent the coefficients used to fit the solid solution strengthening data and i=C, N; j=Cr, Mn, Mo, Nb, Si, Ti, V; and k=Al, Cu, Ni, W.

Equation 8 further indicates that the stability parameter is a linear function of the yield strength of the material.

Figure 15:
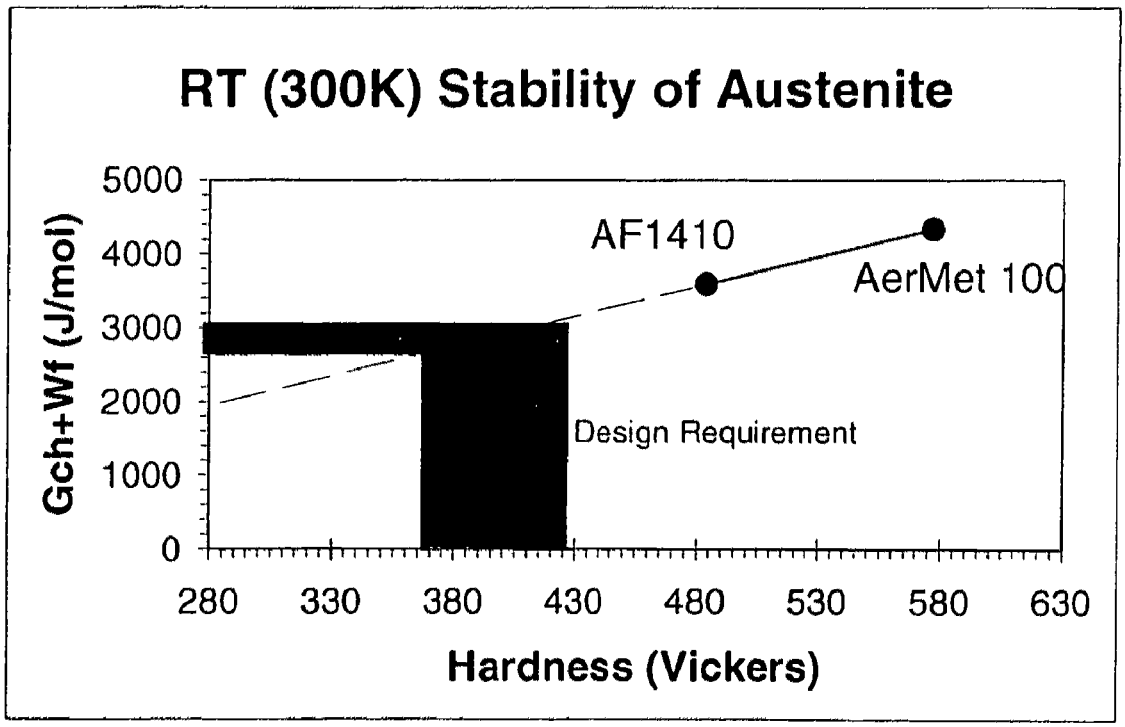
FIG. 15 is a plot depicting room temperature (300K) austenite stability plotted as a function of Vickers Hardness Number (VHN). The shaded region shows our range of interest for austenite stability corresponding to a yield strength requirement of 150-180 ksi after extrapolation of data from previous alloys, AF1410 and AerMet100.

FIG. 15 gives the plot of the austenite stability parameter, $\Delta G^{ch}+W_f$, at room temperature against Vickers hardness of the alloy. The room temperature stability of the austenite dispersion projected from the hardness (or strength) requirement of the design is marked by the shaded region in the figure and quantitatively expressed in Table 1. To achieve a goal of 160 ksi yield strength equivalent to Vickers hardness of 389 (Rc40 equivalent), the estimated optimum $\Delta G^{ch}+W_f$ value of 2837 J/mole is found for the required stability.

TABLE 1

| Target Chemical Driving Force ($\Delta G^{ch}$) + Frictional Work ($W_f$) Value | | | |
|---|---|---|---|
| Alloy | Rockwell C Hardness $R_c$ | Vickers Hardness VHN (kg/mm$^2$) | $\Delta G_{ch} + W_f$ J/mol |
| AerMet 100 | 54 | 577 | 4350 |
| AF1410 | 48 | 484 | 3600 |
| Design | 40 | 389 | 2837 |

Figure 16:
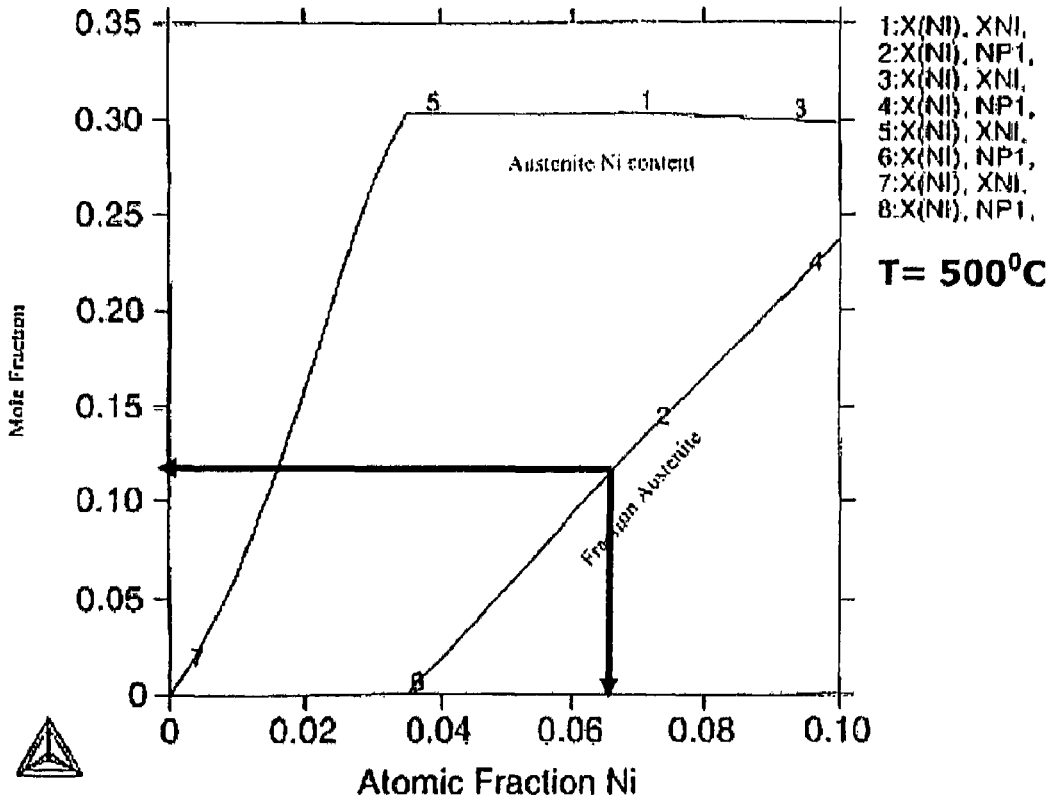
FIG. 16 is a plot of the fraction of Ni in austenite and phase fraction of austenite in alloy vs. mole fraction of Ni at 500° C. with alloy composition in weight %: Fe-0.05C-3.65Cu-1.85Cr-0.6Mo-0.1V.

Plots of both the phase fraction of austenite and nickel content in the austenite phase vs. alloy atomic fraction Ni were computed. FIG. 16 was calculated at an estimated final tempering temperature of 500° C. for substitutional diffusion and revealed that a minimum of 3.5 at % Ni is required to get austenite and a maximum fraction of nickel in the austenite of about 0.30 could be obtained. It also showed that at the 6.25 at % Ni composition, about a 0.10 phase fraction of austenite would be formed as shown by the arrows. Thus, the alloy Ni level is set to about 6.25 at %, which also saturates the austenite Ni content to 30 at %.

Alloy Composition and Processing Integrated

Figure 17:
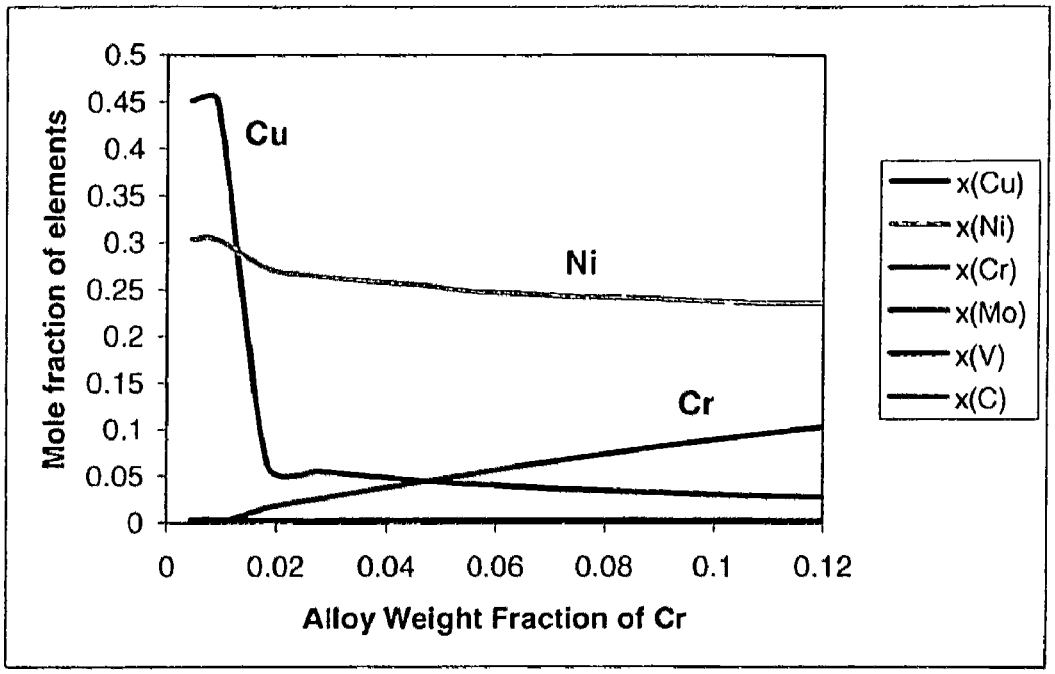
FIG. 17 is a plot of the equilibrium composition of austenite as a function of alloy Cr content (wt. fraction) at 510° C.

The overall composition was optimized so that all of the phases necessary for strengthening and toughening are simultaneously present. The maximum $M_2C$ driving force is obtained with no chromium. The copper added for precipitation strengthening went instead into the austenite phase. A study of the equilibrium austenite composition with varying alloy Cr content was then undertaken as given in FIG. 17. It was found that Cr partitions Cu out of austenite and into the BCC precipitate phase effectively at 2 wt % and above.

Figure 18:
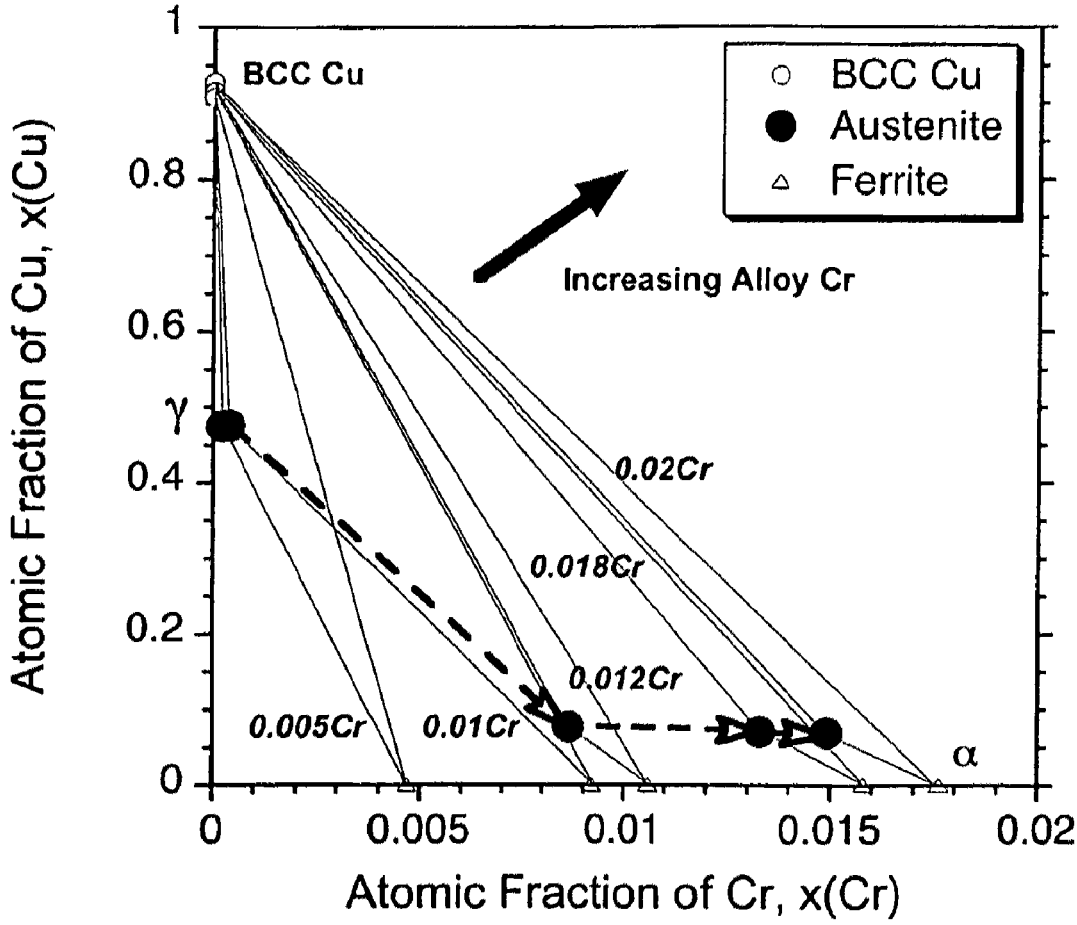
FIG. 18 is a quasi-ternary section of the designed multi-component alloy system at 510° C. Other alloying elements are fixed at Fe-0.24C-3.25Cu-6.26Ni-0.35Mo-0.11V (at %). The tie-triangles shown by thin solid lines indicate three-phase equilibrium between BCC Cu, austenite and ferrite. The dashed arrow traces out the trajectory of the austenite phase composition (solid dots) as a function of increasing alloy Cr content.

To understand the effect of Cr on partitioning of Cu out of the austenite phase, a detailed investigation was done based on a quasi-ternary section of the multicomponent system at 510° C. as presented in FIG. 18. The equilibrium Cr and Cu phase compositions of BCC Cu, austenite and the ferrite phases connected with tie-triangles are presented for different Cr contents of the alloy. The austenite equilibrium point abruptly shifts to a much lower Cu level with an increase of alloy Cr level from 1 at % to 1.2 at %. This confirms that Cu partitions to the BCC precipitate phase above 1.2 at % Cr. Thus, 2 at % Cr (equivalent to 1.84 wt % Cr) was set for the alloy to make the copper in the alloy available for precipitation strengthening.

Figure 19:
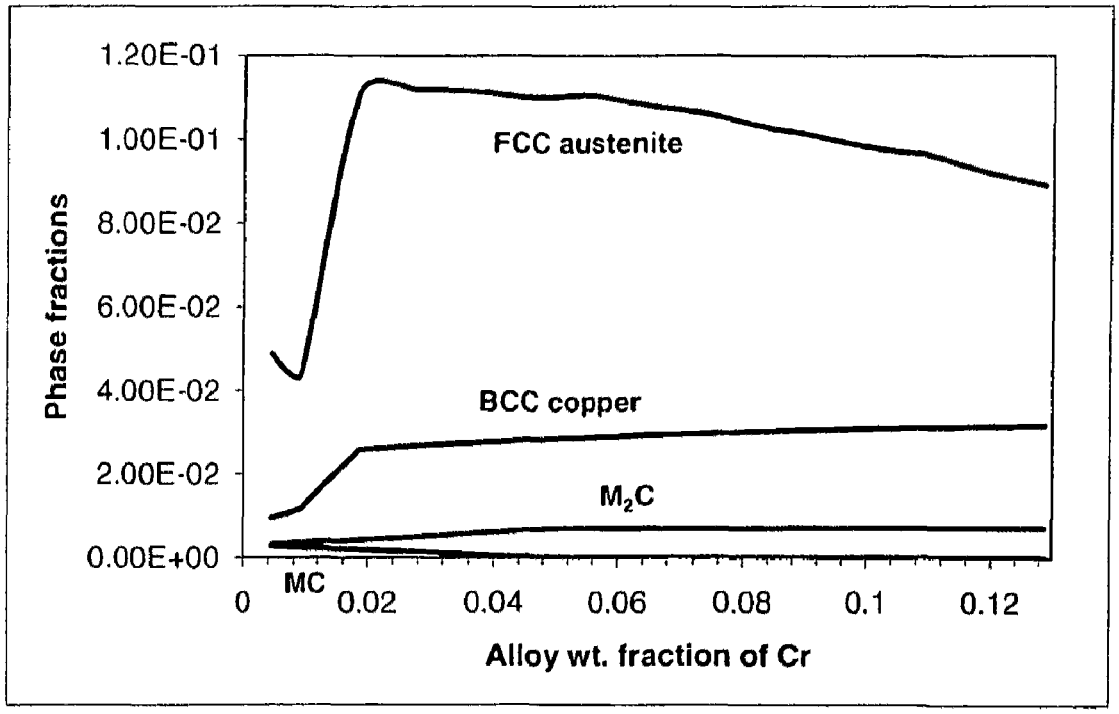
FIG. 19 is an equilibrium phase fractions at 510° C. as a function of alloy Cr content (wt fraction).

The relative fractions of the different phases in the microstructure were then calculated as a function of the alloy Cr content to confirm the effect of chromium as shown in FIG. 19. This confirms that at 2 wt % Cr, there is sufficient precipitation of austenite (>0.1 mole fraction) for transformation toughening and bcc Cu (~0.03 mole fraction) for strengthening.

Processing Factors

Solution Treatment Temperature and Allotropic Transformations

Figure 20:
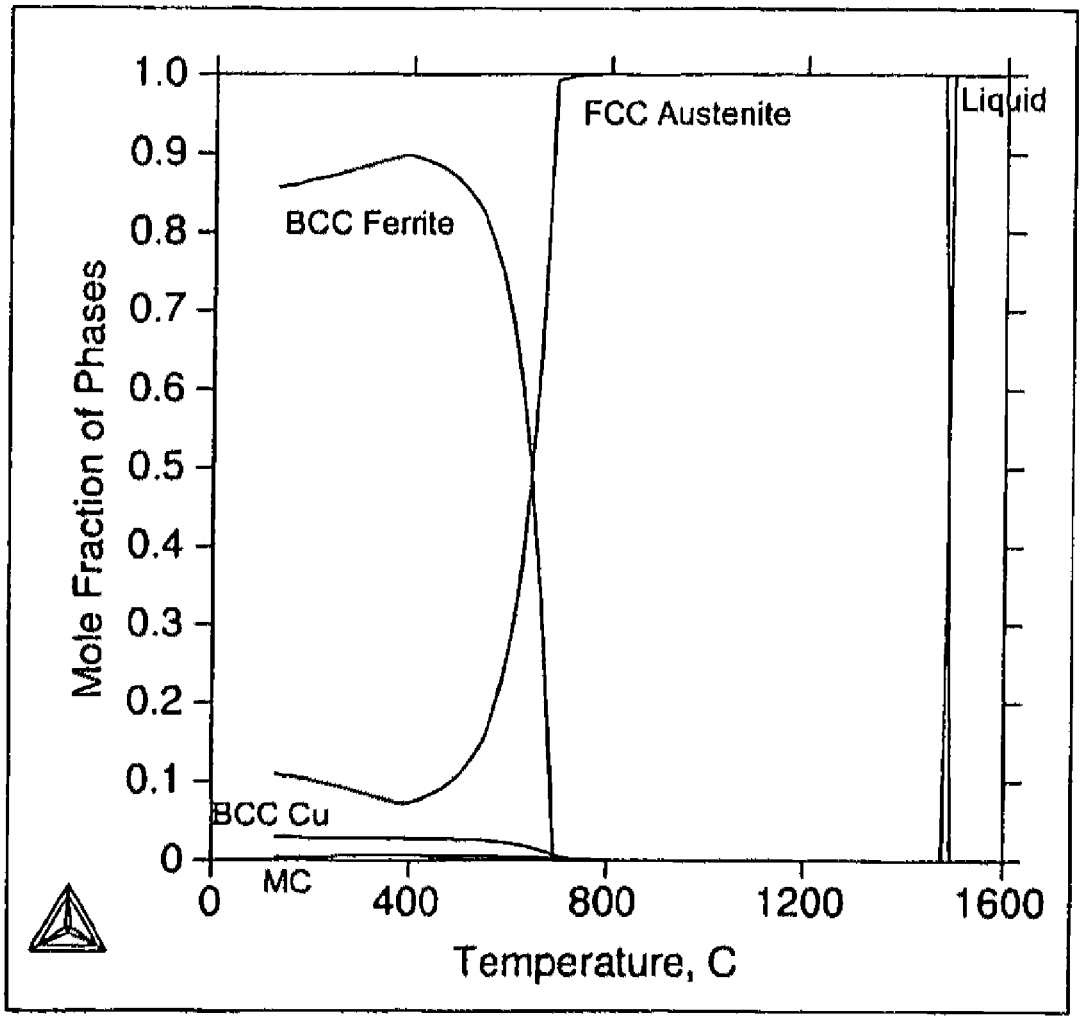
FIG. 20 is a plot showing the variation of equilibrium mole fraction of different phases in the alloy as a function of temperature, showing that the alloy is solution treatable at 900° C.

A solution treatment temperature of 900° C. was chosen. With the increased levels of Cu and Cr it was confirmed that the alloy was solution treatable at 900° C. as shown by the phase fraction plot in FIG. 20.

For this alloy composition, the martensite and bainite kinetic models predict an $M_S$ temperature of 298° C. and a bainite start (Bs) temperature of 336° C. These are deemed sufficiently high to ensure formation of bainite/martensite mixtures with air-cooling.

Microsegregation Behavior

Solidification of alloys generally occurs with segregation, which can have a strong effect on the alloy's final properties.

Figure 21:
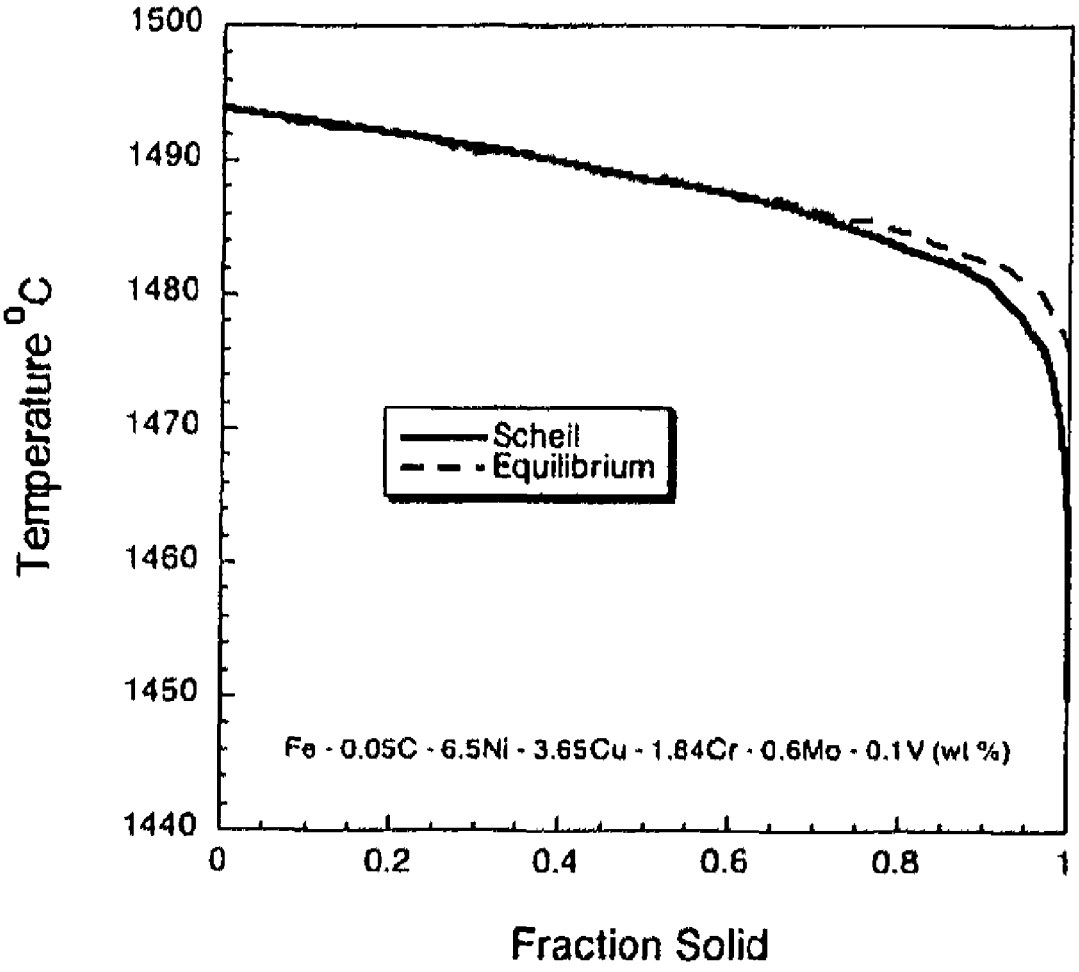
FIG. 21 is a plot of a Scheil simulation for evolution of the fraction solid with cooling for designed alloy Fe-0.05C-6.5Ni-3.65Cu-1.84Cr-0.6Mo-0.1V (wt %) in comparison with equilibrium solidification.
Figure 22:
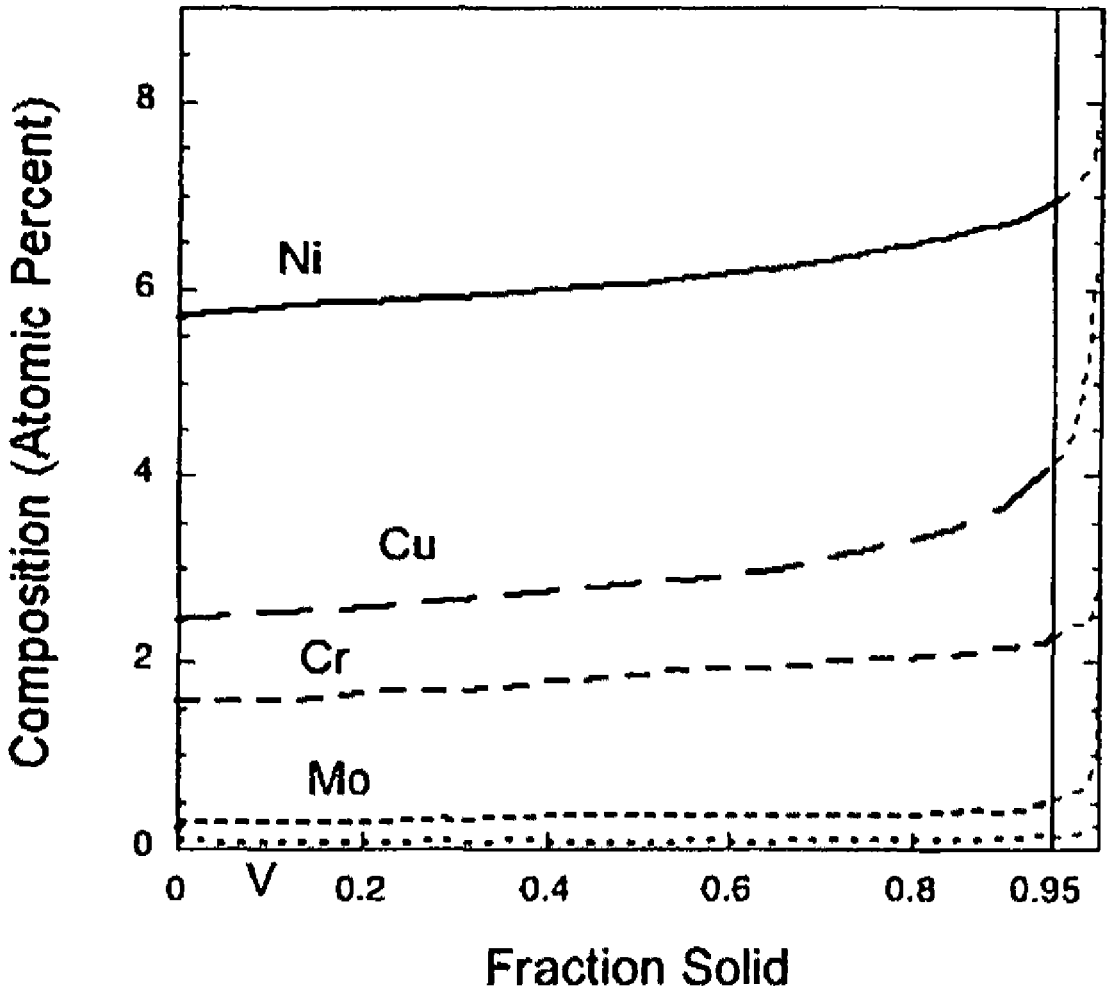
FIG. 22 is a plot of a Scheil simulation for composition profile of each alloying element after solidification for designed alloy Fe-0.05C-6.5Ni-3.65Cu-1.84Cr-0.6Mo-0.1V (wt %). Solid fraction corresponds to position relative to dendrite arm center.

FIG. 21 presents the solidification simulation result as temperature vs. fraction solid using a non-equilibrium Scheil simulation and compares it with the full equilibrium case. FIG. 22 presents the composition profiles calculated by a Scheil simulation showing the degree of microsegregation in the solid after solidification. Here, the fraction of solid is equivalent to a position relative to a dendrite arm center. The results presented in Table 2 predict that Mo has the greatest potential for segregation. However, since the level of Mo in the alloy is low, no serious microsegregation problems are encountered.

TABLE 2

| Amplitude of microsegregation with respect to each alloying element predicted by Scheil simulation at 95% solidification | | | | | |
|---|---|---|---|---|---|
| Alloying Elements | Ni | Cu | Cr | Mo | V |
| Nominal Alloy Composition —$C_{alloy}$ (at %) | 6.38 | 3.31 | 2.04 | 0.36 | 0.11 |
| Microsegregation Amplitude $C_{0.95}$-$C_0$ (at %) | 1.29 | 1.67 | 0.72 | 0.34 | 0.05 |

Tempering Temperature

Figure 23:
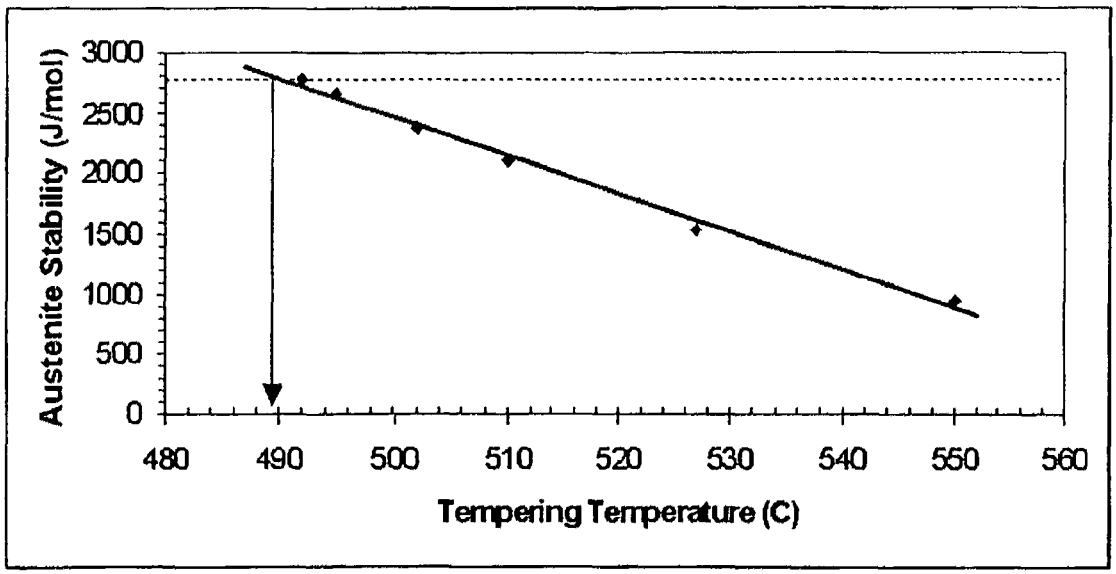
FIG. 23 is a plot of room temperature (300K) stability of austenite as a function of tempering temperature. The required stability is predicted for 490° C.

The austenite stability for this transformation toughened alloy is dependent on the optimal tempering temperature condition. With the alloy composition fixed, the austenite stability is calculated as a function of tempering temperature as shown in FIG. 23. It illustrates that the $G_{ch}$+Wr value of 2836 J/mole desired for this alloy is achieved for a tempering temperature of 490° C., very close to the originally assumed temperature of 500° C.

A composition is thus in a preferred embodiment for the ultratough, high strength weldable plate steel (in wt %) to be tempered at 490° C. of about:

Fe–0.05C–3.65Cu–6.5Ni–1.84Cr–0.6Mo-0.1V.

The composition should be solution treatable at 900° C., with predicted $M_S$ and $B_S$ transformation temperatures of 298° C. and 336° C. respectively. Initial tempering at a slightly elevated temperature will help nucleate the austenite before tempering at 490° C. to enrich the Ni content to the designed level.

Experimental Results and Examples

Material

Special Metals Corporation in New Hartford, N.Y. produced the alloy in a 34-pound heat by Vacuum Induction Melting (VIM) from 100% virgin raw materials and cast into 9.5"×8"×1.75" (24.1 cm×20.3 cm×4.5 cm) slab ingots as a simulation of a continuous casting process. The as-cast ingot was subsequently homogenized at 2200° F. (1204° C.) for 8 hours and then hot rolled to 0.45" (1.1 cm) thickness followed by air-cooling to room temperature by Huntington Alloys in Huntington, West Va. The final dimension of the plate measured roughly 33"×10"×0.45" (83.8 cm×25.4 cm×1.1 cm). The hot-rolled plate was annealed at 900° F. (482° C.) for 10 hours to improve machinability of the material. The designed and the actual compositions (in wt %) of the alloy is given in Table 3. The impurity level in the alloy was measured as 0.002 wt % S, 13 ppm O and 2 ppm N.

TABLE 3

| Designed and Measured Composition (in wt. %) of alloy | | | | | | | |
|---|---|---|---|---|---|---|---|
| Alloy | Fe | C | Cu | Ni | Cr | Mo | V |
| Design | Bal. | 0.05 ± 0.01 | 3.65 ± 0.05 | 6.5 ± 0.2 | 1.84 ± 0.05 | 0.6 ± 0.05 | 0.1 ± 0.01 |
| Measured | Bal. | 0.040 | 3.64 | 6.61 | 1.78 | 0.58 | 0.11 |

Experimental Procedures

Heat Treating

All samples were solution treated at 900° C. for 1 hour and quenched in water followed by a liquid nitrogen cool for 30 minutes prior to every tempering treatment to ensure a fully martensitic starting microstructure and eliminate any retained austenite. Solution treatments were done in an argon atmosphere to prevent oxidation of samples. To ensure rapid heating of the entire sample, the short-time nucleation stage heat treatments were conducted using a molten salt bath followed by water-quenching to room temperature. The salt used for the molten bath was Thermo-Quench Salt (300-1100° F.) produced by Heat Bath Corporation. The residue layer from the salt pot treatment was ground off before the second step aging treatment. The standard aging treatments for longer times (1-10 hours) were performed in a box furnace under vacuum (to prevent oxidation and decarburization) and then air-cooled to room temperature. Vacuum was achieved by encapsulating the samples in 0.75" diameter pyrex tubes connected to a vacuum system. The pyrex tubes were evacuated by a mechanical roughing pump followed by a diffusion pump. During evacuation, the tubes were backfilled with argon three times before reaching a final vacuum of <5 mtorr. Each tube was then sealed with an oxygen/propane torch.

Metallographic Sample Preparation

All samples were ground and polished directly to 1 μm finish using a Buehler Ecomet-4 variable speed automatic grinder/polisher. The samples prepared for measuring hardness were mounted in room temperature curing acrylic, while those prepared for microsegregation studies were hot mounted with conductive phenolic resin using a Stuers Labo-Press-I after nickel-plating for edge retention of the oxide layer during grinding and polishing. Microsegregation samples were etched by submersion in a 2% nital (2% nitric acid in ethanol) solution for 10-30 seconds to reveal the compositional banding close to the metal-oxide interface associated with scale formation during hot working. Following etching, the samples were viewed with an optical microscope to study the banded structure in the as-cast material.

Dilatometry

Dilatometry is used to study phase transformations by recording length changes versus temperature. For these studies a computer controlled MMC Quenching Dilatometer was used. Specimens were prepared by EDM (Electro-Discharge Machining) wire cutting into cylindrical rods 10 mm long and 3 mm in diameter. The samples are heated by an induction furnace and cooled by jets of helium gas. They are mounted between two low expansion quartz platens, which are lightly spring-loaded and are connected to an LVDT transducer that records the length. The temperature is monitored by a Pt—Pt 10% Rh thermocouple spot welded directly to the sample surface. The sample stage is enclosed in a vacuum chamber connected to a turbo-mechanical pump and mechanical backing pump capable of achieving a vacuum of $10^{-4}$ torr.

Dilatometry was used for determining the martensite start temperature ($M_S$) and for evaluating the bainite transformation kinetics. For estimating the experimental $M_S$ temperature, samples were heated at a rate of 2-3° C./sec to 1050° C., held for 5 minutes for homogenization and then rapidly quenched (>100° C./sec) to room temperature. The $M_S$ temperature was determined as the transition at which the sample started expanding on cooling. For studying the bainite kinetics, samples were held isothermally for 2 hours at bainite transformation temperatures between 360-420° C. after quenching (Cooling rate from 800° C. to 500° C., $T_{8/5}$=50° C./sec) from the austenizing temperature. The length change at the isothermal hold temperature is a measure of the amount of bainitic transformation. All samples were austenized at 1050° C. for 5 minutes and then rapidly quenched prior to the actual runs of martensite and bainite transformation in order to ensure uniform starting microstructure.

Microhardness Testing

Vickers hardness was measured for every aging condition as a measure of strength. The relationship between hardness and yield strength helped to assess the mechanical properties directly from the hardness data. Hardness measurements of materials in this study were performed using the Buehler Micromet II Micro Hardness Tester based on the method prescribed in ASTM standard E384. A diamond Vickers pyramidal indenter with face angles of 136° is used to make the indentations. After applying a load of 200 g for 5 seconds, the diagonals of the indent were measured at 400× magnification to obtain the Vickers Hardness (VHN) according to Equation 9.

$$VHN = \frac{1.854P}{d^2} \tag{9}$$

where P is the load in kg. and d is the average length of the diagonal in millimeters of the indent. Prior to testing, all the heat-treated samples were mounted in acrylic mold and polished to 1 μm. The samples were at least 8 mm thick and ground to reveal opposite surfaces to avoid any errors due to anvil effects. At least ten hardness measurements were recorded uniformly across the cross-section for every sample tested and the average was documented as the hardness value.

Impact Toughness Testing

Figure 24:
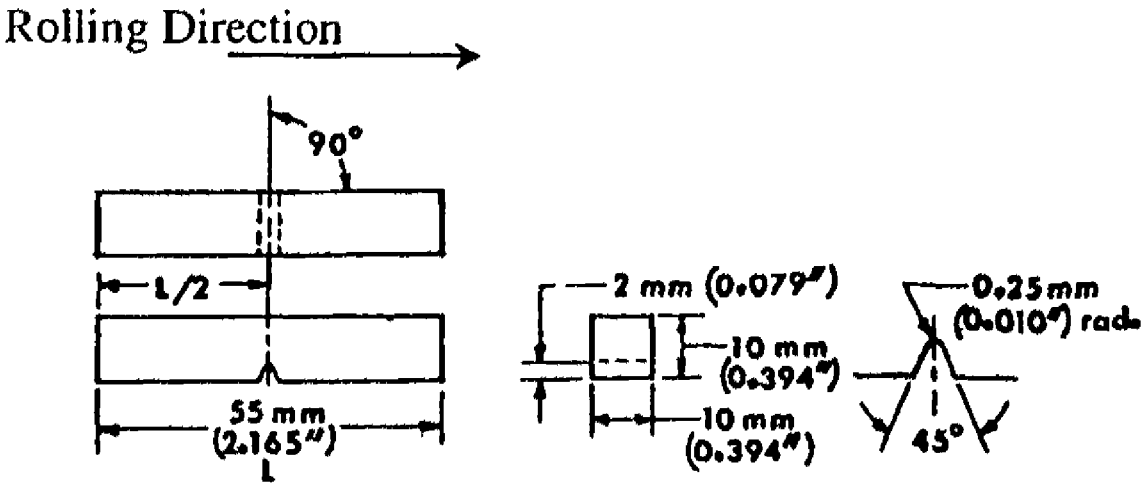
FIG. 24 is a diagram of the Charpy V-notch impact specimen dimensions (Standard ASTM E23) with longitudinal axis corresponding to the L-T orientation.

The impact toughness properties for the different heat treatment conditions of the alloy were measured using a Tinius Olsen 260 ft-lb (352J) impact-testing machine. Prior to testing, the samples were machined according to the ASTM standard Charpy V-notch dimensions (1996 ASTM E23) 10 mm×10 mm×55 mm (0.39"×0.39"×2.17") with a 45° notch of depth 2 mm and root radius of 0.25 mm placed at the center of the long side. The longitudinal axis of the specimen corresponded to the L-T orientation. A schematic view of the sample geometry is given in FIG. 24. The impact fracture energy was measured directly on analog scale and the given impact energy data was mostly based on a two-sample average. Most impact properties were evaluated at room temperature. For the low temperature impact fracture properties, the aged samples were held for 20 minutes at the test temperature in an Instron low temperature furnace connected to a liquid nitrogen supply. Within 5 seconds of removal from the furnace, the samples were placed inside the machine and struck with the 100-lbf hammer.

Tensile Testing

Figure 25:
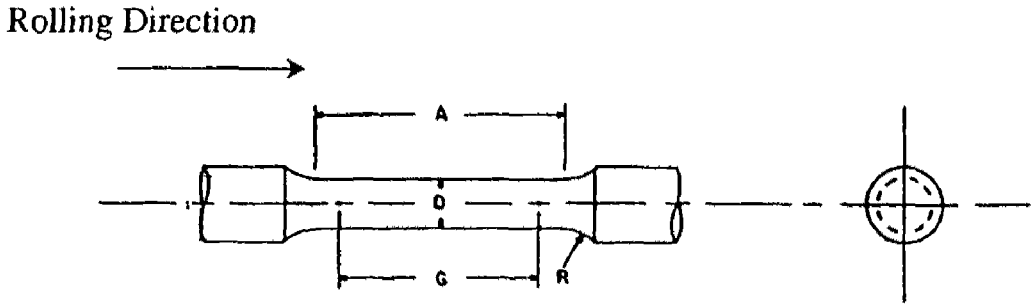
FIG. 25 is a diagram of the tensile test specimen dimensions (Standard ASTM E23).

Tensile test specimens were machined from blanks measuring approximately 10 mm×10 mm×70 mm (0.39"×039"×2.76") from the original plate parallel to the longitudinal rolling direction. Prior to machining, the samples were solution-treated and aged as discussed in Section 2.2.1. From each blank, sub-sized tensile specimens, scaled in accordance to ASTM standards (1996 ASTM E8M) were machined as shown schematically in FIG. 25. The final specimen had a gage diameter of 6 mm (0.24") and a gage length of 30 mm (1.18").

All tensile tests were performed at room temperature using a computer controlled Sintech 20/G screw driven mechanical testing machine with a 20,000 lb (8896 N) load cell at a constant cross-head speed of 0.005 in/sec (0.127 mm/sec). The load cell was calibrated prior to every data set using the computer controlled calibration test. A calibrated extensometer of gage length 1" (25.4 mm) was attached to the sample during testing to measure the displacement. The load-time response was recorded using the TestWorks computer software package interfaced with the Sintech tensile testing machine. The actual cross-sectional areas and gage lengths of the specimens were measured prior to testing and listed in the testing program. Area reduction and extension were measured manually upon completion of the test. Engineering stress-strain curves were obtained directly thorough the TestWorks program. Based on a two-sample average for select processing conditions, the ultimate tensile strengths, 0.2% offset yield strengths and total elongations were obtained.

Scanning Electron Microscopy

A Hitachi S-3500 scanning electron microscope (SEM) with a tungsten hairpin filament was used to investigate the composition banding in the as-rolled samples and the fracture surfaces of the Charpy impact specimens. The microscope uses Quartz PCI Image Management Software for capturing images and for conducting quantitative analysis. For analysis, the samples were mounted on graphite tape and examined in the SEM with a 20 kV electron beam at a vacuum level of $10^{-4}$ torr inside the specimen chamber. The secondary electron (SE) detector was used for imaging both the etched and fracture surfaces. The compositionally banded structure of the etched sample was characterized quantitatively from the metal-oxide interface using the PGT Energy Dispersive X-ray analyzer with digital pulse processing. Fractography analysis was done to characterize the fracture surface and micrographs containing interesting features were taken.

Atom Probe/Field Ion Microscopy (AP-FIM)

A three-dimensional atom probe microscope was used for characterizing the size, number-density and composition of nanoscale strengthening (Cu precipitates) and toughening (Ni-stabilized austenite) dispersions in the heat-treated samples. The atom probe, operated and maintained under an ultra-high vacuum system ($10^{-10}$-$10^{-11}$ torr) combined with a field ion microscope, operated with imaging gas at a pressure level of $10^{-5}$ torr, makes it an extremely high-resolution microscopy technique.

The specimens (atom probe tips) were prepared by a two-step electropolishing sequence of small rods (100 mm long with 200 μm×200 μm square cross-section) cut from heat-treated hardness samples. Initial polishing was done using a solution of 10% perchloric acid in butoxyethanol at room temperature applying a DC voltage of 23V until the square rods were shaped into long needles with a small taper angle. A solution of 2% perchloric acid in butoxyethanol at room temperature was used for necking and final polishing to produce a sharply pointed tip, with a radius of curvature less than 50 nm. The voltage was gradually decreased from 12V DC to 5V DC during the final stages of electropolishing.

Each atom probe specimen of tip radius 10 to 50 nm is raised to a high positive potential of 5-15 kV, resulting in an exceptionally strong electric field on the order of 50 V/nm. FIM analysis was performed at temperatures between 50K-80K with a chamber pressure of $10^{-5}$ torr consisting of neon gas. The voltage on the tip was raised until an FIM image was observed on the monitor. Neon atoms, which are used as an imaging gas for steel, are ionized in the high electric field causing the positively charged ions to accelerate to a micro-channel plate array. The ionization process occurs at prominent atomic sites at the edge of a crystallographic plane corresponding to a particular atom. A continuous stream of ions forms an image on a phosphorus screen that represents the nanometer-scale structure of the specimen tip. FIM images were captured during analysis using the Scion Image imaging software. For atom probe analysis, the specimen is then rotated towards the reflectron for aligning the primary detector on the region of interest in the FIM image (usually near a pole or on a precipitate in the FIM image). Atom probe analysis is then conducted at temperatures 50K and 70K under ultra-high vacuum conditions ($10^{-10}$-$10^{-11}$ torr) for pulsed field-evaporation with a pulse fraction (pulse voltage/steady state DC voltage) of 20% at a pulse frequency of 1500 Hz.

Atom probe microanalysis is the study of the specimen composition by pulsed evaporation. Field evaporation of the specimen occurs at higher electric fields than ionization of imaging gas ions. The positively charged ions evaporated from the specimen are accelerated towards a detector. By measuring the time of flight, it is possible to determine the mass to charge ratio of the ions according to the following equation:

$$\frac{m}{n} = k(\alpha V_{dc} + \beta V_{pulse})\left(\frac{t + t_0}{d}\right)^2 \tag{10}$$

where m is the atomic mass, n is the charge, k is a constant related to the elementary charge of an electron, V is the DC or pulse voltage, t is the time, $t_0$ is a time offset from electronic delays, and α and β are system specific calibration parameters.

The standard error, σ, for compositions measured using an atom probe is calculated using binomial statistics to account for the statistical uncertainty associated with small sampling sizes according to the equation:

$$\sigma = \sqrt{\frac{c_i(1 - c_i)}{N}} \tag{11}$$

where $c_i$ is the measured composition of element i and N is the total number of ions sampled. This standard error does not account for any overlapping mass to charge ratios between different elements. Systematic errors that may interfere with the collection of specific elements such as carbon may be an additional source of error.

Three-dimensional atom probe (3DAP) records the two-dimensional location of atoms and determines the third dimension (z) by the sequence of arrival of atoms to the detector, thus providing a three-dimensional reconstruction of the specimen tip. The evaporated ion collides with a primary detector that records the time of flight, and the phosphorus screen emits light. The light is split by a partially silvered mirror at 45° to both a camera and an 8 by 10 array of anodes which determine the position of the ion.

The data from 3DAP was analyzed and visualized by the software ADAM developed by Hellman et al. Different elemental isotopes were distinguished by their mass/charge ratio. The overlap of isotope masses between elements contributed to the experimental error in addition to the statistical counting error. A range of tools is available in ADAM to analyze the data from the 3DAP. One feature of ADAM is the ability to define planar or cylindrical regions of interest and to perform analyses such as concentration profiles, ladder diagrams and composition maps with respect to that region of interest. For the data containing copper precipitates, varying in composition from the matrix, it was possible to define isoconcentration surfaces of constant composition. The three-dimensional representation of these isoconcentration surfaces allows for a qualitative view of the approximate size and shape of the precipitates being studied. ADAM has been designed to employ this method by creating a discrete lattice of nodes for which the local composition is calculated. The isoconcentration surfaces then have discrete positions. The creation of isoconcentration surfaces allows for another method of 3DAP data analysis referred to as the proximity histogram, or proxigram. The minimum distance to an isoconcentration surface is calculated for each ion in the data set and the ions are then assigned to bins according to distance. The concentration of each bin is calculated and plotted as a function of distance to the isoconcentration surface. The standard error of each bin is calculated and displayed on the proxigram.

Experimental Evaluation

The analysis began with evaluation of the processability characteristics of the designed alloy at an experimental-heat scale. Optimization of the tempering response of the alloy designed for multi-step treatment helped to attain a significant toughness/strength combination characterization of the strengthening and toughening dispersions related the structure to the properties.

Primary Processing. Behavior

Microsegregation and Hot-working Behavior

The achievement of the property objectives begins with meeting the initial processability requirements, i.e., castability of the steel. Microsegregation is a common problem observed in high-alloyed castings and hot-worked products, which limits the mechanical properties.

To study the microsegregation behavior in the cast alloy, the as-received material (homogenized for 8 hours at 1204° C., hot-rolled for 75% reduction to 0.45" or 4.5 cm thick plate and then annealed at 482° C. for 10 hours) in the form of a 10 mm×10 mm×20 mm sample, was etched with 2% nital following standard metallographic polishing to 1 μm. Low magnification transverse optical micrographs revealed both the banded structure oriented along the longitudinal rolling direction and the oxide-metal interface as shown in FIG. 26.

Figure 27:
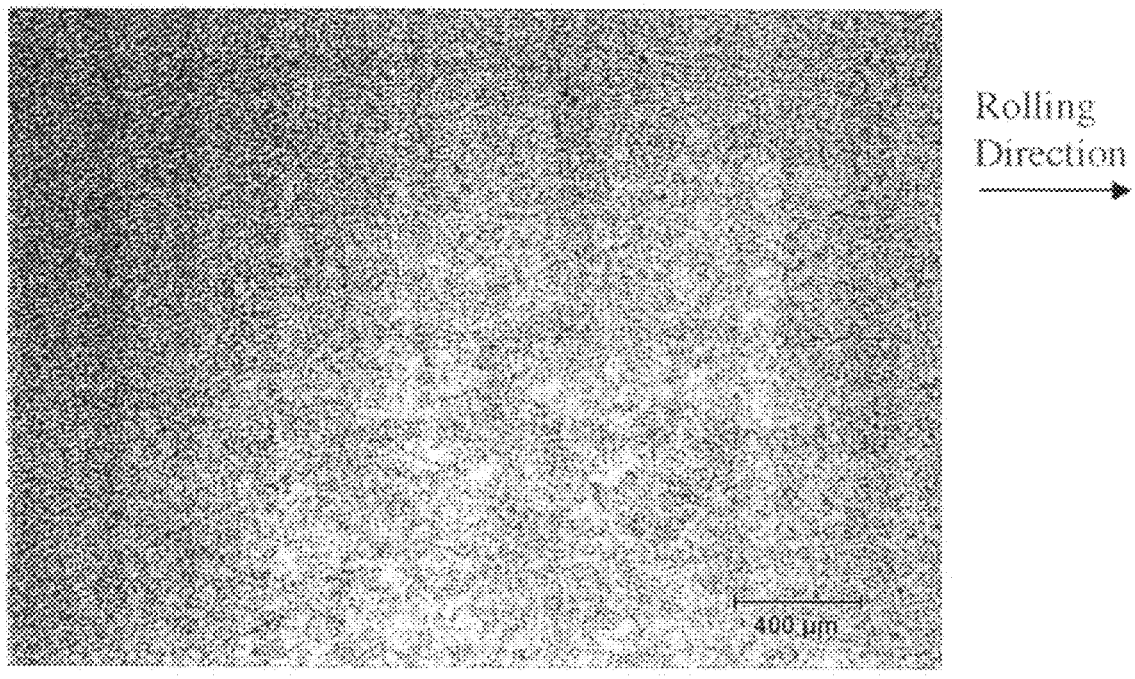
FIG. 27 is an optical micrograph of the hot-rolled plate viewed transverse to the rolling direction at the centerline after etching with 2% nital.
Figure 28:
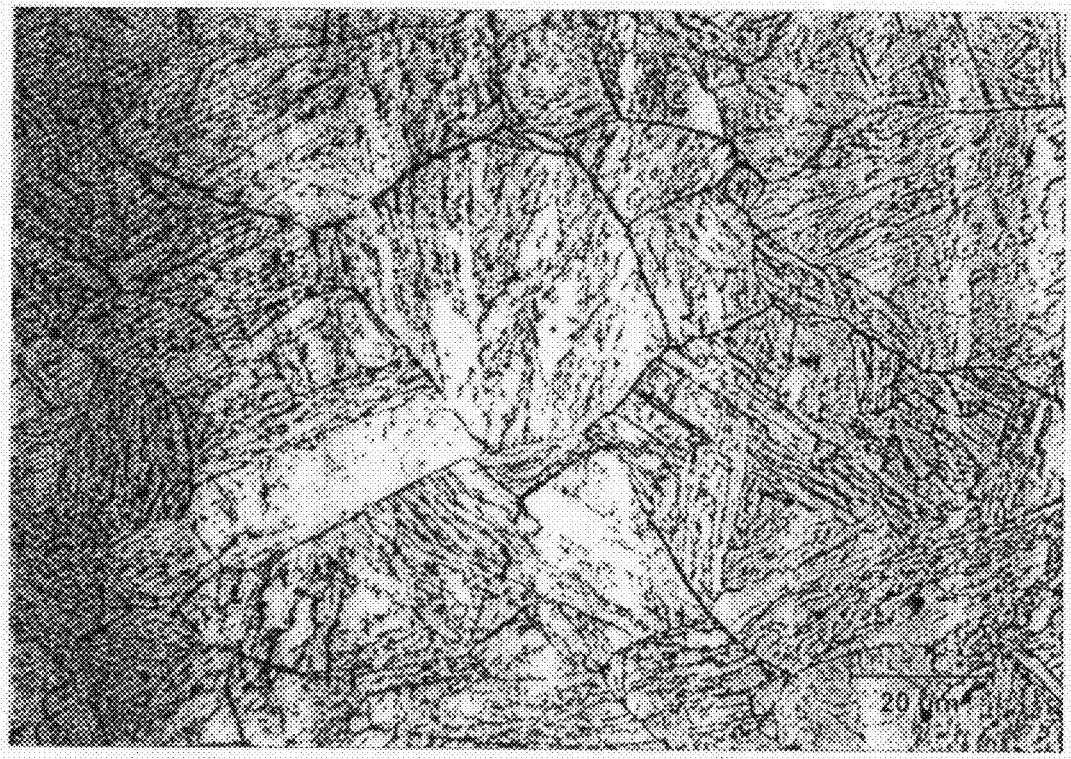
FIG. 28 is a higher magnification optical micrograph of the hot-rolled plate at the centerline.

The centerline of the hot-rolled plate did not reveal as much of a banded structure as the surface region, as shown in FIG. 27. Higher magnification optical micrograph at the centerline of the plate presented in FIG. 28 shows an equiaxed microstructure, which is predominantly lath martensite in the form of packets within the prior austenite grain boundaries of an average size of ~50 μm.

Figure 26:
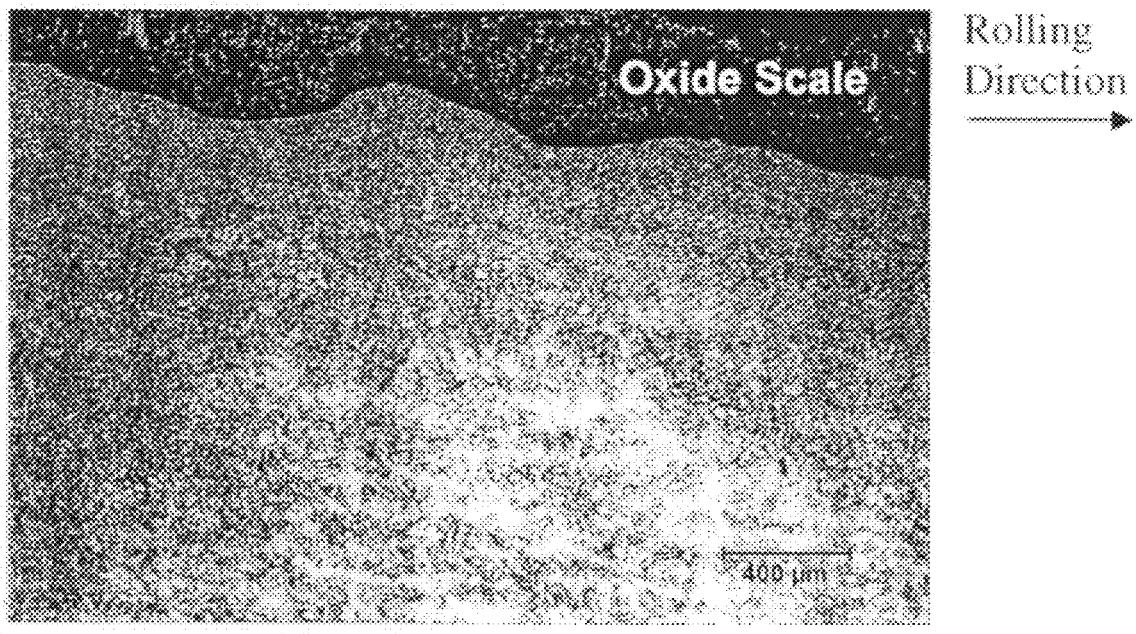
FIG. 26 is an optical micrograph of the as-received plate viewed transverse to the rolling direction at the oxide-metal interface after etching with 2% nital.
Figure 29:
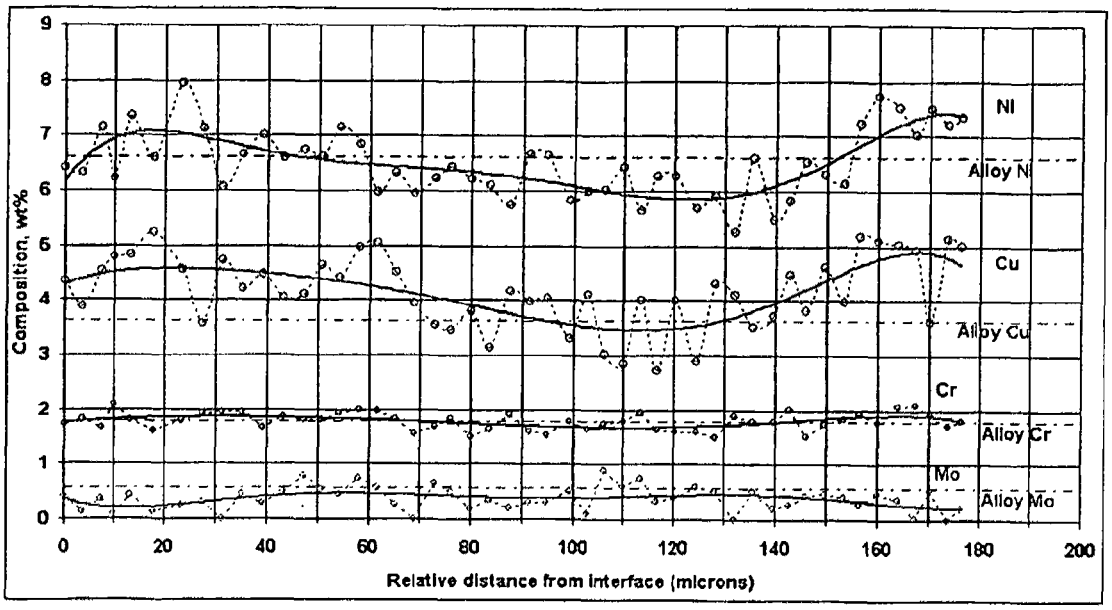
FIG. 29 is a graph of line profile compositions for as-received material from oxide-metal interface.

The composition bands revealed on etching in FIG. 26 were estimated to be of 40-50 μm thickness. The extent of microsegregation within these bands was determined by measuring the composition profile across the thickness of the plate near the oxide-metal interface. Composition data was collected every 4 μm starting from the metal-oxide interface and proceeding towards the center of the plate. The composition variation across the bands with respect to the major alloying elements Ni, Cu, Cr and Mo is presented in FIG. 29. It was found that compositional banding in the plate was limited to an amplitude of approximately 6-7.5 wt % Ni, 3.5-5 wt % Cu, 1.6-2 wt % Cr, and 0.2-0.5 wt % Mo. From the strength model, a variation in the level of Cu across the bands within 3.5 to 5 wt % corresponds to a predicted hardness variation of 30 VHN equivalent to 6.8 ksi (~47 MPa) in yield strength. This will promote a smooth yielding behavior as confirmed by the tensile property behavior.

Figure 30:
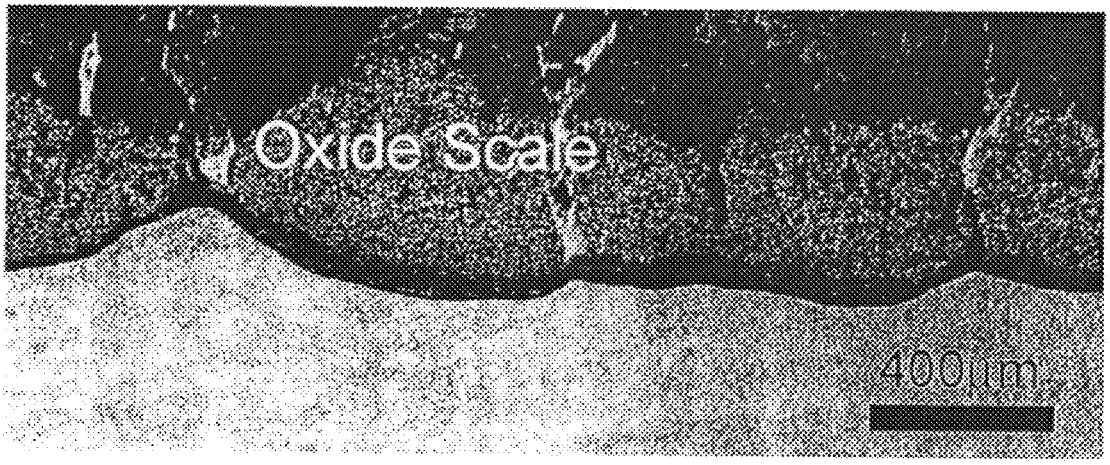
FIG. 30 is an optical micrograph showing the oxide scale in the as-received plate.

Another important factor determining the processability of an alloy is the material response during high temperature deformation or formability. Hot shortness is a common problem associated with high copper steel production. During the rolling stage of the fabrication process, the effect of hot shortness is observed by the appearance of surface cracks or fissures leading to unacceptable products. At hot rolling temperatures above 1050° C. in an oxidizing atmosphere, iron is selectively oxidized leaving an enrichment of copper near the oxide-metal interface. If the composition of the copper enriched region exceeds the liquid-austenite equilibrium limit, the copper enriched liquid phase enters the grain boundary of the austenite causing intergranular fracture during hot rolling. A high Ni/Cu ratio of 1.8 was maintained to prevent any hot-shortness problems during processing. Successful hot rolling of the alloy was demonstrated during processing. As further verification, the oxide layer of the as-received material was examined carefully for any evidence of Cu-rich regions. FIG. 30 shows an optical micrograph of the oxide layer in the as-received plate. The oxide-metal interface does not show any evidence of hot shortness. Composition analysis of various regions in the oxide layer did not reveal any Cu rich phase but did show some Ni-enriched phases varying from 20 to 80% within the Fe-rich oxide. This study thus supports the ability of Ni to cause occlusion of the Cu-enriched liquid during oxidation.

Evaluation of Allotropic Kinetics

Figure 31:
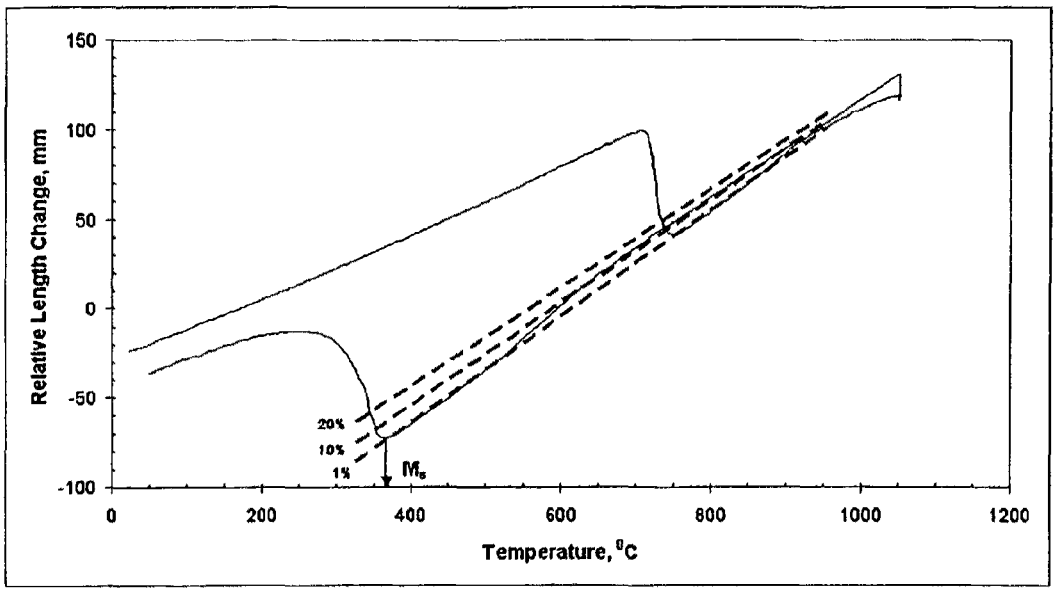
FIG. 31 is a plot of relative sample length change and temperature trace during heating and cooling (quench) cycle from dilatometry experiment.

A dilatometry study was conducted to determine the allotropic kinetics of the prototype. The first step involved the measurement of the martensite start temperature (Ms) of the designed alloy. FIG. 31 presents a plot of the relative length change vs. temperature, used to determine the transformation points during the heating and cooling (quench) cycle of a dilatometry experiment. Straight lines are fit to the single phase portions of heating and cooling curves, the full width between them defining full transformation. The series of dashed lines superimposed on the length and temperature trace represent varying degrees of partial martensitic transformation during rapid quench from an austenizing temperature of 1050° C. The threshold for transformation is taken as 1%. Thus, $M_S$ was determined from the 1% martensitic transformation point as shown in FIG. 31. The $M_S$ temperature, averaged over 15 dilatometry runs, is 360±8.4° C.

Since the alloy is a bainite/martensite microstructure during air-cooling of plates, the bainite kinetics was determined by studying the isothermal time-temperature-transformation characteristics of the steel through dilatometry. This information is useful in determining the processing necessary in order to achieve bainitic transformation of 50%, for example. The amount of bainitic transformation was determined by isothermal hold experiments (after an initial quench step) performed at incremental temperatures above the martensite start temperature. This data was then compiled and analyzed in order to plot a time-temperature-transformation (TTT) curve.

Figure 32:
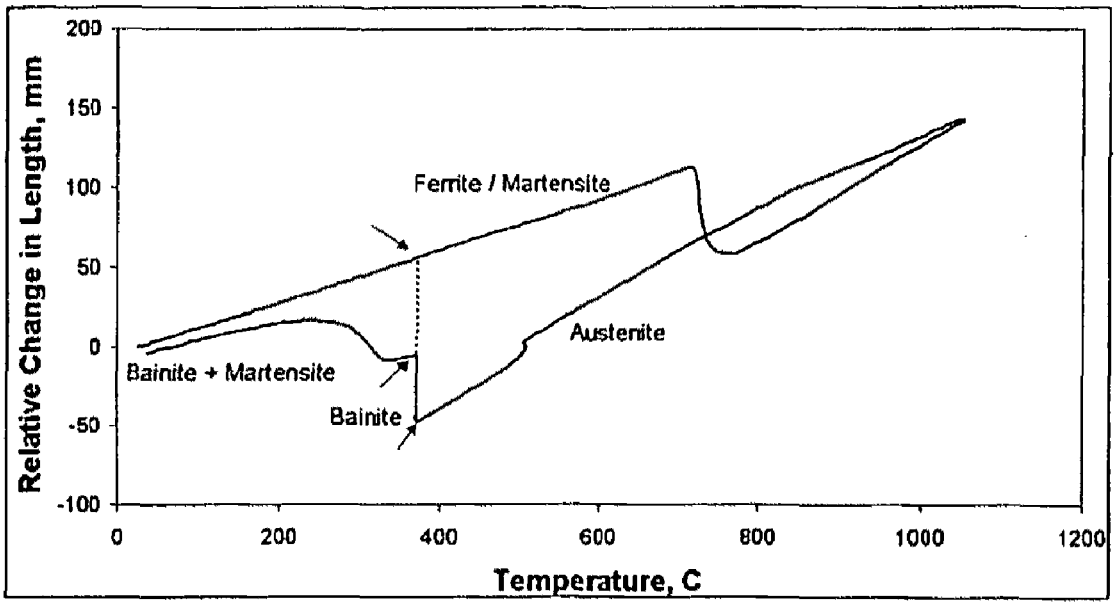
FIG. 32 is a plot of relative sample length change and temperature trace during heating, cooling and isothermal hold at 377° C. from dilatometry experiment.
Figure 33:
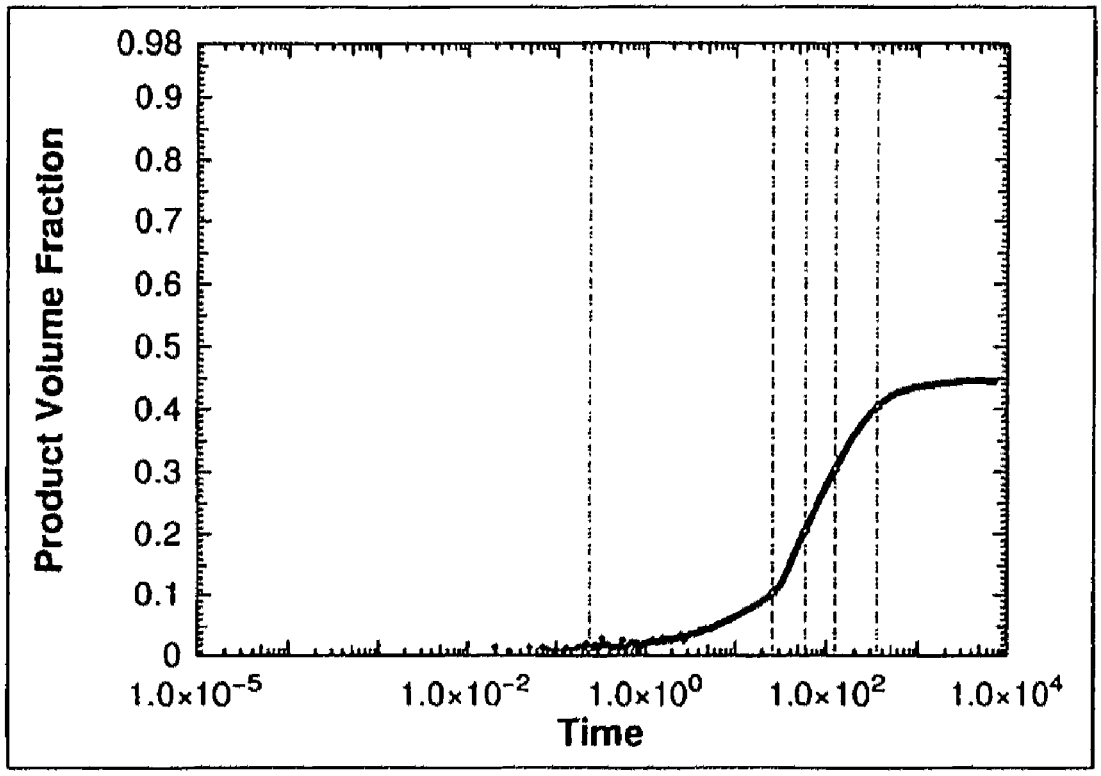
FIG. 33 is a volume fraction evolution of bainite as a function of time for isothermal temperature of 377° C.
Figure 34:
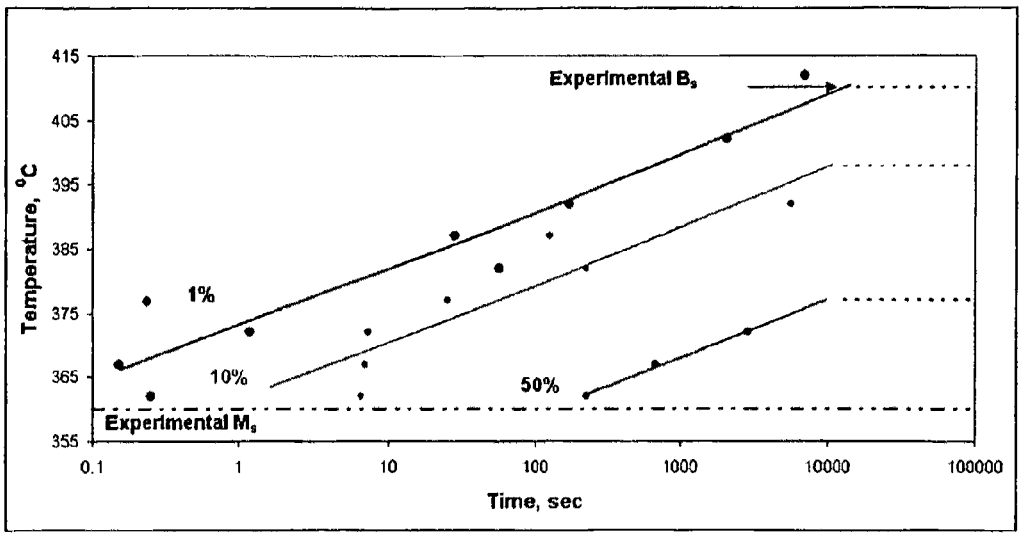
FIG. 34 is a time-temperature-transformation (TTT) curve for bainite transformation reaction.

The relative length change vs. temperature dilatometry trace for a two-hour isothermal hold at 377° C. is presented in FIG. 32. The percent of bainitic transformation is determined by measuring the length increase upon arrival at the isothermal hold temperature and dividing it by the total FCC(γ)–BCC(α) length difference (defined from the martensitic transformation in FIG. 31) at the isothermal hold temperature. In this case, the total bainitic transformation that took place after 2 hours is 44.1%. The evolution of bainitic transformation with respect to time can be determined from the measurement presented in FIG. 32. This behavior at 377° C. is shown in FIG. 33. From this plot it is apparent that the volume fraction of bainite is saturated after a two-hour isothermal hold. Similar analyses were carried out for each two-hour test performed at isothermal temperatures ranging from 362° C. to 407° C. Table 4 summarizes the maximum transformation levels at all the temperatures. The TTT curve was then determined by analyzing the data at each isothermal hold temperature. For example, a 1% transformation curve is plotted by finding the time at which the sample exhibits 1% transformation at different isothermal temperatures. The TTT curve based on the data from all of the isothermal runs is presented in FIG. 34. It shows achievement of a 50% bainite/martensite mix in approximately 4 minutes at 360° C. The experimental $B_S$ temperature was determined to be 410° C., 50° C. higher than the corresponding $M_S$ temperature (360° C.).

TABLE 4

Saturation volume fraction of bainite as a function of isothermal temperature

| Temperature (C.) | Saturation Volume Fraction of Bainite |
|---|---|
| 362 | 0.609629 |
| 367 | 0.526697 |
| 372 | 0.5003 |
| 377 | 0.440938 |
| 382 | 0.242981 |
| 387 | 0.265119 |
| 392 | 0.098382 |
| 402 | 0.015628 |
| 407 | 0.007966 |

Thermal Process Optimization

Isochronal Tempering Response

An isochronal tempering study was conducted to evaluate the tempering characteristics of the alloy and provide a baseline for multi-step tempering treatments. For simplicity, the tempering response investigation was done in a uniform martensite matrix to minimize retained austenite effects. Deleterious transformation products from retained austenite decomposition during tempering could negatively affect the toughness. After a solution treatment at 900° C. for 1 hour followed by a water quench and liquid nitrogen cool, tempering was performed for 1, 5 and 10 hours under vacuum. Samples were finish machined, notched and then tested at room temperature for Charpy impact toughness. Hardness measurements were taken directly from the polished surface of the Charpy specimens.

Figure 35:
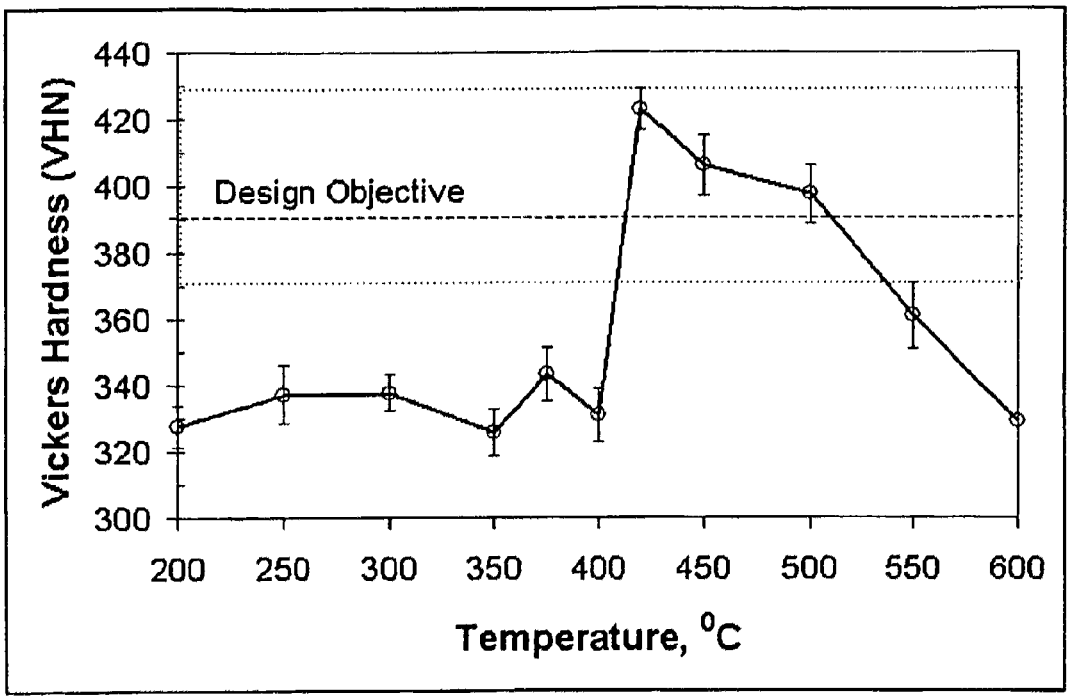
FIG. 35 is a plot of isochronal (1 hour) tempering response of prototype alloy. The arrow superimposed on the plot shows that the design objective is achieved by tempering at 500° C. in agreement with design prediction.

The tempering response for 1 hour isochronal tempering was investigated over a temperature range of 200° C.-600° C. in the solution-treated alloy and is shown in FIG. 35. The 1-hour isochronal tempering study demonstrates that a peak hardness level is reached at 420° C. followed by gradual overaging. The retention of high hardness even after the peak aging condition to 500° C. can be attributed to precipitation of $M_2C$ carbides and a fine austenite dispersion. The hardness at 500° C. is (represented by an arrow in FIG. 14).

Figure 36:
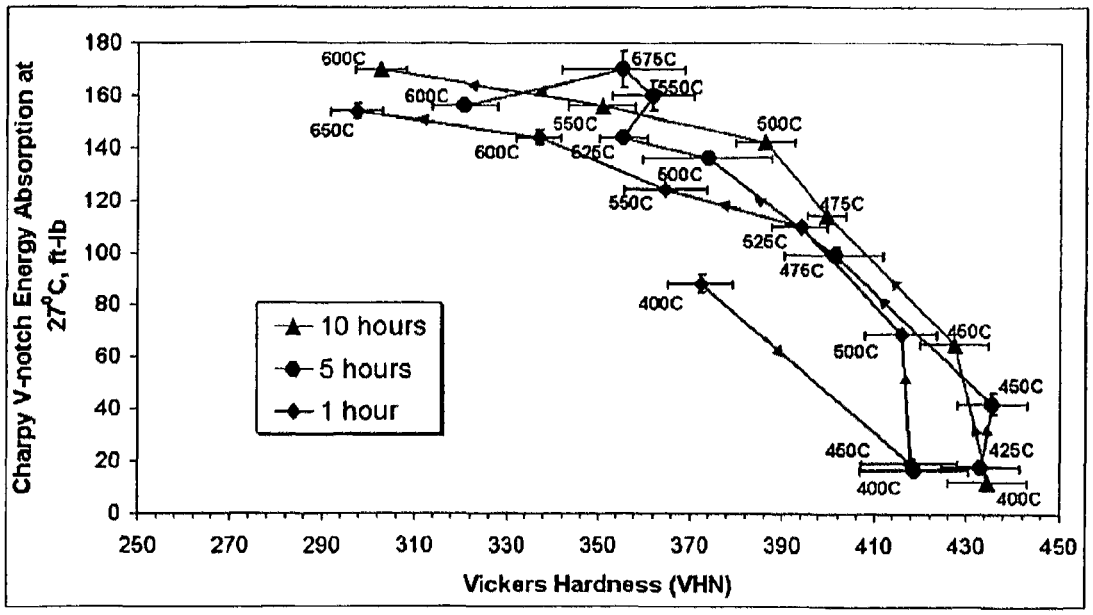
FIG. 36 is a plot of isochronal tempering response represented by Charpy toughness—Vickers hardness trajectory. The label corresponding to each data point indicates the tempering temperature.

After confirming the basic secondary hardening characteristics of the alloy, a series of isochronal tempering treatments of Charpy specimens were done for 1, 5 and 10 hours within a temperature range of 400-600° C. FIG. 36 illustrates the room temperature Charpy toughness ($C_V$)—Vickers hardness (VHN) trajectory for the indicated tempering temperatures. This establishes the baseline of the toughness-hardness (strength) combination in tempered martensitic microstructures.

At the shortest tempering time of 1 hour, FIG. 36 demonstrates that cementite formation limits toughness, and as Cu precipitates in its presence, strength increases from 400° C. to 450° C. tempering treatment while there is a sharp decline in toughness. With further tempering, cementite begins to dissolve as a result of $M_2C$ carbide formation in combination with BCC copper precipitation at the peak aging condition. This results in an increase of both strength and toughness. The toughness-hardness trajectory takes a sharp turn thereafter, as the strengthening precipitates begin to coarsen exceeding their optimum sizes and the strength continues to decrease with overaging. FIG. 36 suggests that peak hardness occurs at 450° C. 5 hour tempering and the corresponding toughness resides on an upper band indicating complete dissolution of paraequilibrium cementite by precipitation of an optimal size $M_2C$ strengthening dispersion.

The highly overaged region is also likely associated with precipitation of a fine dispersion of austenite, which increases in stability due to Ni enrichment at higher tempering times. A feature observed in the toughness-hardness trajectory for 5 hour tempering in FIG. 36 between tempering temperatures of 525° C. and 575° C. is a toughness enhancement from the baseline toughness of 144 ft-lbs to 170 ft-lbs respectively, a toughness increment by 18% at a strength level corresponding to 355 VHN. This is characteristic of the transformation toughening phenomenon caused by the austenite reaching an optimal stability for the lower strength condition.

Figure 37:
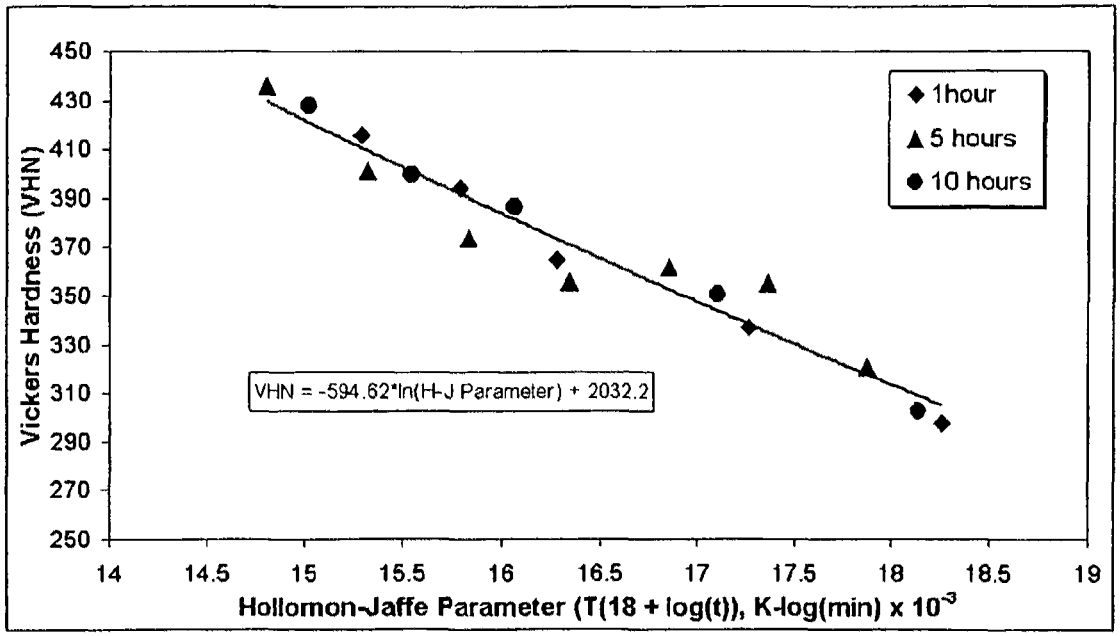
FIG. 37 is a plot of Hollomon-Jaffe Parameter correlating the hardness data obtained for different tempering conditions in the overaged region.

The tempering response of the hardness (strength) can be correlated to an empirical Larson-Miller type parameter, known as the Hollomon-Jaffe tempering parameter. The parameter is defined as $T(18+\ln(t))$ where T is tempering temperature in K and t is the tempering time in minutes, and is used for correlation of hardness data at higher tempering temperatures between 400° C. and 600° C. FIG. 37 presents the measured values of hardness for different tempering conditions as a function of the Hollomon-Jaffe tempering parameter. Fairly good agreement with the parameter is obtained for hardnesses under overaged tempering conditions. The parameter can provide a simple interpolation scheme to adjust tempering for a desired strength level.

Figure 38:
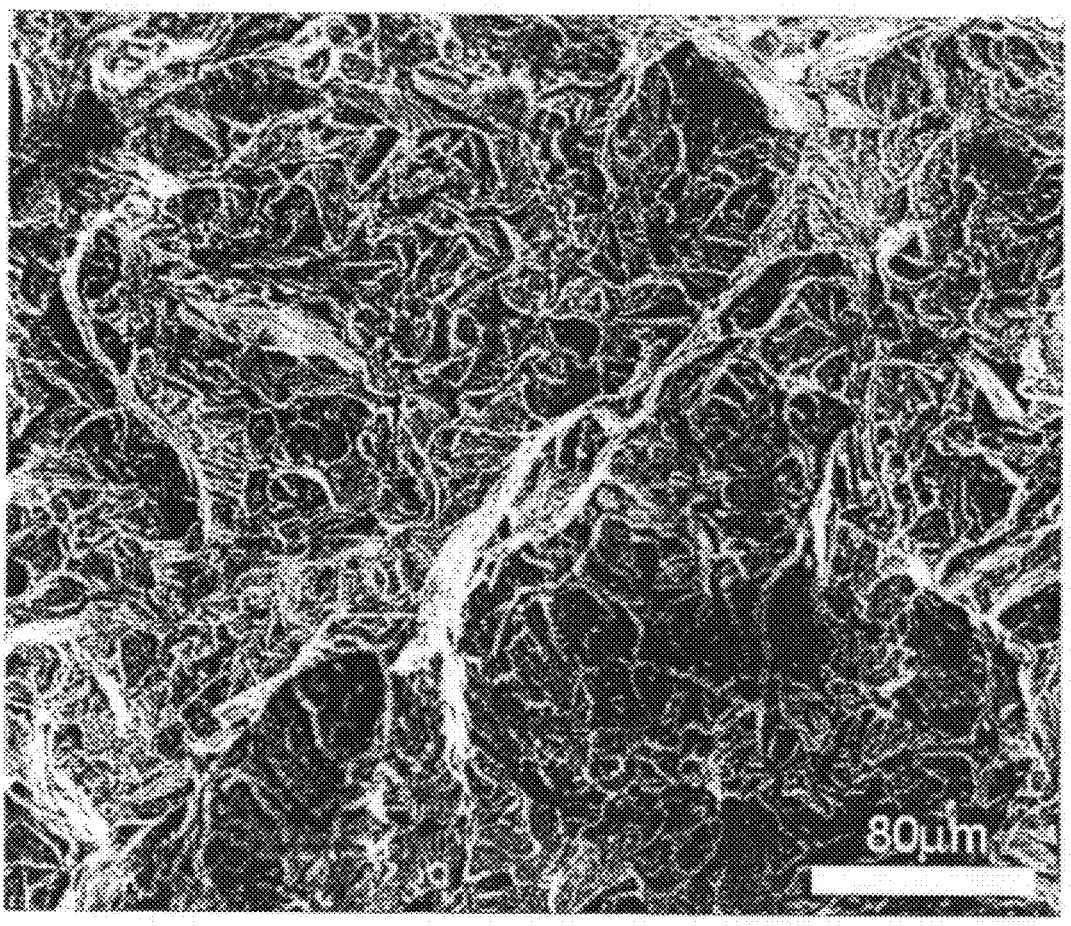
FIG. 38 is a SEM micrograph of quasi-cleavage fracture surface for prototype tempered at 450° C. for 1 hour.

The fracture surfaces of the broken Charpy impact testing samples were observed under SEM to characterize the mode of fracture. The fracture surface for the 450° C. 1 hour tempering condition is presented in FIG. 38. The SEM micrograph reveals that the sample failed by quasi-cleavage fracture with signs of intergranular embrittlement. Quasi-cleavage is characterized by an array of cleavage failures connected by ductile tear ridges but is a much more desired fracture mode compared to intergranular fracture. The fracture mode represents relatively brittle behavior attributed to the presence of undissolved cementite at short tempering times.

Figure 39:
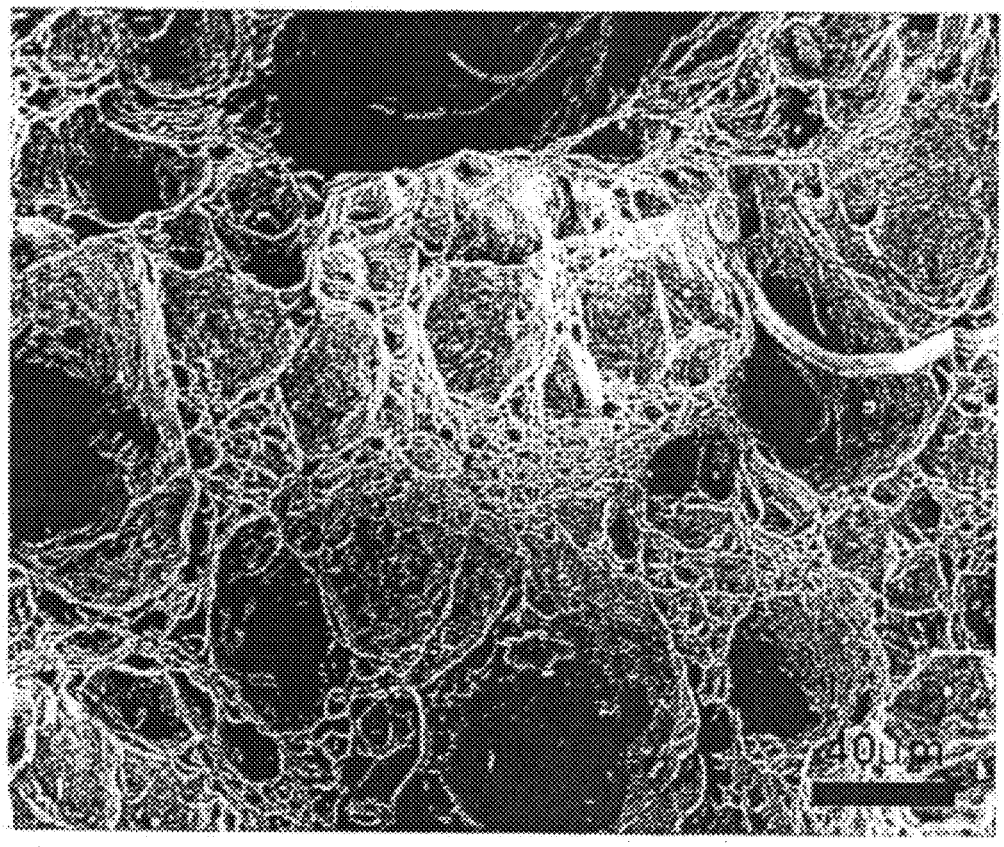
FIG. 39 is a SEM micrograph of ductile fracture surface for prototype tempered at 525° C. for 5 hours.
Figure 40:
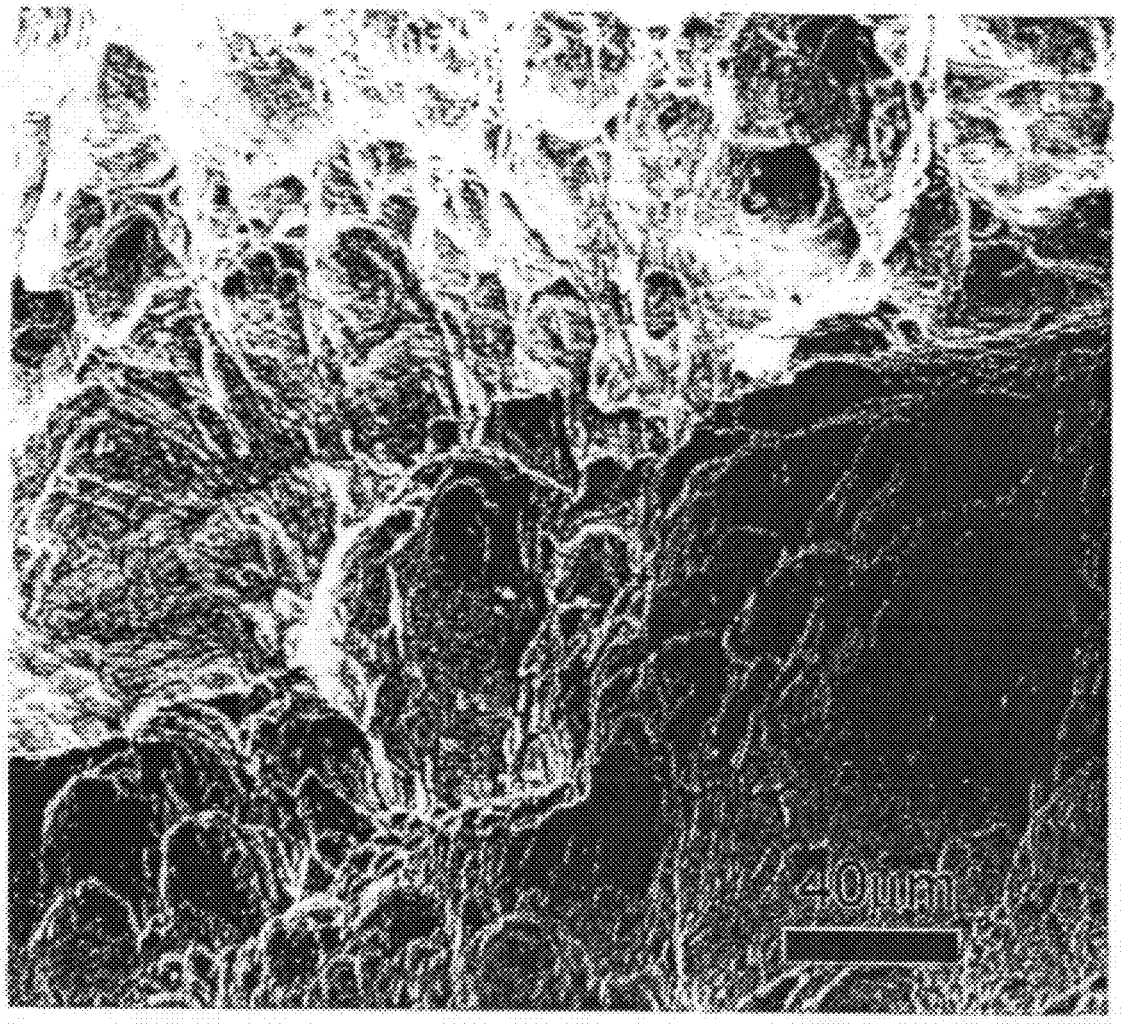
FIG. 40 is a SEM micrograph of ductile fracture surface representing toughness enhancement due to transformation toughening for prototype tempered at 550° C. for 5 hours.
Figure 41:
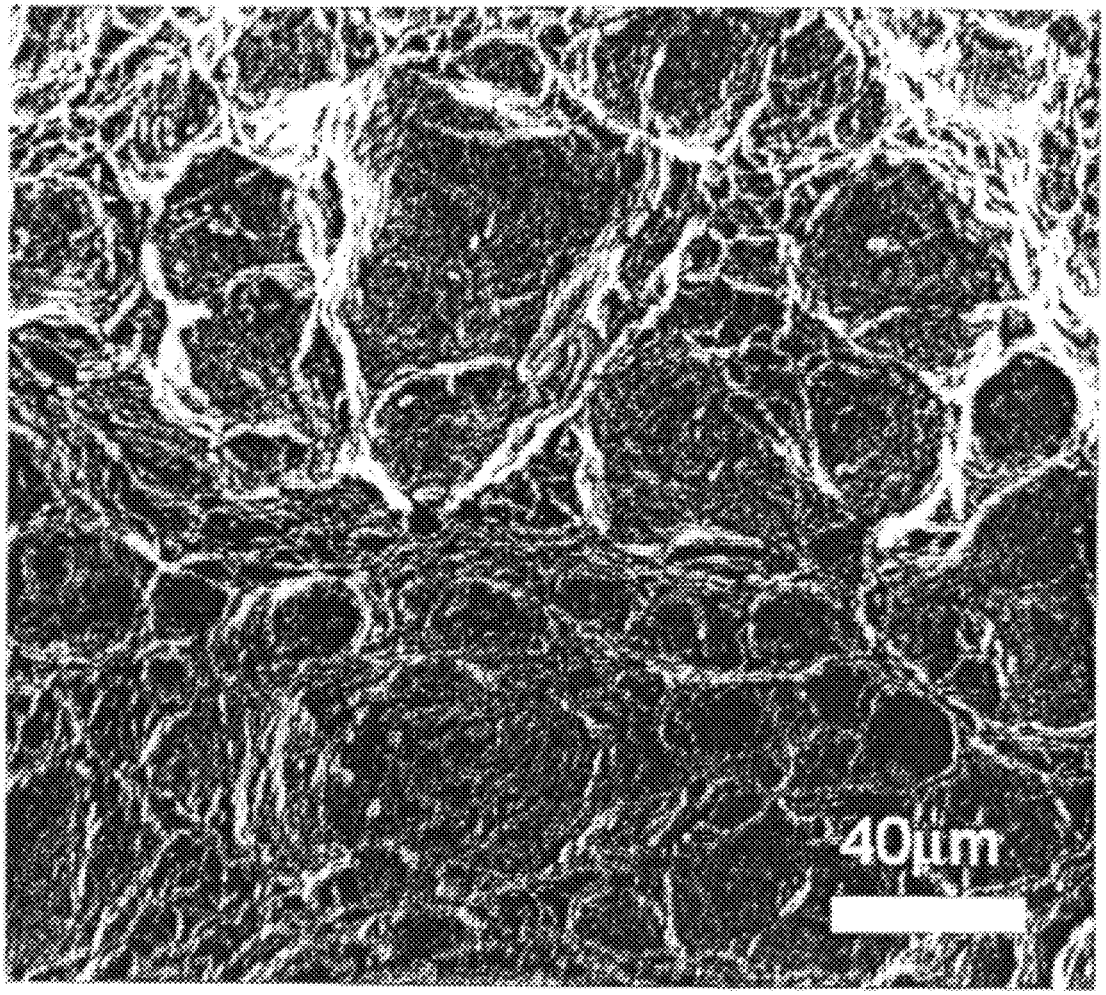
FIG. 41 is a SEM micrograph of ductile fracture surface representing toughness enhancement due to transformation toughening for prototype tempered at 575° C. for 5 hours.

For higher tempering times and temperatures, ductile fracture occurred by microvoid nucleation and coalescence. Representative SEM micrographs showing ductile mode of fracture for 5 hour tempering marked by toughness enhancement due to transformation toughening in FIG. 36 are presented in order of increasing tempering temperature in FIGS. 39 through 41. FIG. 39 clearly shows that a completely ductile mode of fracture is achieved with 5 hour 525° C. tempering and micrographs presented in FIGS. 40 and 41 represent fracture surfaces with increased toughness due to transformation toughening, indicated by the relatively higher degree of primary void growth.

Toughness Optimization by Multi-step Tempering

Heat treatment for stabilization of austenite for dispersed phase transformation toughening phenomenon is directed towards combined size refinement and compositional enrichment of the austenite particles. A two-step tempering process consisting of an initial high temperature, short time treatment followed by an isothermal tempering treatment is employed to achieve this goal. The first step is designed to nucleate a fine, uniform dispersion of intralath austenite and strengthening particles of sub-optimal size formed directly by increasing the driving force for precipitation. This is achieved by a short time, high-temperature tempering step designed to give an underaged state based on the isochronal tempering study. At this stage, it is advised to understand the implications of the kinetic competition between the precipitation of austenite and strengthening dispersions namely, BCC copper and $M_2C$ carbides. In the alloy, the austenite precipitation kinetics is slower than the BCC copper precipitation kinetics, which in turn is considerably slower than the carbide precipitation process at intermediate tempering temperatures. It is, therefore, desired to optimize the time for the high-temperature austenite nucleation step, since the carbides might become overaged at higher times and full hardness cannot likely be achieved. Yet this uncertainty in loss of strength by overaging of carbides is overcome in the alloy because of additional strengthening of nearly 40% provided by BCC copper precipitation, which has slower coarsening kinetics than the carbides. The second tempering step is thus optimized to enhance Ni-enrichment of the austenite particles coupled with completion of precipitation strengthening for peak aging condition involving enrichment of the 3 nm Cu precipitates and cementite conversion to 3 nm $M_2C$ carbides. This is achieved by a longer-time final tempering at a lower temperature characterized by the peak strengthening condition. Thus, from the toughness-hardness trajectory for isochronal tempering presented in FIG. 36, the optimal final stage tempering condition was determined to be about 5 hours at 450° C., which produced a peak hardness of 436 VHN. The first step was optimized by varying the tempering time from 5 to 90 minutes over a temperature range of 500° C. to 575° C. in intervals of 25° C.

Figure 42:
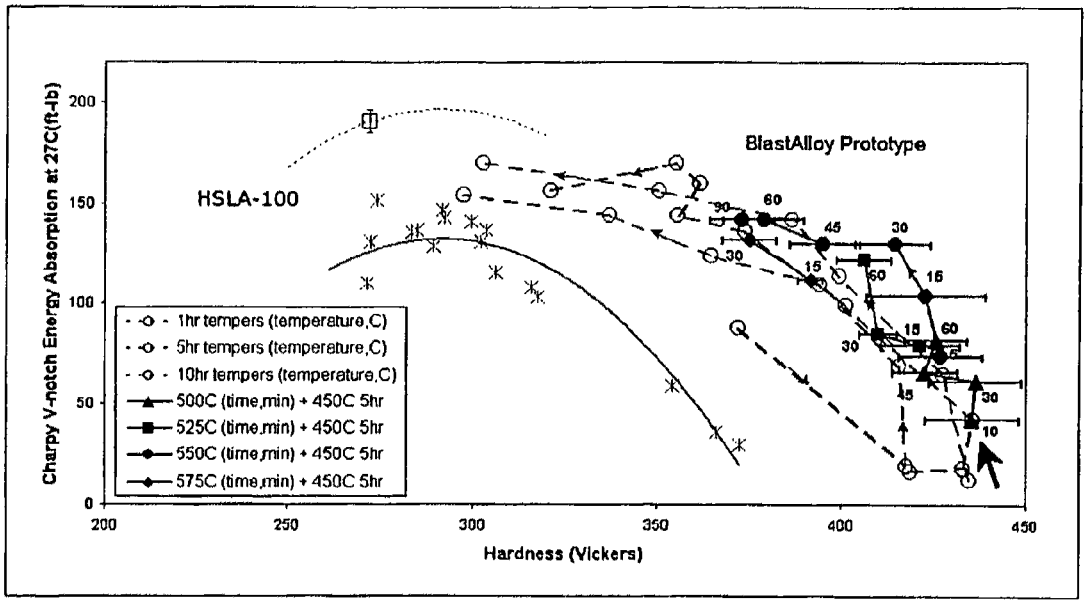
FIG. 42 is a plot of a multi-step tempering treatments designed to maximize transformation toughening response represented by Charpy toughness—Vickers hardness trajectory. The label corresponding to each data point indicates the tempering time during the first tempering step. The condition for the second step is listed on the legend.

FIG. 42 shows the variety of two-step heat treatments investigated to maximize the toughness-strength combination in comparison with an HSLA100 alloy and is superimposed on the isochronal tempering plot. The labels in the plot represent the tempering time in minutes corresponding to the first step and the bold black arrow points to the condition for maximum strengthening, which is the final step in the tempering sequence. The short time, high temperature nucleation treatments were conducted in a molten salt-bath to reduce heating time followed by water quench to reduce cooling time. The initial solution treatment was conducted in argon atmosphere and isothermal aging was conducted under vacuum as described earlier.

The optimal combination of toughness and strength is determined from FIG. 42 to be about a 550° C. 30 minutes followed by 450° C. 5 hours heat treatment. The apparent achievement of optimal austenite stability by multi-step tempering results in significant increase of impact toughness to 130 ft-lbs at a hardness level of 415 VHN. Comparing with the baseline toughness-strength combination from isochronal tempering data, a transformation toughening increment of 50% from 87 ft-lbs for the 10 hour isothermal treatment and 70% from 77 ft-lbs for the 5 hour isothermal treatment is observed at the same strength level. So an average of 60% toughness increment due to dispersed phase transformation toughening can be attributed to multi-step tempering when compared to standard isothermal tempering at the same strength level.

The competition of several substructures begins with the first higher temperature nucleation treatment. Within the carbide subsystem, cementite has an initial advantage of precipitation because it involves only rapid interstitial carbon diffusion. As aging time increases, the more stable but kinetically slower $M_2C$ carbides attract carbon from cementite as they coherently precipitate at heterogeneous sites provided by the high dislocation density of the martensitic matrix. In parallel, the copper atoms also partition out of solution and nucleate on the dislocation substructure. This promotes not only dissolution of cementite but also heterogeneous nucleation of austenite particles on the carbide and copper strengthening precipitates. The precipitation phenomenon is halted after the first step nucleation treatment by water quenching. At this point, the microstructure consists of embryonic BCC copper and $M_2C$ precipitates acting as nucleation sites for intralath austenite with some undissolved cementite. The second heat treatment step continues the precipitation of $M_2C$ at the expense of cementite and enriches the fine austenite in Ni while continuing the precipitation of Cu. The lower temperature of this second tempering step is likely to produce additional nucleation of the strengthening precipitates as more dislocation sites are activated by the higher driving force. The embrittling cementite dispersion is eventually consumed by the very fine dispersion of $M_2C$.

Figure 43:
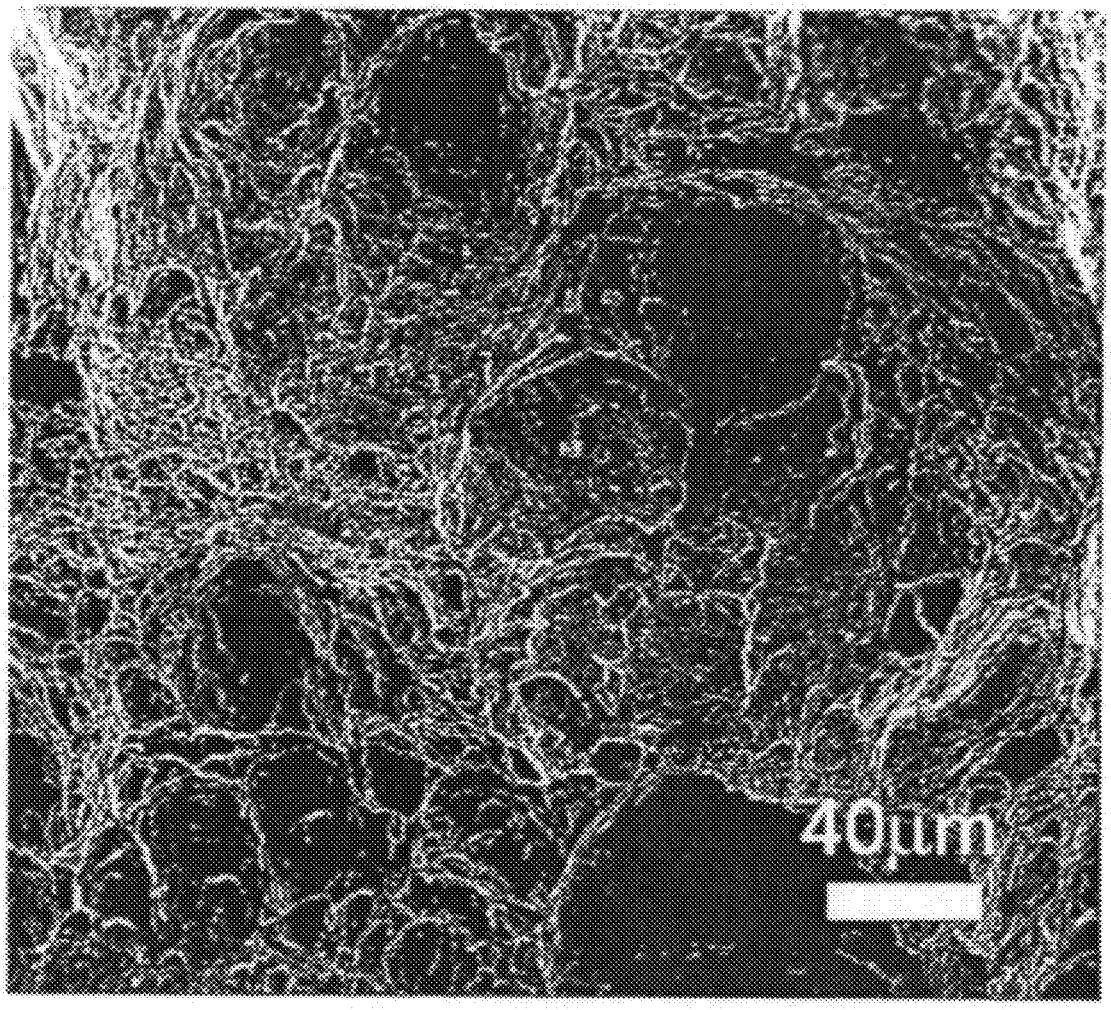
FIG. 43 SEM micrograph of ductile fracture surface representing toughness enhancement due to transformation toughening for the 550° C. 30 min+450° C. 5 hrs multi-step tempering treatment.
Figure 44:
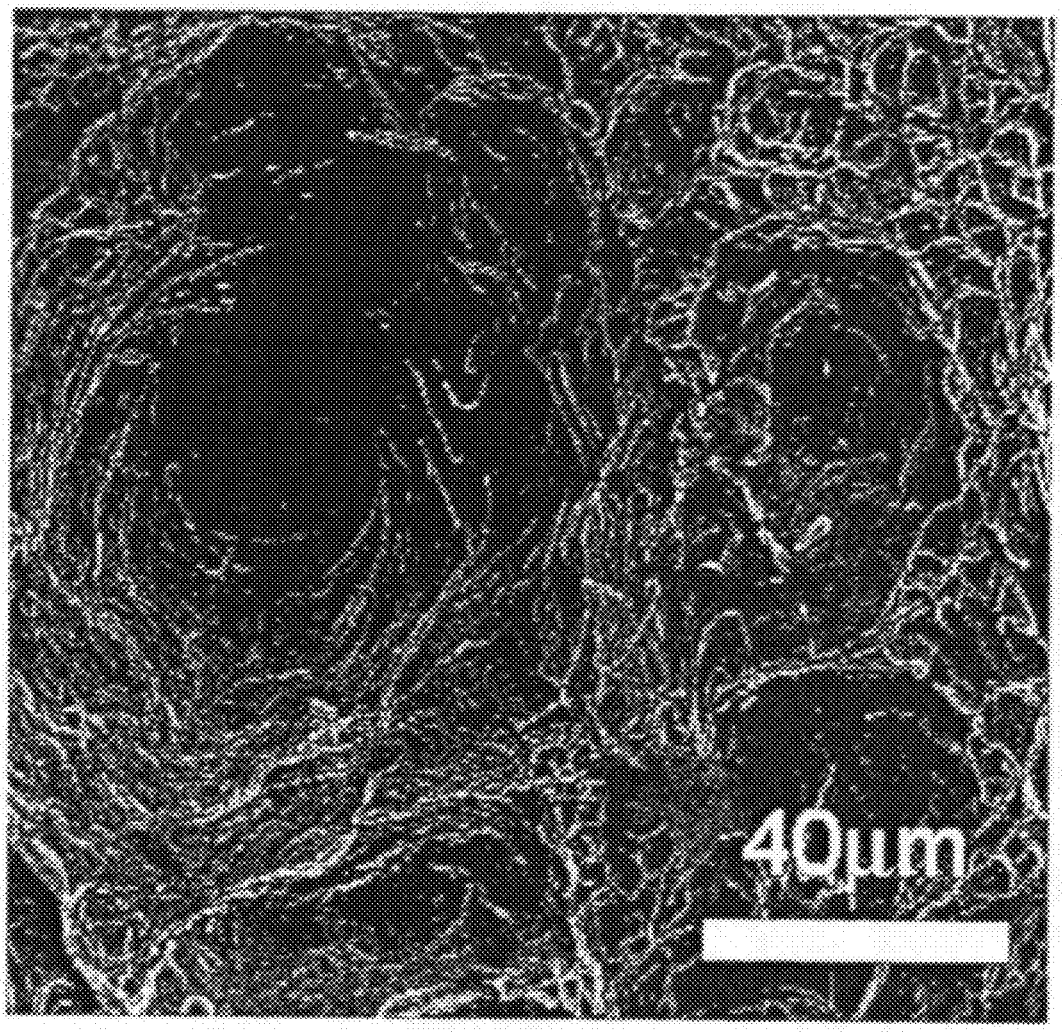
FIG. 44 is a SEM micrograph of a primary void in the fracture surface of prototype for 550° C. 30 min+450° C. 5 hrs multi-step tempering treatment.

SEM analysis of the fracture surfaces for the multi-step treatment specimens indicate transition from quasi-cleavage to ductile mode of failure as the time of initial tempering is increased, attributed to transformation toughening increment as described. FIG. 43 presents a representative micrograph of the fracture surface for the optimal toughness-strength combination for tempering treatment of 550° C. 30 min+450° C. 5 hrs. FIG. 44 shows a higher magnification micrograph of a primary void in the same sample. The relatively higher degree of primary void growth is consistent with delayed microvoid instability, as expected for transformation toughening.

Mechanical Properties

Evaluation of Tensile Properties

An evaluation of the tensile properties was conducted to determine the actual yield strength of the alloy under the optimized tempering conditions and to provide a basis for comparison of the hardness—strength correlation for this class of steels. Room temperature tensile properties were assessed for the chosen heat treatment conditions based on the results of the toughness—hardness data from both isochronal and multi-step tempering response. The tempering conditions were chosen to cover the full width of the toughness—strength combination plot (FIG. 42). The same processing route of solution treatment at 900° C. for 1 hour followed by water and liquid nitrogen quench and isothermal aging (short time aging was done using molten salt bath) was followed for the tensile samples, prior to final machining into dimensions described previously. Duplicate samples for each heat treatment condition were tested to determine the scatter in the data. Table 5 summarizes the results of the tensile testing for the solution treated and aged samples for each heat treatment condition and provides hardness values for comparison. FIG. 46 presents the true stress vs. true plastic strain curves for all the samples tested. The curves are represented as solid lines until the point of tensile instability (necking) or uniform elongation and by dotted lines thereafter. The tensile data presented in FIG. 45 and Table 5 confirms the design of a 160 ksi yield strength steel. The multi-step tempering treatments helped to achieve the 160 ksi yield strength goal.

dispersed phase transformation toughening. Thus, from FIG. 42 the tempering condition displaying the best toughness-strength combination, 550° C. 30 min+450° C. 5 hrs was chosen. The alloys were solution treated at 900° C. for 1 hour, water quenched, liquid nitrogen cooled and then multi-step tempered. The samples were thermally equilibrated at the test temperature for 20 minutes prior to testing.

Figure 47:
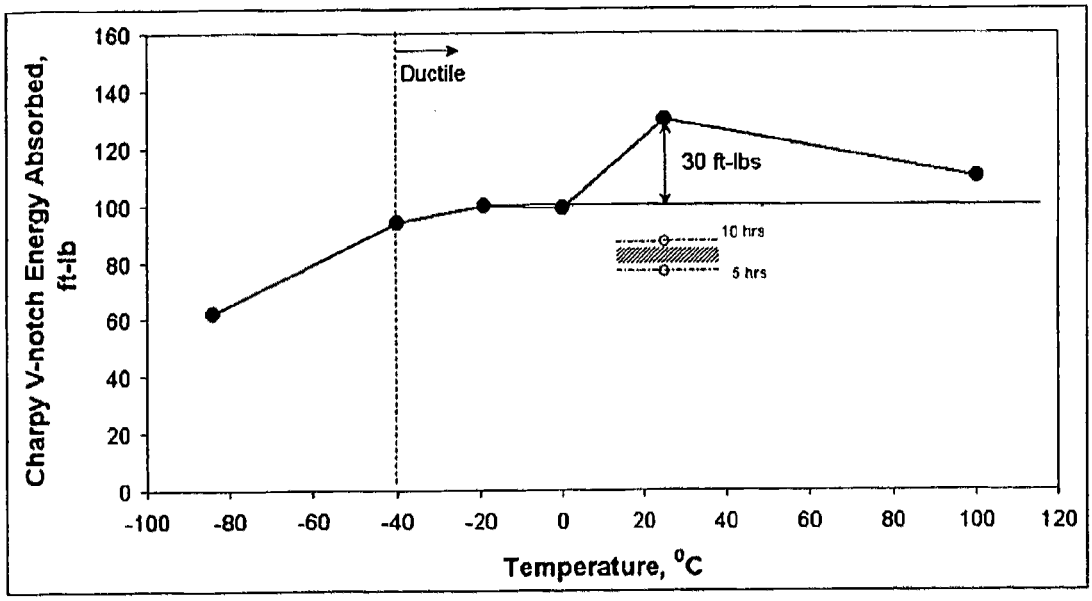
FIG. 47 is a plot of Charpy impact energy absorbed as a function of testing temperature for prototype tempered at 550° C. 30 min+450° C. 5 hr. Toughness increment of 30 ft-lb due to dispersed phase transformation toughening is shown. The toughness band defined by 5 hour and 10 hour single step tempering is superimposed.

FIG. 47 shows the Charpy impact energy of the prototype as a function of test temperature. The corresponding impact energy values for 5 hour and 10 hour tempering treatments at room temperature are superimposed on the plot. The plot shows that there is a 30 ft-lbs toughness increment at 25° C.

TABLE 5

Room temperature tensile properties of alloy

| Tempering Condition | 0.2% Off-set Yield Strength ksi (MPa) | Ultimate Tensile Strength ksi (MPa) | YS/UTS | Uniform Elongation % | Reduction in Area % | Hardness VHN |
|---|---|---|---|---|---|---|
| 575° C. 5 hours | 142.12 (980) | 146.45 (2019) | 0.97 | 4.98 | 73.94 | 355.30 |
| 550° C. 30 minutes + 450° C. 5 hours | 156.35 (1078) | 167.56 (1155) | 0.93 | 5.89 | 64.60 | 414.70 |
| 500° C. 30 minutes + 450° C. 5 hours | 160.97 (1110) | 180.16 (1242) | 0.89 | 5.70 | 57.09 | 436.57 |

From data on the reduction in area at fracture and uniform elongation in Table 3, all the heat treatment conditions show reasonably high values of ductility. The ratio of YS/UTS (strength ratio) is a general measure of work hardening behavior. The low values of strength ratio for the "transformation toughening optimized" multi-step treatments compared to that for the single-step treatment condition suggests that the work hardening of the steel is appreciably improved by the optimal tempering treatments. The load-displacement curves for all the conditions showed smooth yielding without any distinguishable upper and lower yield points. Analysis revealed that the plastic stress strain behavior could be described by the Hollomon power law equation (Equation 12). The fitting parameters are summarized in Table 6.

$$\sigma_{pl}=K\epsilon_{pl}^{n} \tag{12}$$

n is the strain-hardening exponent and K is the strength coefficient in ksi.

The yield strength and hardness data from Table 3 is superimposed on the hardness—yield strength correlation plot in FIG. 46 (see FIG. 6 for comparison). The black heavy points represent the data from the current tensile properties study of alloy.

TABLE 6

Figure 45:
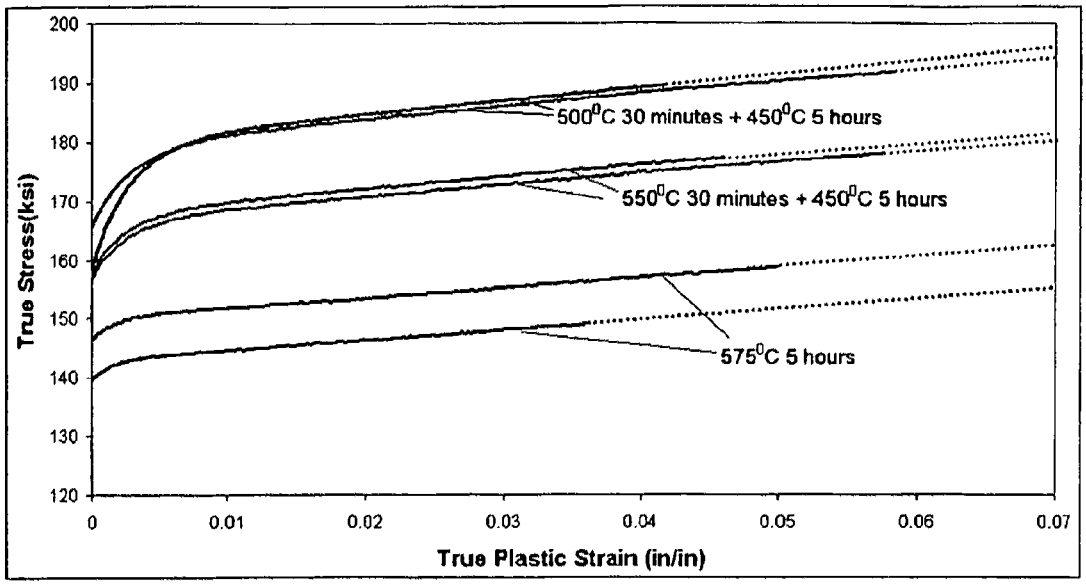
FIG. 45 is a plot of true stress—true plastic strain response. The stress ($\sigma$)—plastic strain ($\epsilon_p$) behavior is shown by solid lines until uniform elongation and by dotted line after necking.
Figure 46:
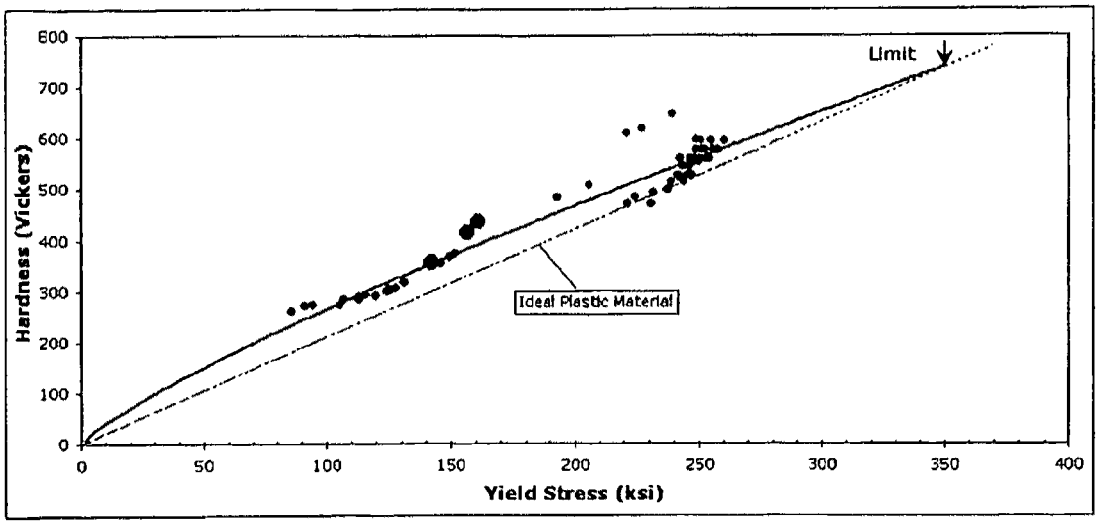
FIG. 46 is a plot of hardness—Yield Strength Correlation developed from previous data. The heavy black points represent data from current investigation.

Fitting parameters for Hollomon power law equation from tensile data of alloy (FIG. 45)

| Tempering Condition | | Yield Stress, ksi $\sigma_0$ | Strain Hardening Exponent n | Strength Coefficient, ksi K |
|---|---|---|---|---|
| 575° C. 5 hours | # 1 | 138.59 | 0.027 | 162.8 |
| | # 2 | 145.64 | 0.03 | 172.6 |
| 550° C. 30 minutes + | # 1 | 155.81 | 0.04 | 199.1 |
| 450° C. 5 hours | # 2 | 156.9 | 0.038 | 198.7 |
| 500° C. 30 minutes + | # 1 | 157.5 | 0.042 | 216.6 |
| 450° C. 5 hours | # 2 | 164.44 | 0.048 | 219.8 |

Toughness—Temperature Dependence

To characterize the effect of service temperature on toughness, Charpy V-notch impact tests were performed over temperatures ranging from −84° C. to 100° C. for the tempering condition that optimized the austenite for room-temperature compared to the baseline ductile fracture toughness at lower and higher test temperatures. Additional toughening occurs in the alloy because of the delay of microvoid shear localization during ductile fracture by the optimum stability austenite dispersion. At higher and lower test temperatures austenite becomes less stable than required for transformation toughening to occur although the fracture still occurs in a purely ductile mode, as confirmed by fractography.

Figure 48:
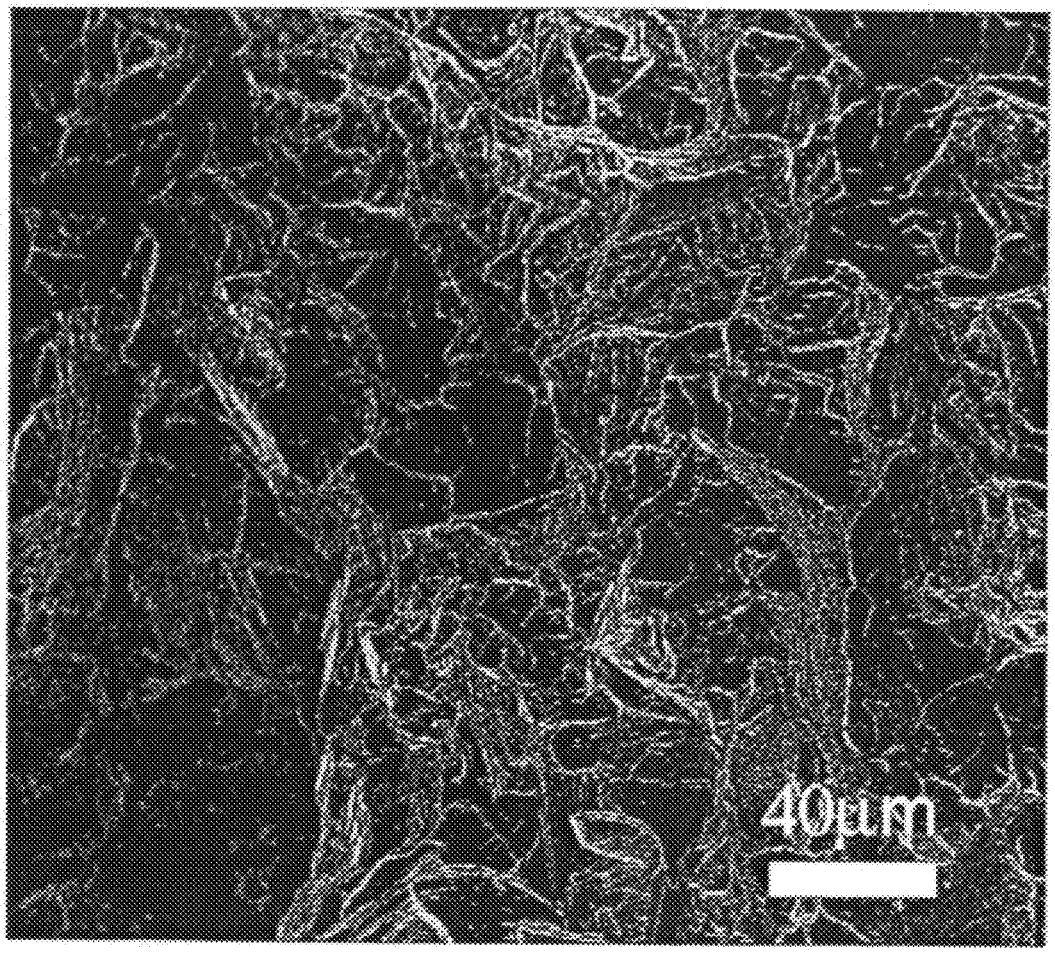
FIG. 48 is a SEM micrograph of quasicleavage fracture surface showing flat facets with dimples and tear ridges for the 550° C. 30 min+450° C. 5 hrs multi-step tempering treatment tested at −84° C.
Figure 49:
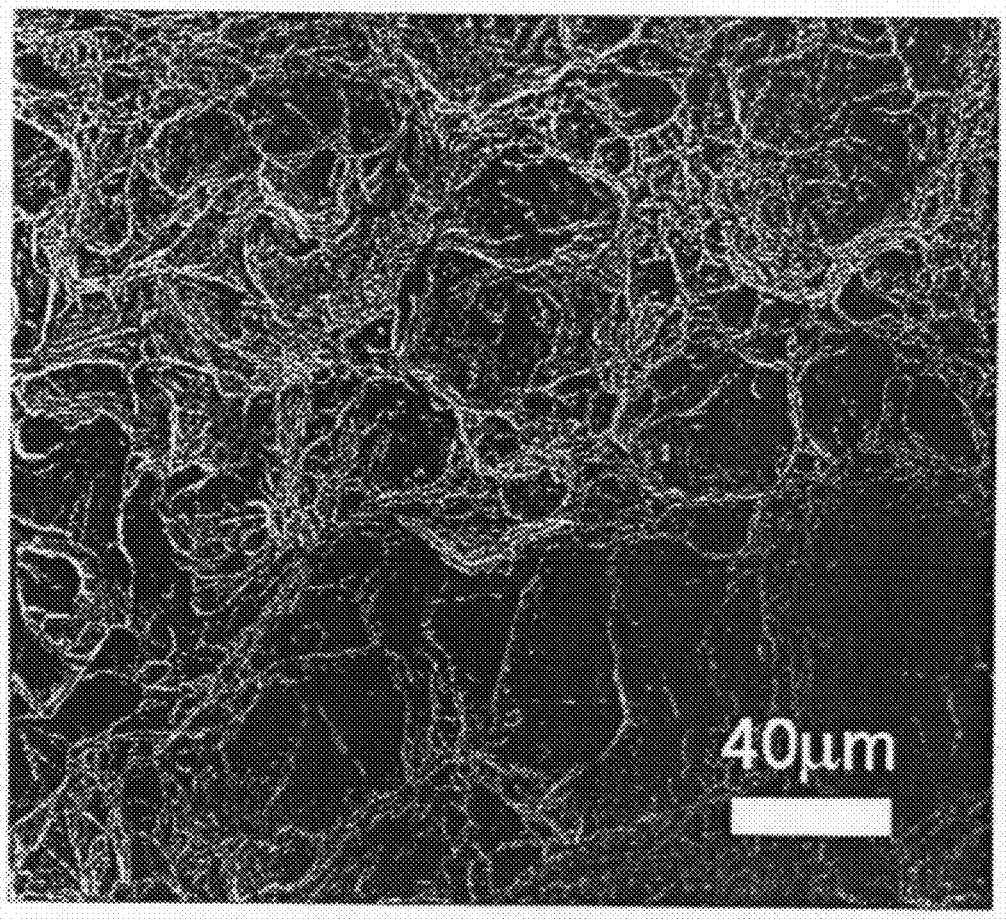
FIG. 49 is a SEM micrograph of mixed ductile/brittle mode fracture surface showing microvoids with some tear ridges for the 550° C. 30 min+450° C. 5 hrs multi-step tempering treatment tested at −40° C.
Figure 50:
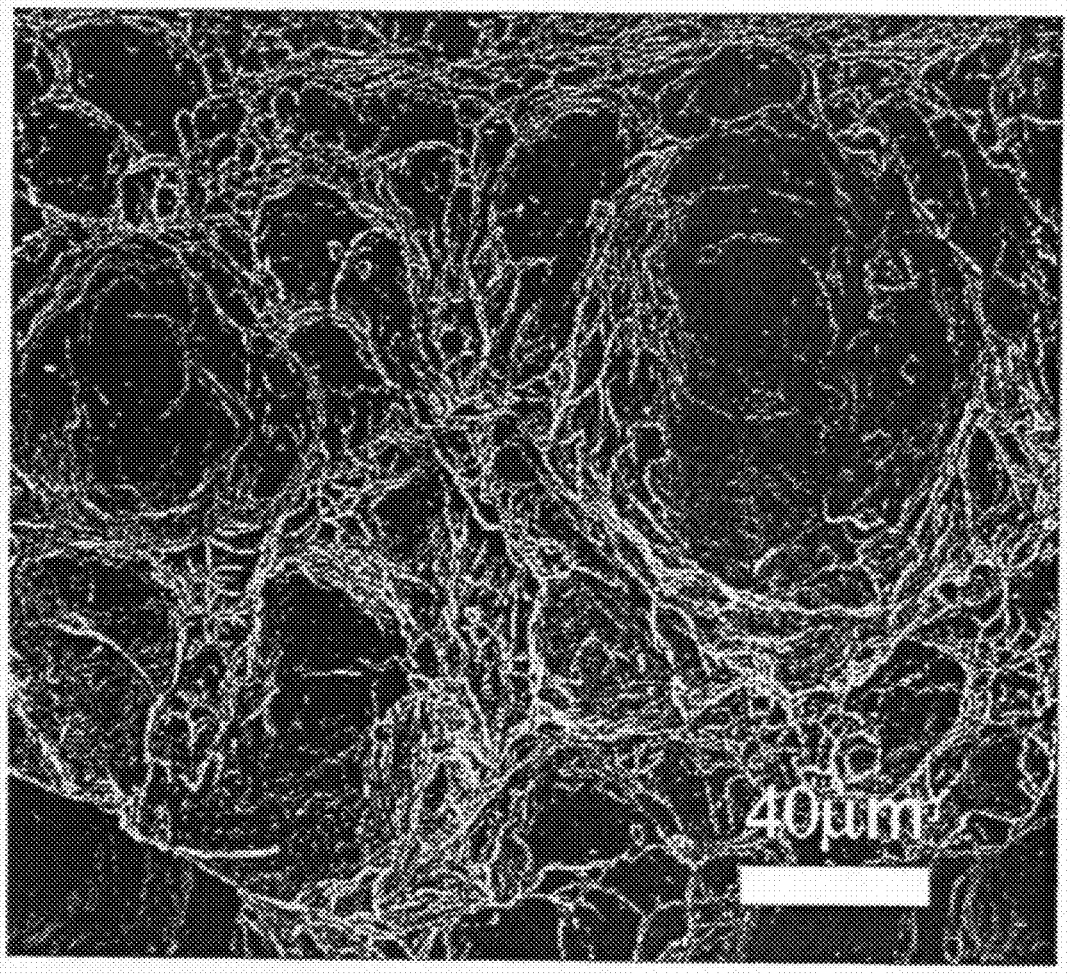
FIG. 50 is a SEM micrograph of purely ductile mode fracture surface showing primary voids and microvoids for the 550° C. 30 min+450° C. 5 hrs multi-step tempering treatment tested at −20° C.
Figure 51:
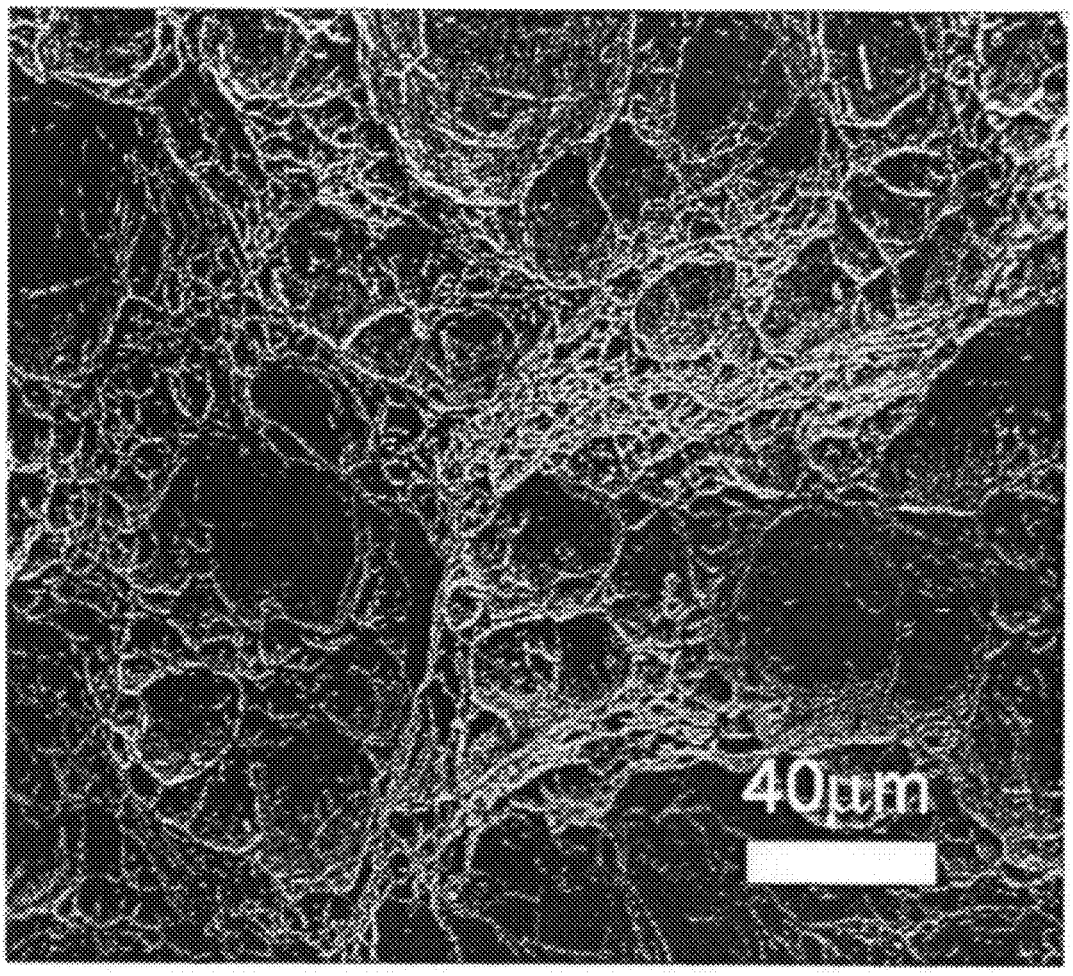
FIG. 51 is a SEM micrograph of purely ductile mode fracture surface showing primary voids and microvoids for the 550° C. 30 min+450° C. 5 hrs multi-step tempering treatment tested at 0° C.
Figure 52:
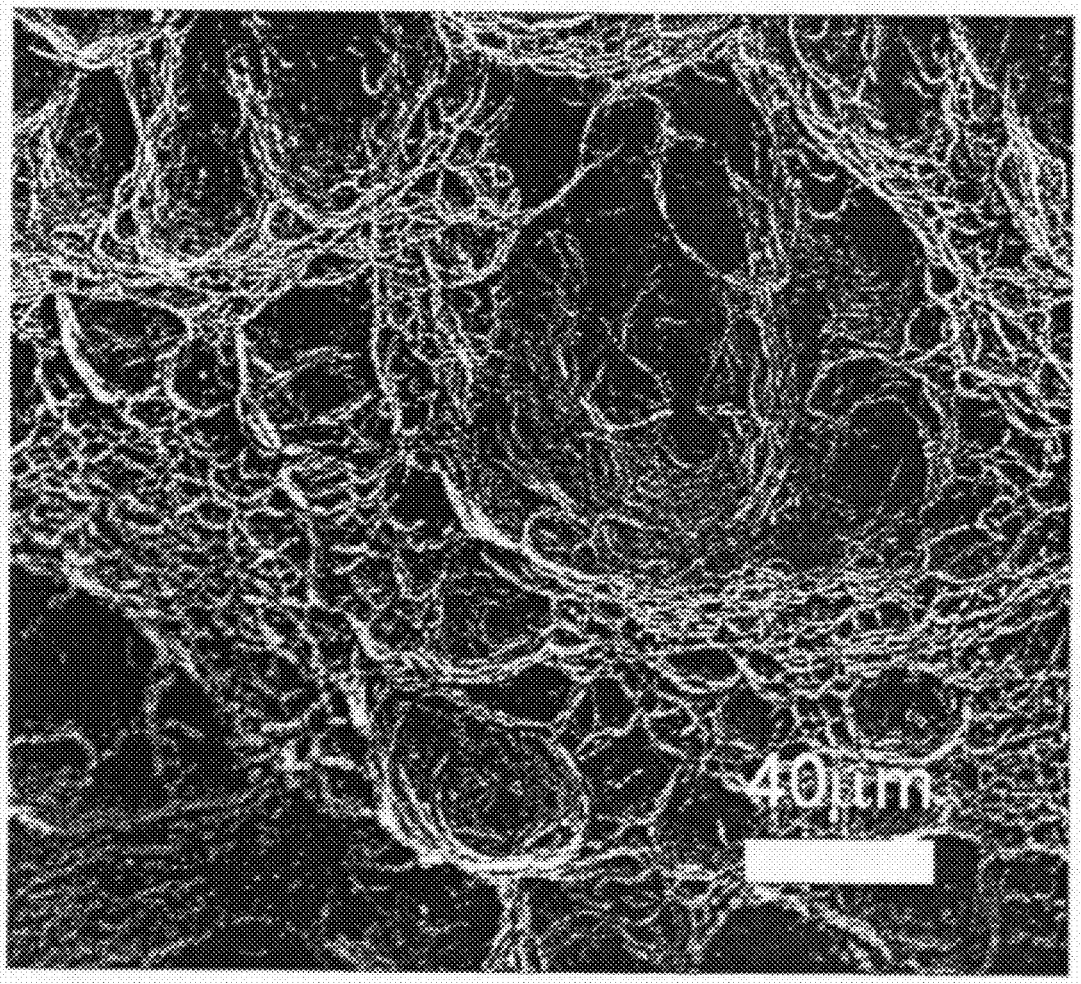
FIG. 52 SEM micrograph of purely ductile mode fracture surface showing primary voids and microvoids for the 550° C. 30 min+450° C. 5 hrs multi-step tempering treatment tested at 100° C.

SEM micrographs of the fracture surfaces presented in FIGS. 48 to 52 at each of the test temperatures establish the mode of fracture. FIG. 48 shows that the fracture surface for the alloy tested at −84° C. is representative of quasicleavage fracture characterized by the array of flat facets with dimples and tear ridges around the periphery of the facets. This indicates a brittle mode of failure. However, as the test temperature is increased to −40° C., the fracture surface primarily consists of microvoids. Although most of the fracture surface is characteristic of ductile mode of fracture, closer investigation of FIG. 49 shows that there are a few tear ridges with facets, indicating a slightly mixed fracture mode. FIGS. 50, 51 and 52 are representative micrographs from fracture surfaces of alloys tested at −20° C., 0° C. and 100° C. respectively showing purely ductile mode of fracture characterized by primary voids and microvoids without any evidence of flat facets. The micrographs for the fracture surface of the prototype tested at room temperature are presented in FIGS. 43 and 44, which contain mostly primary voids with very few microvoids. The delay of microvoid shear localization caused by the dispersed phase, transformation toughened, optimal stability austenite at the crack-tip stress state leads to more extensive growth of the primary voids before they coalesce by microvoiding. This finding further supports transformation toughening by multi-step tempering to precipitate an optimal stability dispersion of austenite. Toughness enhancement is increased by a larger volume change. FIG. 47 indicates that the toughness enhancement in the alloy is 30%.

Microstructural Validation

Optimization of the processing conditions of the alloy for dispersed phase transformation toughening in combination with a fine dispersion of strengthening precipitates has been supported by property evaluation in the previous sections. Microanalytical characterization of the austenite dispersion and the strengthening precipitates and their interaction with the other substructures in the prototype was performed.

Three-Dimensional Atom Probe (3DAP) Microscopy

3DAP microscopy was chosen to the be the preferred method of characterization over X-Ray diffraction, Magnetometry and Transmission Electron Microscopy for identifying the nanometer scale intra-lath austenite and the optimal 3 nm particle size strengthening precipitates in the transformation toughened alloy. This characterization tool was used as a means of evaluating the matrix composition as well as precipitate compositions, sizes, morphologies and their average number density.

The choice of samples for analysis was based on the condition of tempering treatment for the highest obtainable number density of the precipitates, determined from the assessed mechanical properties (FIG. 42). Thus, the tempering condition corresponding to the highest observed strength (Table 5) namely, 500° C. 30 min+450° C. 5 hrs was chosen. The 450° C. 1 hour tempering condition was also chosen as a reference for comparison with 3DAP data on similar Cu-strengthened steels as well as with the other tempering condition. For simplification, the 450° C. 1 hour tempering treatment specimen is referred to as the "single-step temper" and the 500° C. 30 min followed by 450° C. Stirs tempering treatment specimen is referred to as the "multi-step temper". The data for both the tempering conditions is presented simultaneously for easier comparison.

The analyzed tips were isothermally aged according to their respective schedules, following solution treatment at 900° C. for 1 hour, water quench and liquid nitrogen quench. The overall composition of the reconstructed volume from atom probe analysis was obtained and compared with the actual composition of the prototype as shown in Table 7. It is seen that the actual compositions compare well with that for the elements detected. The error for the concentrations is given by $2\sigma_c$, where $\sigma_c=\sqrt{c(1-c)/N}$, with c being the measured composition and N being the total number of atoms detected. Thus, the statistical error associated with composition analysis decreases as the total number of atoms detected increases.

TABLE 7

Comparison between the actual overall composition of alloy and the overall compositions determined by 3DAP analysis

| | Actual Overall Composition | | Overall Composition from 3DAP | |
|---|---|---|---|---|
| | | | 450° C. 1 hr | 500° C. 30 min + 450° C. 5 hrs |
| Element | wt % | at % | at % | at % |
| Fe | 87.2 | 90 | 89.90 ± 0.08 | 88.58 ± 0.18 |
| C | 0.04 | 0.192 | 0.11 ± 0.24 | 0.12 ± 0.53 |
| Cu | 3.64 | 3.30 | 2.37 ± 0.23 | 1.13 ± 0.53 |
| Ni | 6.61 | 6.49 | 5.34 ± 0.23 | 7.01 ± 0.52 |
| Cr | 1.78 | 1.97 | 1.86 ± 0.23 | 2.1 ± 0.53 |
| Mo | 0.58 | 0.35 | 0.31 ± 0.24 | 0.89 ± 0.53 |
| V | 0.11 | 0.124 | 0.11 ± 0.24 | 0.16 ± 0.53 |

Figure 53:
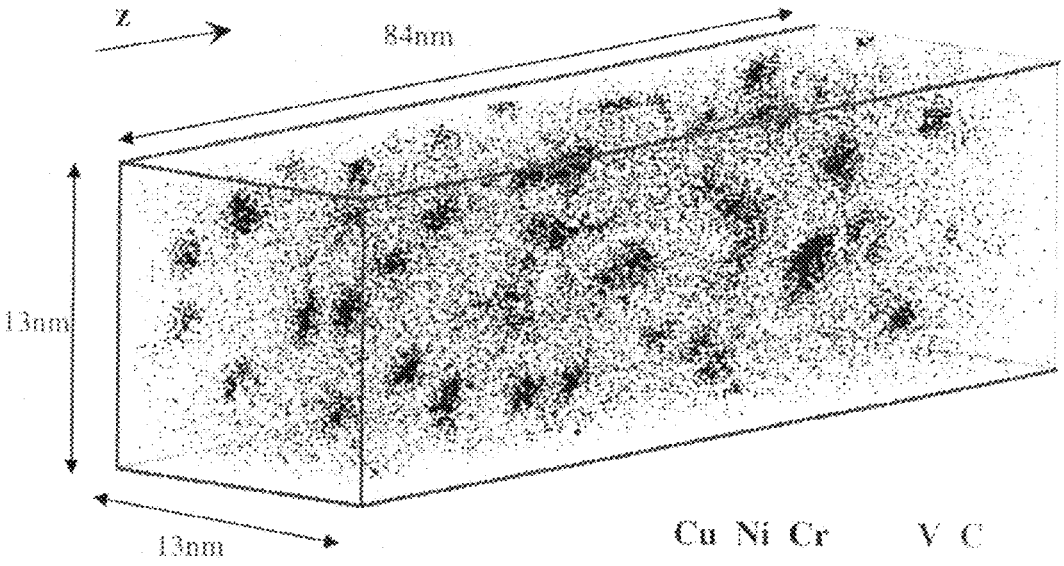
FIG. 53 is a 3DAP reconstruction for prototype tempered at 450° C. for 1 hour. The elements in the reconstruction are indicated by their color code. Iron is not shown to provide more clarity in viewing the particles. z is the direction of analysis.
Figure 54:
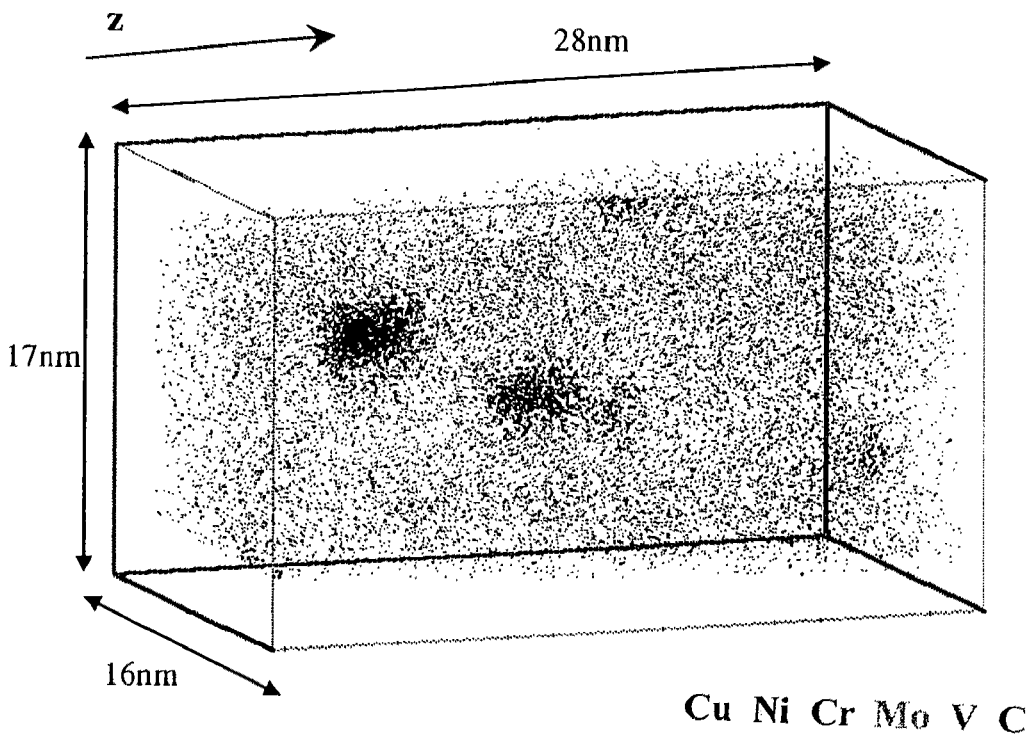
FIG. 54 is a 3DAP reconstruction for prototype tempered at 500° C. 30 min+450° C. 5 hrs. The elements in the reconstruction are indicated by their color code. Iron is not shown to provide more clarity in viewing the particles. z is the direction of analysis.

Atom probe analysis of the single-step temper was conducted at 50K while that for the multi-step temper at 70K with a pulse fraction of 20% at a pulse frequency of 1.5 kHz from 7 kV to 10 kV steady state DC voltage. The complete analysis for the single-step temper contained a total of 751,608 atoms in a reconstruction volume of dimensions 13 nm×13 nm×84 nm. The multi-step temper analysis collected 254,917 atoms in a reconstruction volume dimension of 17 nm×16 nm×28 nm. FIGS. 53 and 54 show partial 3D reconstruction of all the atoms detected after being field evaporated from the specimen with their positions and elemental identities for single-step and multi-step tempering conditions respectively. Iron is not shown in any reconstruction in this section for purpose of clarity, enabling larger microstructural features like precipitates to be seen distinctly.

Figure 55:
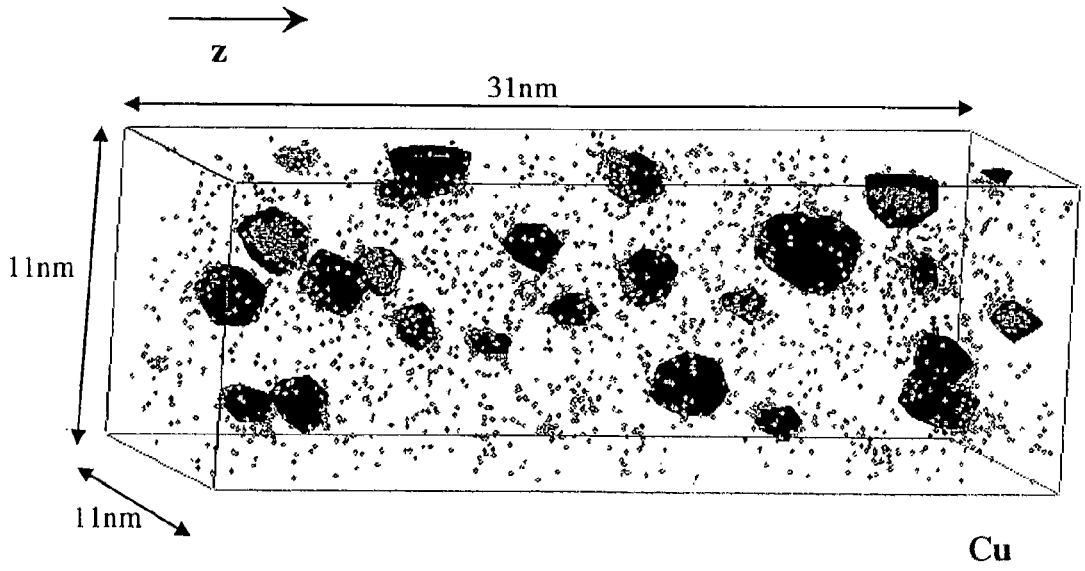
FIG. 55 is a 3DAP reconstruction for prototype tempered at 450° C. for 1 hour showing copper precipitates defined at 10 at % isoconcentration surface overlaid on atomic positions of copper atoms. All other atoms in the reconstruction are not shown. z is the direction of analysis.
Figure 56:
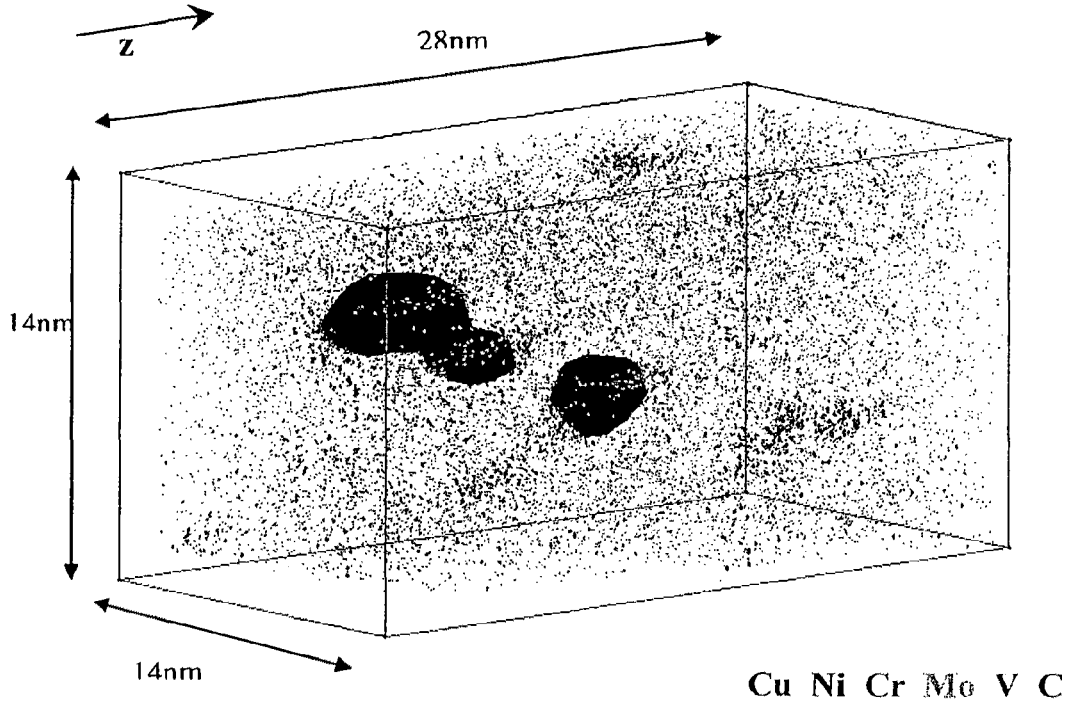
FIG. 56 is a 3DAP reconstruction for prototype tempered at 500° C. 30 min+450° C. 5 hrs showing copper precipitates defined by 10 at % isoconcentration surface overlaid on atomic positions of copper atoms. z is the direction of analysis.

The regions of high copper concentration are clearly noticeable in both FIGS. 53 and 54 confirming the presence of a nanometer sized copper particle distribution in the microstructure. These copper—rich precipitates can be represented by an isoconcentration surface at 10 at % copper level overlaid with the atomic positions of copper atoms as shown in FIGS. 55 and 56. The isoconcentration surfaces clearly outline the Cu-rich precipitates. The size of the copper precipitates for the single-step temper is relatively smaller than that for the multi-step temper, while the number density of precipitates for the former is much higher.

The shape of the copper precipitates appears to be elliptical and stretched in the direction of analysis for both the tempering conditions. The distortion is an instrument artifact due to a magnification effect caused by the difference in field evaporation of copper precipitates compared to the matrix. The precipitates are believed to be spherical in shape.

Having defined the copper precipitates by the isoconcentration surface, the size, number densities and compositions of these copper precipitates can be determined with the help of the 3DAP analysis software, ADAM. Cross-sectional views from an analyzed volume of the reconstruction were used to measure the size of the precipitates. For the single-step temper, the average diameter of the copper precipitates contained completely within the analysis volume was found to be 2.67±0.57 nm while that for the multi-step temper is 3.79±0.13 nm. From the hardness data, it is apparent that the multi-step temper corresponds to the peak aging condition. However, considering the statistical error of the measurement and a distribution of particle sizes in the material, the optimal particle size of BCC Cu-precipitates for maximum particle size lies within about 2.5-4

The number density of strengthening Cu precipitates is higher for the single-step temper than the multi-step temper. The number density of the copper precipitates in the analyzed volume was estimated by Equation 13.

$$N_V = \frac{N_p \zeta}{n\Omega} \tag{13}$$

$N_p$ and n are the number of particles and the total number of atoms detected in the volume, Ω is the average atomic volume and ζ is the detection efficiency of a single ion detector, equal to 0.6 in this case. The number density of copper precipitates for the single-step temper was calculated to be $5.42\times10^{18}$ precipitates/cm$^3$ while that for multi-step temper was calculated to be $1.2\times10^{18}$ precipitates/cm$^3$. The high number density measured for the single-step temper (4.5 times that for multi-step temper) is consistent with the high Cu content of the alloy. Evidence for cementite dissolution in the toughness-hardness plots of FIG. 42 support the presence of $M_2C$ carbides contributing to the strength of the multi-step tempered material.

The average matrix and precipitate compositions can be determined from the analyzed volume by calculating the fraction of atoms of each element within the phase. To analyze the composition of the inner core of the precipitates, a higher threshold level of 15 at % was set to isolate them. Tables 8 and 9 give the composition of the Cu-precipitates and the matrix respectively with 2σ error bar limits for both the single-step and multi-step conditions. Table 9 also compares alloy matrix composition with the homogeneous phase composition of the BCC matrix predicted for austenite stability.

TABLE 8

Average copper precipitate compositions determined by 3DAP analysis for selected heat treatment compositions.

| | BCC Cu Precipitate Composition from 3DAP analysis | |
|---|---|---|
| Element | 450° C. 1 hr at % | 500° C. 30 min + 450° C. 5 hrs at % |
| Fe | 30.25 ± 3.53 | 43.79 ± 6.52 |
| Cu | 63.50 ± 2.55 | 46.69 ± 6.35 |
| Ni | 5.40 ± 4.11 | 8.76 ± 8.31 |
| C | ND | ND |
| Cr | 0.40 ± 4.21 | 0.57 ± 8.67 |
| Mo | 0.13 ± 4.22 | ND |
| V | ND | 0.19 ± 8.69 |

ND means not detected

TABLE 9

Average matrix compositions determined by 3DAP analysis for selected heat treatment compositions compared with equilibrium prediction.

| | BCC Matrix Composition from 3DAP analysis | | Equilibrium Prediction |
|---|---|---|---|
| Element | 450° C. 1 hr at % | 500° C. 30 min + 450° C. 5 hrs at % | 490° C. At % |
| Fe | 91.22 ± 0.49 | 92.01 ± 0.22 | 94.1 |
| Cu | 0.73 ± 0.66 | 0.22 ± 0.77 | 0.12 |
| Ni | 5.32 ± 1.62 | 6.33 ± 0.74 | 3.78 |
| C | 0.014 ± 1.67 | 0.041 ± 0.77 | 0.000044 |
| Cr | 2.18 ± 1.65 | 0.88 ± 0.76 | 1.88 |
| Mo | 0.44 ± 1.66 | 0.39 ± 0.77 | 0.10 |
| V | 0.09 ± 1.67 | 0.12 ± 0.77 | 0.02 |

ND means not detected

The results of the 3DAP analysis indicate that the matrix composition for both heat treatment conditions compare reasonably well with the predicted equilibrium calculations. The matrix Cu composition is near the predicted equilibrium composition at the earliest evolution stage, indicating a high degree of Cu precipitation and it remains at the equilibrium condition for the multi-step temper composition analyzed. The relatively higher Ni level observed for both conditions may be associated with the microsegregation compositional banding described earlier. The difference between the homogeneous equilibrium matrix Ni prediction and the 3DAP microanalysis results is consistent with the level of banding microsegregation observed with respect to Ni.

Figure 57:
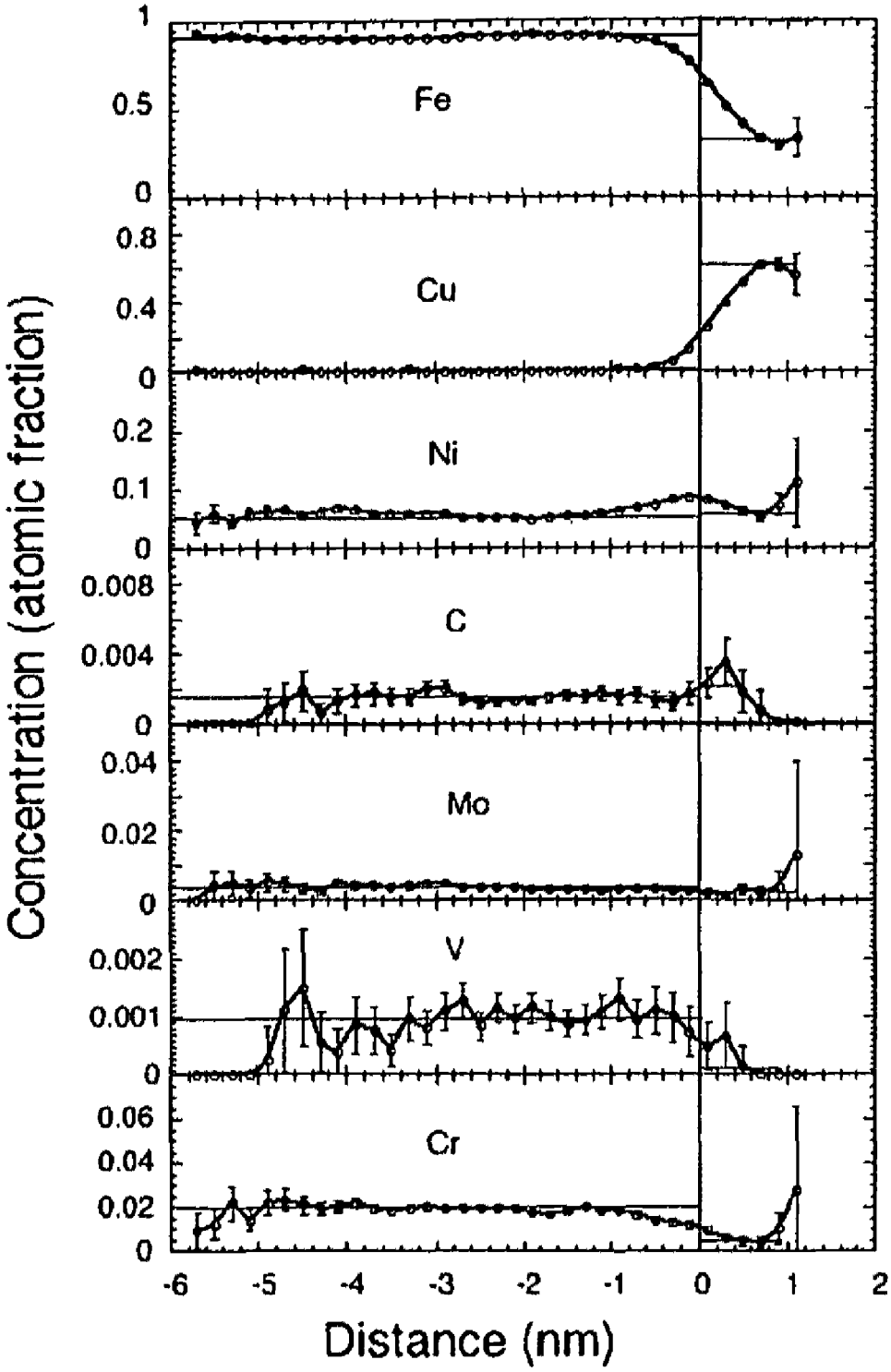
FIG. 57 is a proxigram of all the solute species detected in the 450° C. 1 hr temper specimen with respect to 10 at % copper isoconcentration surface in the analysis volume.

The average matrix and precipitate compositions and the concentration of the various solute atoms near the matrix/precipitate interface can be investigated by a proximity histogram, or "proxigram", available in ADAM. The concentration values were determined by averaging the concentration in 0.2 nm peripheral shells around all the precipitates with respect to the 10 at % copper isoconcentration surface, within and outside the precipitates. The negative values in abscissa represent the matrix composition while the positive values are indicative of the precipitate compositions. However, the zero point is not necessarily a correct estimate of the precipitate/matrix interface and serves as an approximate reference point. The proxigrams obtained from analysis of copper precipitates in single-step temper and multi-step temper samples are presented in FIGS. 57 and 58 respectively. The proxigrams indicate that for both cases of tempering condition, Ni shows considerable partitioning to the precipitate/matrix interface while that for other solute atoms is within the error limit of estimation. The level of Ni enrichment at the interface is about 50% higher than the matrix Ni content for the single-step temper observed in FIG. 57.

Figure 58:
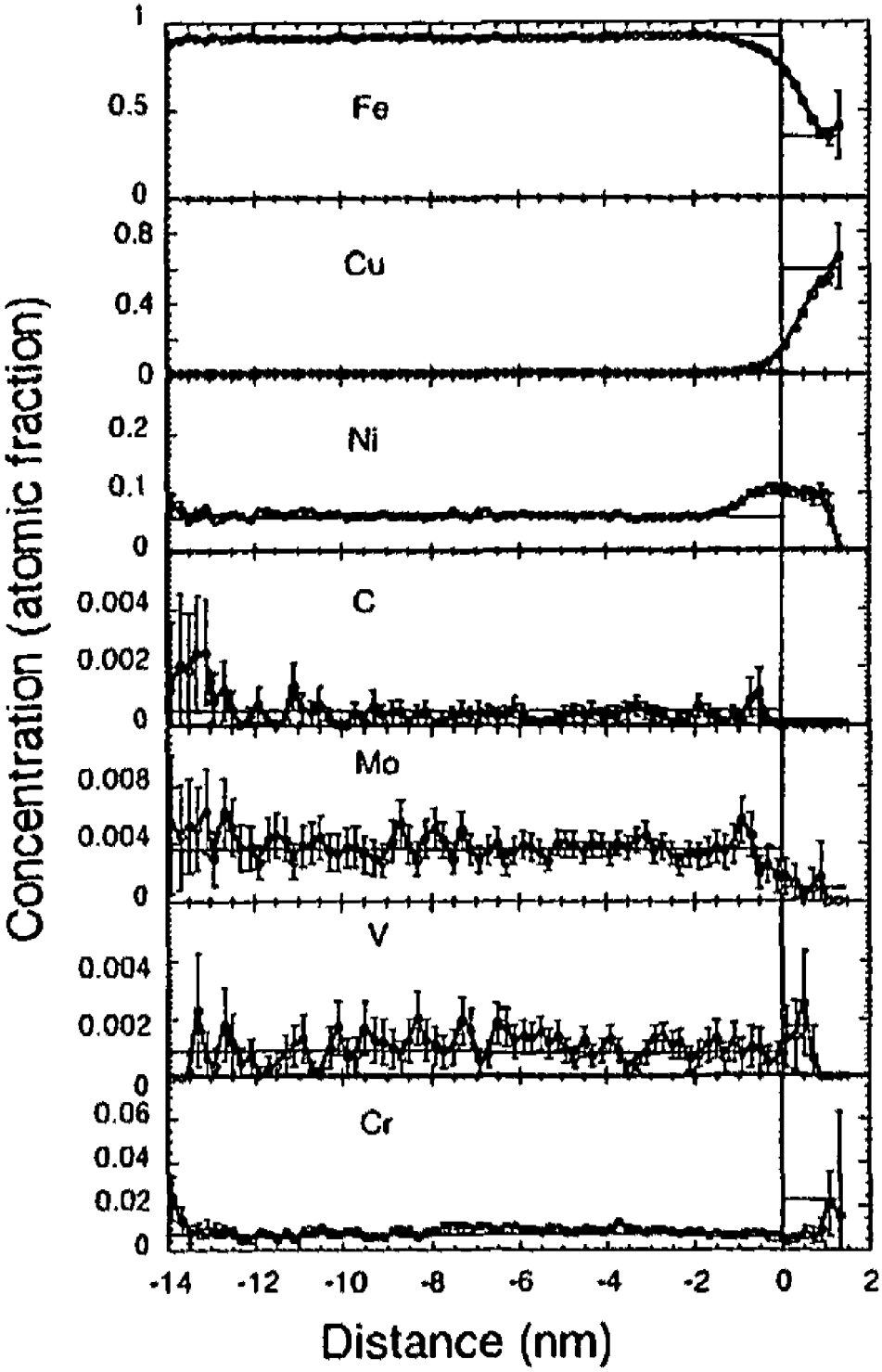
FIG. 58 is a proxigram of all the solute species detected in the 500° C. 30 min+450° C. 5 hrs temper specimen with respect to 10 at % copper isoconcentration surface in the analysis volume.
Figure 59:
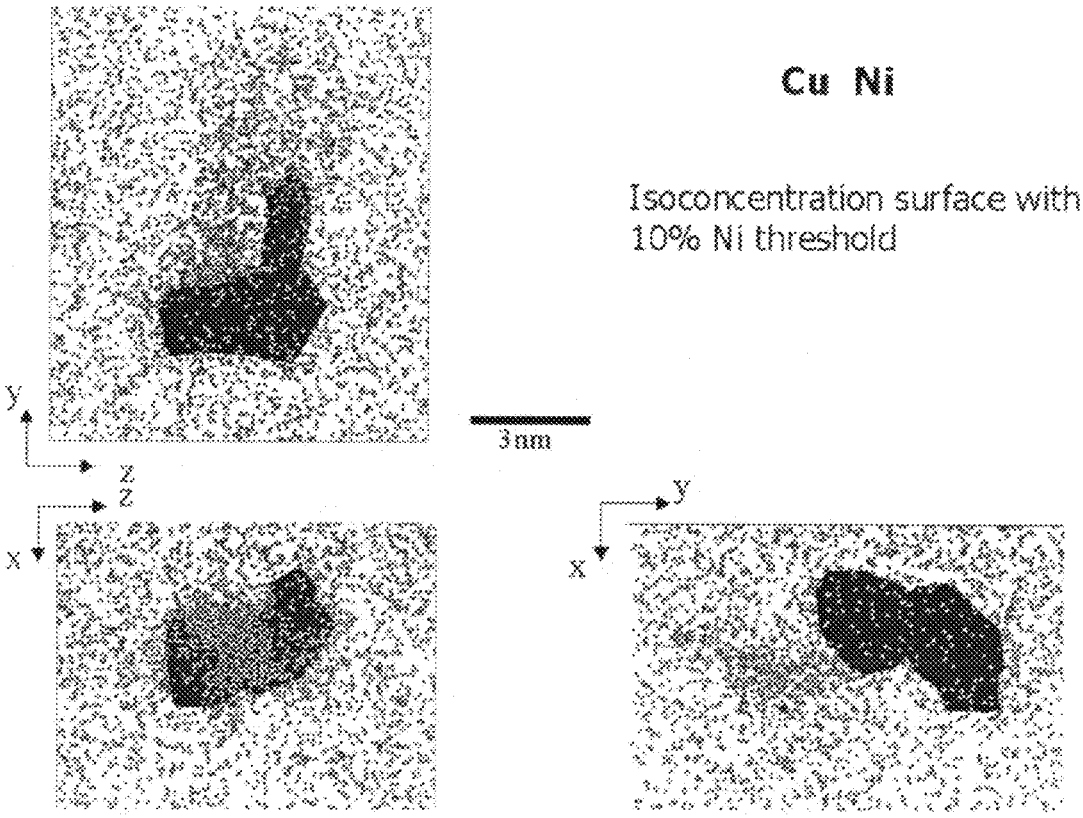
FIG. 59 is a 3DAP reconstruction for prototype tempered at 500° C. 30 min+450° C. 5 hrs showing austenite defined by 10 at % Ni level isoconcentration surface overlaid on atomic positions of nickel and copper atoms. z is the direction of analysis.

Referring to FIG. 58, that the level of Ni located near the interface was more than 50% with respect to the matrix Ni content for the multi-step temper condition. This led to further investigation of the precipitate/matrix interface region by varying Ni concentration threshold levels in the 3D reconstruction for the multi-step temper. Setting a 10 at % level for Ni, the isoconcentration surface of a Ni-rich precipitate at the interface of the Cu-rich precipitates could be identified. FIG. 59 shows the isoconcentration surface outlining the Ni-rich precipitate defined at 10 at % Ni, overlaid with atomic positions of Cu and Ni from three different orientations. Composition analysis for the Ni-rich precipitate and its comparison with equilibrium prediction of austenite composition is shown in Table 10. Ni concentration of 19.5 at % in the precipitate demonstrates that the precipitate is the desired austenite of optimum stability for transformation toughening. Lower than equilibrium concentration of the Ni in the austenite estimated as 30 at % may be attributed to the local magnification effects previously mentioned. This is further supported by the higher (twice) Cu level in austenite than equilibrium prediction due to the possibility of having copper atoms from the adjacent copper precipitates projected into the austenite precipitate because of the solute overlap effect. Since only a single austenite particle was observed, the statistical error associated with the composition estimation is likely significant. To confirm the Ni content of austenite, further investigation was done by a one-dimensional composition profile plotted along the atom-probe analysis direction in FIG. 60. This confirmed that the Ni content of austenite is 30 at % and is consistent with equilibrium values.

TABLE 10

Average austenite composition determined by 3DAP analysis for selected heat treatment compositions compared with equilibrium prediction.

| | Austenite Composition from 3DAP analysis 500° C. 30 min + 450° C. 5 hrs | Equilibrium Prediction 490° C. |
|---|---|---|
| Element | at % | at % |
| Fe | 65.9 ± 5.6 | 61.5 |
| Cu | 13.9 ± 8.9 | 6.97 |
| Ni | 19.3 ± 8.6 | 29.8 |
| C | ND | 0.00068 |
| Cr | 0.93 ± 9.6 | 1.47 |
| Mo | ND | 0.03 |
| V | ND | 0.00084 |

ND means not detected

Figure 60:
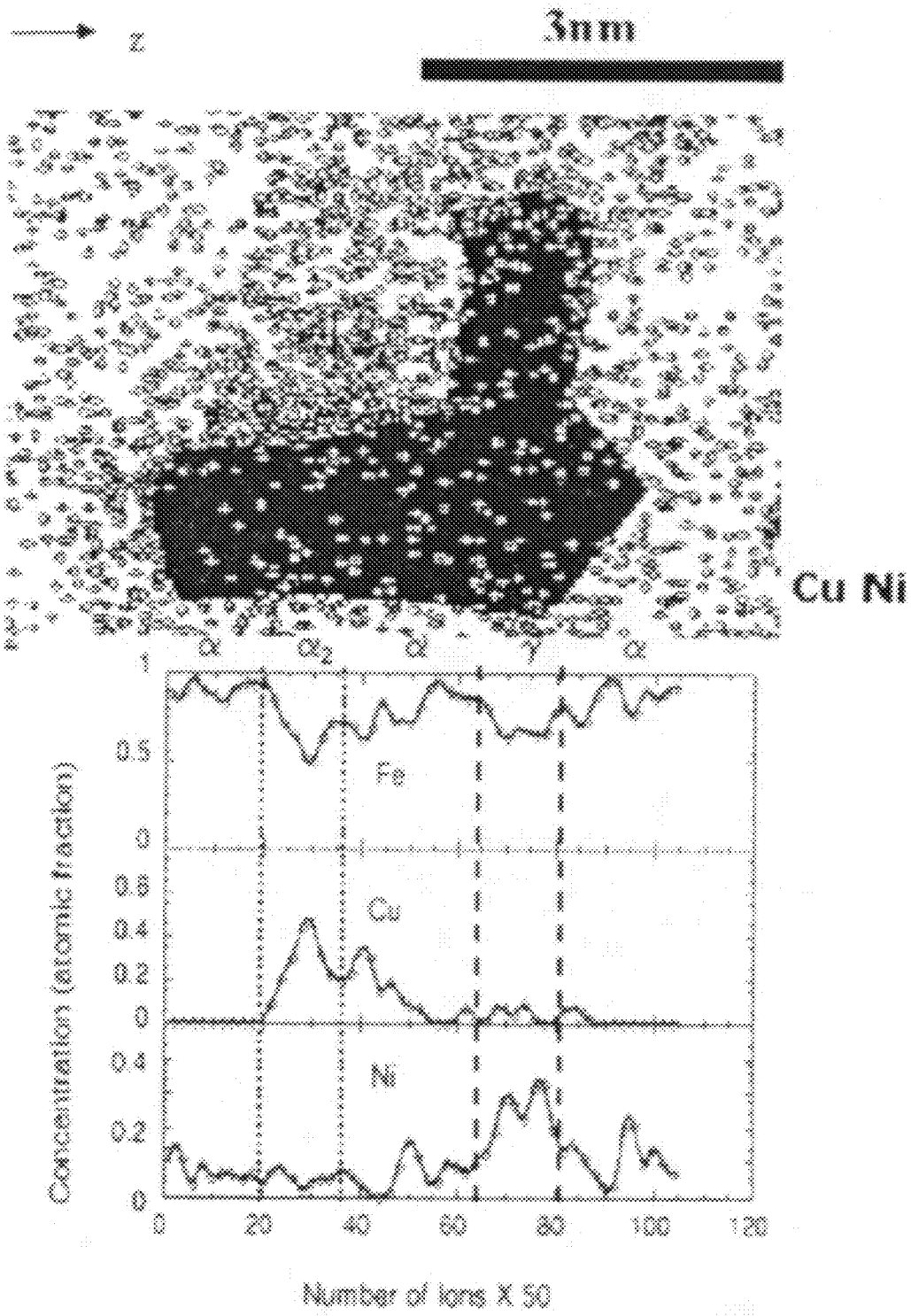
FIG. 60 is a One-dimensional composition profile along the atom-probe analysis direction in the 500° C. 30 min+450° C. 5 hrs temper specimen with respect to 10 at % copper isoconcentration surface in the analysis volume. z is the direction of analysis.

The size and location of the austenite precipitate, measured as 5 nm from FIG. 60, confirms that it is intralath austenite nucleated on two adjacent Cu precipitates. This result provides direct visual evidence of the heterogeneous nucleation of intralath austenite on a fine dispersion of strengthening precipitates; Cu precipitates in this case. This finding also strengthens the transformation toughening conclusion of an optimal stability austenite dispersion is effected by employing a multi-step tempering treatment to nucleate the austenite in the first tempering step followed by a Ni-enrichment final tempering step.

No $M_2C$ carbide precipitate was identified in the atom-probe reconstructions. Because of the low equilibrium phase fraction of $M_2C$ calculated for the optimal tempering treatment, the precipitates might have been excluded from the analysis volume of the atom probe. Also, detection of carbide particles is difficult because of differences in the field evaporation rates between the carbide and the surrounding matrix that cause the carbide to stick out in relief leading to tip-fracture. Such a situation was encountered during the multi-step temper atom-probe run, when a high level of carbon and molybdenum was observed in the in-situ composition profile during data collection and the tip fractured soon thereafter. No data could thus be obtained for 3D reconstruction and characterization of $M_2C$ carbide in the alloy.

Figure 61:
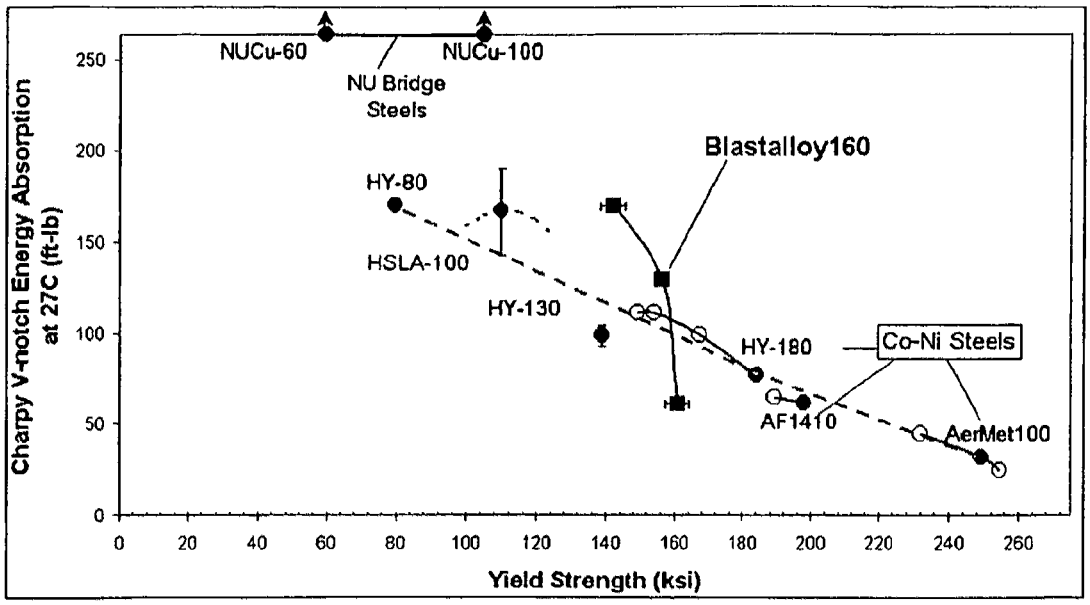
FIG. 61 is a toughness-yield strength comparison plot of Blastalloy160 with other commercial and experimental steels.

Impact toughness of 130 ft-lb was achieved at 160 ksi yield strength for a multi-step tempering condition of the alloy, which is a significant improvement of properties over other conventional alloys. FIG. 61 graphically represents the toughness-strength combination of the alloy for three different tempering conditions in comparison to other commercial and experimental alloys.

Summary

To simulate a continuous casting process, a 34 lb (15.4 kg) Vacuum Induction Melt (VIM) heat of the alloy was slab cast as 1.75" (4.45 cm) plate, homogenized for 8 hours at 2200° F. (1204° C.), hot-rolled to 0.45" (1.14 cm) and then annealed at 900° F. (482° C.) for 10 (1 hours. Consistent with microsegregation/homogenization simulations, compositional banding in the plate was limited to an amplitude of 6-7.5 wt % Ni, 3.5-5 wt % Cu, 1.6-2 wt % Cr, and 0.2-0.5 wt % Mo. Examination of the oxide scale showed no evidence of hot shortness in the alloy during hot working. The evaluation of the alloy for different tempering conditions was conducted under an initial martensitic condition obtained by austenizing solution treatment at 900° C. for 1 hour followed by a water-quench and a liquid nitrogen cool. Since this is an alloy for low-cost air-hardenable plate steel, isothermal transformation kinetics measurements were also conducted, demonstrating achievement of 50% bainite in 4 minutes at 360° C. Hardness and tensile tests confirmed predicted precipitation strengthening behavior in quench and tempered material. Isochronal tempering studies at 1 hour confirmed peak strengthening at 420° C. with gradual overaging. Multi-step tempering was employed to optimize the austenite dispersion and a significant enhancement in toughness was observed with minimal loss in strength for a 550° C. 30 min+450° C. 5 hrs tempering condition. An optimal austenite stability was indicated by a significant increase of impact toughness to 130 ft-lb at a strength level of 160 ksi. Comparison with the baseline toughness-strength combination determined by isochronal tempering studies indicates a significant transformation toughening increment of 60% in Charpy energy. Tensile tests were conducted on the preferred tempering conditions to confirm the predicted strength levels. Charpy impact tests and fractography demonstrate ductile fracture with $C_v$>80 ft-lbs down to −40° C., with a substantial toughness peak at 25° C. Cu particle number densities and the heterogeneous nucleation of optimal stability high Ni 5 nm austenite on nanometer-scale copper precipitates in the multi-step tempered samples were confirmed using three-dimensional atom probe microscopy. The copper precipitate size was verified for peak strengthening at about 2-3 nm, and a precipitate composition of 50-60% copper for short tempering times was confirmed. The fine austenite dispersion showed a Ni content near of about 30%.

Variations of the composition of the steel alloy as well as the processing thereof may be undertaken without departing from the spirit and scope of the invention. Therefore, while there have been described preferred compositions and methods, the invention is to be limited only by the following claims and equivalents thereof.

What is claimed is:

1. A hardened steel alloy having enhanced toughness, weldability strength and workability, said steel alloy comprising in weight percent about:

0.030 to 0.055 carbon (C);
3.50 to 5.0 copper (Cu);
6.0 to 7.5 nickel (Ni);
1.6 to 2.0 chromium (Cr);
0.2 to 0.6 molybdenum (Mo);
0.05 to 0.20 vanadium (V), and
the balance iron (Fe) characterized by a yield strength exceeding about 140 Ksi, and an essentially martensitic microstructure dispersed with BCC copper hardening precipitates, $M_2C$ carbide strengthening particles where M is one or more elements selected from the group consisting of Cr, Mo, and V, and Ni-stabilized precipitated austenite.

2. The steel alloy of claim 1 wherein the steel is characterized by secondary hardening.

3. The steel alloy of claim 1 having been subjected to a first tempering step in the range of about 450° C. for a period of about 30 to 90 minutes.

4. The steel alloy of claim 3 having been subjected to a second tempering step in the range of about 300° C. to 450° C. for a period of about 1 to 10 hours.

5. A method for manufacture of a hardened steel alloy comprising the steps of:

(a) forming a melt into a steel alloy casting comprised in weight percent of about 0.030 to 0.055 carbon (C), 3.5 to 5.0 copper (Cu), 6.0 to 7.5 nickel (Ni), 1.6 to 2.0 chromium (Cr), 0.2 to 0.6 molybdenum (Mo), 0.05 to 0.20 vanadium (V) and the balance iron;
(b) homogenizing the steel alloy casting at a temperature in the range of about 1200° C.±50°for about 6 to 8 hours;
(c) hot working said steel alloy;
(d) ambient cooling said steel alloy;
(e) annealing said steel alloy at a temperature in the range of about 480° C.±40° C. for about 8 to 12 hours;
(f) solution heating said steel alloy at a temperature of about 900° C.±50° C. for about 30 to 90 minutes;
(g) cooling said steel alloy to form an essentially martensitic microstructure;
(h) tempering said steel alloy at a temperature of about 500° C. to 575° C. for about 5 to 90 minutes to achieve Ni-stabilized austenite precipitation; and
(i) further tempering said steel alloy at a temperature of about 400° C. to 500° C. for about 1 to 10 hours to achieve $M_2C$ carbide particle formation where M is one or more elements selected from the group consisting of Cr, Mo, and V, and BCC copper hardening precipitates.

6. A method for manufacture of a hardened steel alloy comprising the steps of:

(a) forming a melt into a steel alloy casting comprised in weight percent of about 0.030 to 0.055 carbon (C), 3.5 to 5.0 copper (Cu), 6.0 to 7.5 nickel (Ni), 1.6 to 2.0 chromium (Cr), 0.2 to 0.6 molybdenum (Mo), 0.05 to 0.20 vanadium (V) and the balance iron;

(b) heat treating and working said steel alloy to form an essentially martentsitic microstructure;

(c) tempering said steel alloy at a temperature of about 500° C. to 575° C. for about 5 to 90 minutes to achieve dispersed austenite precipitation; and (d) further tempering said steel alloy at a temperature of about 400° C. to 500° C. for about 1 to 10 hours to achieve $M_2C$ carbide particle formation where M is one or more elements selected from the group consisting of Cr, Mo, and V, and BCC copper hardening precipitates.

* * * * *